United States Patent [19]

Aoki

[11] Patent Number: 4,499,808

[45] Date of Patent: Feb. 19, 1985

[54] ELECTRONIC MUSICAL INSTRUMENTS HAVING AUTOMATIC ENSEMBLE FUNCTION

[75] Inventor: Eiichiro Aoki, Hamamatsu, Japan

[73] Assignee: Nippon Gakki Seizo Kabushiki Kaisha, Hamamatsu, Japan

[21] Appl. No.: 469,956

[22] Filed: Feb. 25, 1983

Related U.S. Application Data

[63] Continuation of Ser. No. 469,956, Dec. 24, 1980, abandoned.

[30] Foreign Application Priority Data

Dec. 28, 1979 [JP] Japan ..... 54-170939

[51] Int. Cl.[3] ..... G10F 1/00

[52] U.S. Cl. ..... 84/1.03; 84/1.24

[58] Field of Search ..... 84/1.01, 1.03, DIG. 22, 84/1.24

[56] References Cited

U.S. PATENT DOCUMENTS 4,120,225 10/1978 Dietrich et al. ..... 84/1.03

4,205,576 6/1980 Deutsch et al. ..... 84/DIG. 22

4,282,788 8/1981 Yamaga et al. ..... 84/1.03

4,292,874 10/1981 Jones et al. ..... 84/1.03

4,312,257 1/1982 Kato et al. ..... 84/1.03

*Primary Examiner*—Forester W. Isen

*Attorney, Agent, or Firm*—Spensley, Horn, Jubas & Lubitz

[57] ABSTRACT

One or a plurality of tones having a predetermined interval relation in terms of degrees with reference to tones produced by depressed keys of a keyboard are automatically selected from among diatonic scale tones of a performed tonality and the selected tones are produced as musical tones concurrently with the depressed key tones. To this end there are provided a tonality designator for producing an information representing the performed tonality, a duet note data forming circuit for forming pitch data of an ensemble note to be automatically produced necessary to realize a duet performance effect based the designated tonality and the depressed key tone, and a duet musical tone signal generator for producing a duet musical tone signal in accordance with the pitch data thus formed.

27 Claims, 30 Drawing Figures

#2 TABLE 529 (RAM)

| | ADDRESS | M 1 | M 2 |
|---|---|---|---|
| AREA | 0<br>1<br>2<br>3 | (DC TABLE) | (DCN TABLE) |
| | 4<br>5<br>6<br>7<br>8<br>9<br>10<br>11<br>12<br>13<br>14<br>15 | (DN TABLE) | (DUET TABLE)<br>(△KC) |
| AREA | 16<br>17<br>18<br>19 | (DC TABLE) | (DCN TABLE) |
| | 20<br>21<br>22<br>⋮<br>31 | (DN TABLE) | (DUET TABLE)<br>(△KC) |
| | 32<br>⋮<br>159 | ⋮ | ⋮ |

#1 TABLE 528 (C MAJOR TONALITY MEMORY PORTION)

| | ADDRESS | M1 (m)(7th) | M2 |
|---|---|---|---|
| AREA (C) | 0 | NC·C,0,0 | NC·C |
| | 1 | NC·C,0,0 | NC·E |
| | 2 | NC·C,0,0 | NC·G |
| | 3 | all "1" | all "1" |
| | 4 | NC·C | −5 |
| | 5 | NC·C# | −6 |
| | 6 | NC·D | −3 |
| | 7 | NC·D# | −3 |
| | 8 | NC·E | −4 |
| | 9 | NC·F | −3 |
| | 0 | NC·F# | −6 |
| | 11 | NC·G | −3 |
| | 12 | NC·G# | −4 |
| | 13 | NC·A | −4 |
| | 14 | NC·A# | all "1" |
| | 15 | NC·B | −4 |
| AREA (Dm) | 16 | NC·D,1,0 | NC·D |
| | 17 | NC·D,1,0 | NC·F |
| | 18 | NC·D,1,0 | NC·A |
| | 19 | all "1" | all "1" |
| | 20 | NC·C | −3 |
| | 21 | NC·C# | −4 |
| | 22 | NC·D | −5 |
| | 23 | NC·D# | −6 |
| | 24 | NC·E | −4 |
| | 25 | NC·F | −3 |
| | 26 | NC·F# | −4 |
| | 27 | NC·G | −3 |
| | 28 | NC·G# | −3 |
| | 29 | NC·A | −4 |
| | 30 | NC·A# | −5 |
| | 31 | NC·B | −4 |
| | 32 | NC·D,1,1 | NC·D |
| | 33 | NC·D,1,1 | NC·D |
| | 34 | NC·D,1,1 | NC·D |
| | 35 | NC·D,1,1 | NC·D |
| | ⋮ | ⋮ | ⋮ |
| | 159 | | |

FIG.16A

#2 TABLE 529 (A MINOR TONALITY MEMORY PORTION)

| ADDRESS | M1 | M2 |
|---|---|---|
| 0 | NC·A, 1, 0 | NC·A |
| 1 | NC·A, 1, 0 | NC·C |
| 2 | NC·A, 1, 0 | NC·E |
| 3 | all "1" | all "1" |
| 4 | NC·A | −5 |
| 5 | NC·A# | −6 |
| 6 | NC·B | −3 |
| 7 | NC·C | −3 |
| 8 | NC·C# | −4 |
| 9 | NC·D | −3 |
| 10 | NC·D# | −3 |
| 11 | NC·E | −4 |
| 12 | NC·F | −3 |
| 13 | NC·F# | −4 |
| 14 | NC·G | −3 |
| 15 | NC·G# | −4 |
| 16 | NC·C,0,0 | NC.C |
| 17 | NC·C,0,0 | NC.E |
| 18 | NC·C,0,0 | NC.G |
| 19 | all "1" | all "1" |
| 20 | | |
| ⋮ | ⋮ | ⋮ |
| ⋮ | ⋮ | ⋮ |
| 143 | | |

FIG.16B

ELECTRONIC MUSICAL INSTRUMENTS HAVING AUTOMATIC ENSEMBLE FUNCTION

This is a continuation of application Ser. No. 469,956, filed on 12/24/80 now abandoned.

BACKGROUND OF THE INVENTION

This invention relates to an electronic musical instrument having an automatic ensemble function.

Among musical performance styles is included an ensemble performance, such as duet, trio and quartet. In this performance style a plurality of tones are simultaneously produced. Thus, usually, in addition to a melody, one or a plurality of tones having a predetermined interval relation with respect to the melody are simultaneously produced for the purpose of improving the feeling of the melody. Thus, for a music having a tendency of becoming monophonic, the ensemble performance thickens the tone thus eliminating the monophonic feeling, and where the ensemble performance is used at a bridge or release portion, the content of the music can be enriched. Such ensemble performance, however, requires a relatively high degree of skill so that this performance can not be enjoyed by all performers. Notwithstanding a desire of development of a musical instrument or an electronic musical instrument capable of automatically effecting the ensemble performance, the prior art electronic musical instrument or an automatic performance device could not automatically perform the desired ensemble performance.

Thus, there has been developed no automatic performance device capable of producing ensemble notes, nor has been impossible to modify the construction of an existing automatic performance device so as to perform the ensemble performance. A musical instrument has already been know in which a plurality of tones can be produced simultaneously by depressing only one key. For example, such musical instrument can, by depressing a key of a musical tone, produce a plurality of tones that is chords having predetermined interval relations with respect to the musical tone. Such musical instrument, however, is constructed to make automatic performance of the chords so that it has a musical effect different from that of the ensemble performance. For this reason even when an automatic performance device of chords is used for the ensemble performance, it is impossible to provide the effect of the true ensemble performance. Because, with the automatic performance device for chords, only the tones having always the same interval relation are produced irrespective of the note of the depressed key.

On the other hand, the basic principle of the ensemble performance lies in the simultaneous production of a plurality of tones having interval relations of predetermined degrees among the notes of the diatonic scale of the tonality key of the music. For this reason even for the same degree numbers, there may arise a case wherein the intervals differ by a semi-tone for different degree notes in the same tonality key. Thus, even though the third intervals have a same degree number, there are two different kinds i.e. a major third and a minor third depending on the notes. In the same manner, for the same note the ensemble note will be a major third or a minor third apart there from depending on the tonality keys. Not only in the cases of the major interval and the minor interval, but also in the cases of the fourth or fifth intervals, a difference between a perfect interval and an augmented interval or a diminished interval occurs. However, in the prior art chord automatic performance device, as the interval relationship is always determined by the type of the chords it is impossible to discriminate the major interval from the minor interval or to descriminate the perfect interval from the augmented or diminished interval meaning that it is impossible to play correct ensemble performance.

SUMMARY OF THE INVENTION

Accordingly it is an object of this invention to provide a novel electronic musical instrument capable of automatically performing ensemble performances.

Briefly stated this object can be accomplished by automatically selecting one or a plurality of tones having predetermined key numbers with respect to a tone produced by depressed key on a keyboard, and producing the selected tone or tones concurrently with the tone of the depressed key.

According to this invention there is provided an electronic musical instrument of the class comprising a keyboard, and means for generating musical tone signal generating means which generates a tone signal corresponding to a depressed key on the keyboard, characterized by further comprising tonality designating means for designating a tonality of a music to be performed, ensemble data forming means for forming ensemble note pitch data according to a designated tonality and a depressed key information and ensemble musical tone signal generating means for generating a musical tone signal according to said ensemble note pitch data.

More particularly according to a preferred embodiment of this invention, there are provided tonality designating means for generating an information representing a performance tonality, ensemble tone data forming means which forms tone pitch data of a tone (termed ensemble tone) to be automatically produced for providing an ensemble performance effect according to a tone designated by the tonality designating means and a depressed key tone, and a musical tone generating means for producing the musical tone signal of the ensemble according to the tone pitch data. The ensemble tone data forming means comprises a memory device previously written with ensemble tone forming data and a predetermined ensemble tone forming data is read out from the memory device in accordance with a designated tonality and the depressed key tone. The ensemble tone forming data to be stored in the memory device may be data representing th interval between the depressed key tone and the ensemble tone or may be data directly representing the tone pitch or note name of the ensemble tone. Where the ensemble forming data is a data representing the interval, a tone pitch data of a desired ensemble tone can be obtained by adding the interval data (in the following embodiment it is explained as an ensemble tone difference data $\Delta$ KC) to or subtracting from the tone pitch data.

Whether the interval data is to be added or subtracted is determined by making the ensemble tone to be higher or lower than the tone pitch of the depressed key tone. In the following embodiment, key codes are used as the tone pitch data.

The interval between a depressed key tone and an ensemble tone can be made to be selectable. To this end a plurality of memory devices for storing the ensemble tone forming data according to different interval degree numbers so as to make the performer to enable to select a memory device corresponding to a designated degree number by using degree number designating means.

Generally speaking an ensemble performance is added to a melody so that an ensemble tone is added to the tone of a depressed key in a keyboard (for example, an upper keyboard) utilized for the melody performance. Accordingly, as a principle, the ensemble tone may be determined in relation to the state of key depression in one keyboard for melody performance and to the designated tonality, but it will be more musically favorable where the ensemble tone is determined also in relation to the key depression state in another keyboard performed at the same time. More particularly, tones performed at the same time have important musical relation (for example, a melody and a chord) even when they are produced on different keyboards so that the ensemble tone is not always determined solely by the depressed key tone, that is a melody tone of one keyboard, but determination of an exceptional ensemble tone by taking into consideration the key depressed state of another keyboard is important to produce a highly musical ensemble tone performance.

Thus, according to this invention, the pitch data of an ensemble tone is formed in relation to the key depressed state of not only the upper keyboard (for performing a melody) but also of the other keyboard. Especially, selection of an ensemble tone also in relation to an accompaniment chord is important for performing theoretical ensemble tone. For this reason there is provided a chord detection circuit which detects an accompaniment chord from the depressed key state of an accompaniment keyboard, i.e., the lower keyboard for forming the tone pitch data of the ensemble tone together with a designated tonality, a melody tone and an accompaniment tone. As will be described in detail with reference to the following embodiments, the circuit is constructed such that an exception ensemble tone would be formed according to the relationship between the accompaniment tone and the melody tone and between the accompaniment tone and a tonality. In addition to a memory device for prestoring an ensemble tone forming data of a predetermined degree number, there is provided means for forming an exceptional ensemble tone which would be used according to the judgment whether a basic ensemble data or an exceptional ensemble data is to be formed depending upon the relation among the melody tone, the designated tonality and the accompaniment chord. To form an exceptional ensemble tone, an ensemble tone according to Kadenz theory is selected from accompaniment constituting tones or by judging the termination of a music from the motion of the accompaniment chord. The detail thereof are termed as improvements (1) through (9) in the following embodiments. By considering the accompaniment chords formation of ensemble tones matching the modulation of tonality, a passing note or chromatic scale.

BRIEF DESCRIPTION OF THE DRAWINGS

In the accompanying drawings:

FIG. 2*a*–2*c* are scores showing one example of the automatic ensemble tone performance of the embodiment shown in FIG. 1 in which FIG. 2*a* shows melody performance tones, FIG. 2*b* shows autmatically generated ensemble tones and FIG. 2*c* shows melody tones together with ensemble tones;

FIG. 16*a* and 16*b* show examples of the construction of the memory table #1 of the data memory device shown in FIG. 15;

DESCRIPTION OF THE PREFERRED EMBODIMENTS

Figure 1:
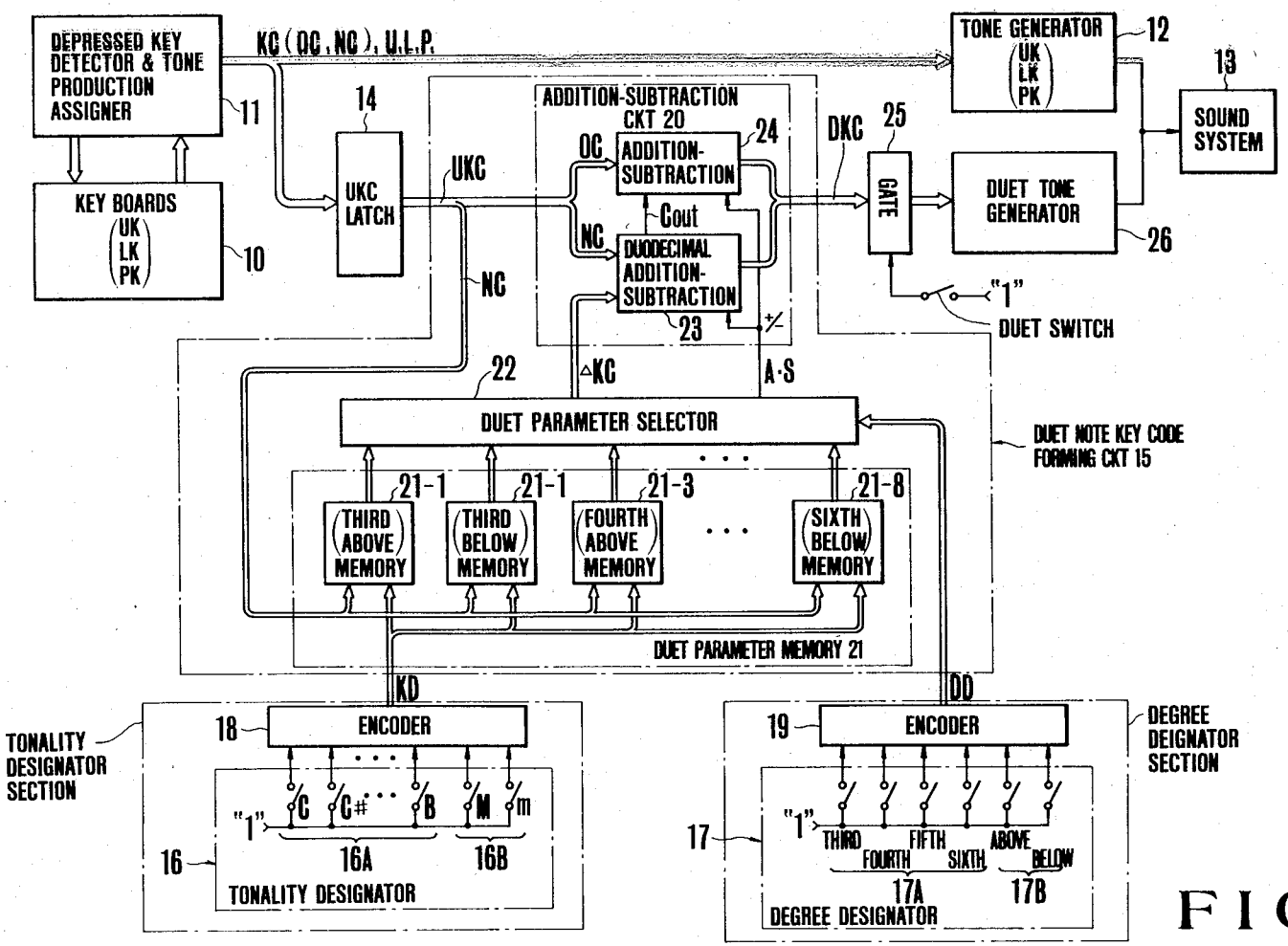
FIG. 1 is a block diagram showing one embodiment of this invention.
Figures 2A, 2B, 2C:
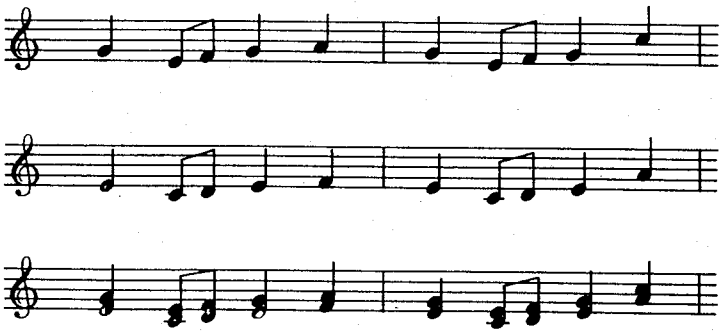

A keyboard unit 10 shown in FIG. 1 is provided with an upper keyboard UK, a lower keyboard LK and a pedal keyboard PK. During normal melody performance the upper keyboard UK is used, while for an accompaniment (chord) performance the lower keyboard LK is used. A depressed key detection and tone generation assignment circuit 11 operates to detect depressed and released keys on the keyboard unit 10 and to assigned the detected key to one of a plurality of tone production channels thereby producing a key code KC specifying the depressed key in accordance with the assignment. A musical tone generator 12 is provided to produce a musical tone signal of the depressed key assigned to a given tone production channel after imparting to the musical tone signal a tone color corresponding to a keyboard to which the depressed key belongs. The musical tone signal thus generated is produced as a musical tone via a sound system 13. More particularly, in the musical tone generator 12 tones of the depressed keys on respective keyboards of the keyboard unit 10 are produced with tone colors corresponding to respective keyboards. For this reason, the circuit 11 and the musical tone generator 12 may comprise any depressed key detection system, assigning system and musical tone signal generating system. The depressed key detection and tone generation assignment circuit 11 may contain an auto-bass/chord performance circuit or it may be constructed such that it produces repective key codes KC of automatically generated code constituting tones as those belonging to the lower keyboard.

In order to distinguish the keyboards to which to key codes KC assigned to respective tone production channels belong, the circuit 11 may be constructed to produce the key codes together with codes representing the keyboards, or to previously make the tone production channels to correspond to respective keyboards so that a depressed key of given keyboard would be assigned to a tone production channel corresponding to the given keyboard. The key code KC outputted from the circuit 11 may be produced for each channel on the time division basis or not. In the following description, it is assumed that the key code is produced on the time division basis.

Each key code KC comprises a note code NC representing the note of the depressed key and an octave code OC representing the octave of the depressed key. One example of the octave codes OC is shown in Table I while one example of the note codes is shown in Table II

TABLE I

| Octave | range | Binary Representation MSB | | LSB | Duodecimal Representation | reference characters |
|---|---|---|---|---|---|---|
| first Octave | C2–B2 | 0 | 0 | 1 | 1 | OC1 |
| Second Octave | C3–B3 | 0 | 1 | 0 | 2 | OC2 |
| Third Octave | C4–B4 | 0 | 1 | 1 | 3 | OC3 |
| Fourth Octave | C5–B5 | 1 | 0 | 0 | 4 | OC4 |
| Fifth Octave | C6–B6 | 1 | 0 | 1 | 5 | OC5 |
| Sixth Octave | C7 | 1 | 1 | 0 | 6 | OC6 |

TABLE II

| Note | Binary Representation MSB | | | LSB | Duodecimal Representation | Reference Characters |
|---|---|---|---|---|---|---|
| C | 0 | 0 | 0 | 0 | 0 | NC.C |
| C# | 0 | 0 | 0 | 1 | 1 | NC.C# |

TABLE II-continued

| Note | Binary Representation MSB | | | LSB | Duodecimal Representation | Reference Characters |
|---|---|---|---|---|---|---|
| D | 0 | 0 | 1 | 0 | 2 | NC.D |
| D# | 0 | 0 | 1 | 1 | 3 | NC.D# |
| E | 0 | 1 | 0 | 0 | 4 | NC.E |
| F | 0 | 1 | 0 | 1 | 5 | NC.F |
| F# | 0 | 1 | 1 | 0 | 6 | NC.F# |
| G | 0 | 1 | 1 | 1 | 7 | NC.G |
| G# | 1 | 0 | 0 | 0 | 8 | NC.G# |
| A | 1 | 0 | 0 | 1 | 9 | NC.A |
| A# | 1 | 0 | 1 | 0 | Y (= 10) | NC.A# |
| B | 1 | 0 | 1 | 1 | Z (= 11) | NC.B |

As shown in Tables I and II, octave codes OC each comprising three bit binary data and note codes NC each comprising 4 bit binary data are represented by duodecimal digits of one order of magnitude and that the weight of the least significant bit LSB of the note codes NC corresponds to a semi-tone. It is now assumed that the octave codes OC an upper order digits over the note codes NC. Then the lowest tone C2 through the highest tone C7 (see Table I) can be represented by continuous duodecimal numbers "10" (binary "0010000") through "60" (binary "1100000"). The reason that the key code KC of the keys (C2 to C7) are represented by duodecimal numbers lies in the easy understanding of the addition and subtraction operations necessary to determine the key codes of ensemble tones as will be described hereinafter. According to this invention, however, the key code KC of each key is not required to be always duodecimal so long as it is related to a tone pitch (or interval) according to a predetermined rule.

The reference characters shown in the rightmost columns of Tables I and II are used in the following description instead of the binary or duodecimal representations shown in the lefthand columns for specifying the contents (octaves) of the octave codes OC and the contents (notes) of the note codes NC.

An upper keyboard key code latch circuit 14 is used to latch only one key code when it is supplied with a key code representing the upper keyboard among key codes KC supplied from the depressed key detection and tone generation assignment circuit 11 and the depressed keyboard designation codes U, L and P. Where a melody is performed on the upper keyboard, usually only one key is depressed at a time. However, where two or more keys on the upper keyboard are simultaneously depressed the latch circuit 14 latches a key code KC of the highest note (or lowest note). Where the circuit 11 produces the key code KC on the time division basis, the latch circuit 14 also functions to convert a single depressed key code of the upper keyboard into a continuous signal.

Of course, when the depressed key on the upper keyboard is changed, the key code KC latched by the latch circuit 14, also changes.

The key code UKC of the depressed key on the upper keyboard latched by the latch circuit 14 is supplied to an ensemble note code forming circuit 15 which is also supplied with a key (tonality) designation signal KD from a tonality designator 16 and a degree designation signal DD from a degree designator 17. The tonality designator 16 designates the tonality of a musical piece to be performed and comprises 12 switches 16A for designating the root note (C–B) of the tonality and two switches 16B for designating major M or minor m of the tonality. The performer selectively operates the switches 16A and 16B for designating a desired tonality. The outputs of the switches 16A and 16B are applied to an encoder 18 which produces a key designation signal KD representing the designated tonality. One example of encoding the tonality designation signal KD is shown in the following Table III.

TABLE III

| Tonality | | Code (KD) | | | | Duodecimal Representation |
|---|---|---|---|---|---|---|
| C Major | (A Minor) | 0 | 0 | 0 | 0 | 0 |
| C# Major | (A# Minor) | 0 | 0 | 0 | 1 | 1 |
| D Major | (B Minor) | 0 | 0 | 1 | 0 | 2 |
| D# Major | (C Minor) | 0 | 0 | 1 | 1 | 3 |
| E Major | (C# Minor) | 0 | 1 | 0 | 0 | 4 |
| F Major | (D Minor) | 0 | 1 | 0 | 1 | 5 |
| F# Major | (D# Minor) | 0 | 1 | 1 | 0 | 6 |
| G Major | (E Minor) | 0 | 1 | 1 | 1 | 7 |
| G# Major | (F Minor) | 1 | 0 | 0 | 0 | 8 |
| A Major | (F# Minor) | 1 | 0 | 0 | 1 | 9 |
| A# Major | (G Minor) | 1 | 0 | 1 | 0 | Y |
| B Major | (G# Minor) | 1 | 0 | 1 | 1 | Z |

The number of the designatable keys are 12 for the major keys and 12 for the minor keys, that is a total of 24, but as shown in the lefthand column of Table III, with regard to the major keys and the minor keys (natural minor scale), the major tones spaced by 3 semi-tones have common scale tones so that their codes may be the same (for example of C major tonality and of A minor tonality). As a consequence, 12 codes are assigned as shown in Table III for the tonality designation signal KD.

The degree designator 17 selects and designates the interval of the ensemble note for a melody tone corresponding to a depressed key on the upper keyboard. In this example, by combining a degree selection switch 17A which selects either one of 3, 4, 5 and 6 degrees with an above/below selection switch 17B which selects an ensemble note (above ensemble note) on the higher tone side of the melody tone of the depressed key on the upper keyboard and an ensemble note (below ensemble note) on the lower tone side, it is possible to select either one of eight degrees of third above, third below, fourth above, fourth below, fifth above, fifth below, sixth above, and sixth below. The outputs of the degrees electron switch 17A and the above/below selection switch 17B are applied to an encoder 19 to produce a degree designation signal DD corresponding to either one of aforementioned 8 interval degrees.

The duet note code forming circuit 15 forms an ensemble note key code DKC based on the code UKC of a depressed key on the upper keyboard, a key designation signal KD, and a degree designation signal DD. Theoretically, the ensemble or duet note, key code DKC is formed as a tone with an interval spaced from the depressed key code UKC by the number of degrees designated by the degree designation signal DD, but depending upon a key designated by the tonality designation signal KD and the note of the depressed key code UKC it is judged whether the interval, is a major interval, or a minor interval, or a perfect interval, or an augmented interval or a diminished interval. The note name of the ensemble note key code DKC is determined in accordance with the judgment.

The key code UKC of the depressed key on the upper keyboard supplied to the ensemble note key code forming circuit 15 from the upper key code latch circuit 14 is applied to an addition/subtraction circuit 20 and only a portion of the key code regarding the note code KC is applied to a duet or ensemble parameter memory device 21 which has been storing the data representing the notes of the duet tones corresponding to 12 notes (C–B) in accordance with 24 types of keys designatable by the key designator 16 and 8 types of degrees designatable by the degree designator 17. More particularly, the memory device 21 has 8 memory elements 21-1 to 21-8 corresponding to 8 types of the degrees (third above to sixth below), respective memory elements 21-1 to 21-8 storing difference data for forming duet notes corresponding to given degrees in accordance with the 12 notes (C–B) and 24 types of the keys. Respective memory elements 21-1 to 21-8 are addressed by the note code NC of the key code UKC of the depressed key and the tonality designation signal KD. The difference data read out from the memory elements 21-1 through 21-8 are applied to a duet parameter selector 22. The selector 22 selects duet forming difference data (duet note difference data) read out from only one memory element (one of 21-1 through 21-8) corresponding to the degree designated by the degree designation signal DD, and supplies a selected data Δ KC to the addition/subtraction circuit 20. Further, the selector 22 supplies an addition/subtraction control signal A·S to the addition/subtraction circuit 20 depending upon whether the degree designation signal DD is designating an above duet note (third above to sixth above) or a below duet note (third below to sixth below). In the case of the above duet tone the addition/subtraction signal A·S is made to be "0" to set the addition/subtraction circuit 20 to an addition mode, whereas in the case of the below duet note, the signal A·S is made to be "1" to set a subtraction mode.

As an example of the duet parameter memory device 21 a portion of the memory construction of the memory element 21-1 for the third above is shown in the following Table IV. By a suitable combination of 12 addresses designated by the tonality designation signal KD with 12 addresses (12 notes of C–B) designated by the tonality designation signal KD, the memory element 21-1 is provided with 144 addresses each prestoring a predetermined duet tone difference data.

TABLE IV

| KD | NC | C | C# | D | D# | E | F | F# | G | G# | A | A# | B |
|---|---|---|---|---|---|---|---|---|---|---|---|---|---|
| Major | (Minor) | 4 | | 3 | | 3 | 4 | | 4 | | 3 | | 3 |
| C | (A) | | | | | | | | | | | | |
| C# | (A#) | 3 | 4 | | 3 | | 3 | 4 | | 4 | | 3 | |
| D | (B) | | 3 | 4 | | 3 | | 3 | 4 | | 4 | | 3 |
| D# | (C) | 3 | | 3 | 4 | | 3 | | 3 | 4 | | 4 | |
| E | (C#) | | 3 | | 3 | 4 | | 3 | | 3 | 4 | | 4 |
| F | (D) | 4 | | 3 | | 3 | 4 | | 3 | | 3 | 4 | |
| . | . | . | . | . | . | . | . | . | . | . | . | . | |
| . | . | . | . | . | . | . | . | . | . | . | . | . | |
| . | . | . | . | . | . | . | . | . | . | . | . | . | |
| . | . | . | . | . | . | . | . | . | . | . | . | . | |
| B | (G#) | | 3 | | 3 | 4 | | 4 | | 3 | | 3 | 4 |

A duet tone difference data stored in an address at a cross-point between a note address designated by the note code NC of a depressed key on the upper keyboard and a key address designated by a tonality designation signal KD is read out from the memory element 21-1. The value of this duet note difference data represents the number of the semi-tones contained in the interval between the melody note and the duet note. By taking the C major key as an example, let us explain the value of this duet note difference data. Thus, the diatonic scale notes of the C major key are C, D, E, F, G, A and B among which the scale notes respectively being 3 degrees (third interval) above are E, F, G, A, B, C and D and their interval kinds are major, minor, minor, major, major, minor and minor thirds respectively. Since the major 3rd degree interval is 4 semi-tones and the minor 3rd degree interval is 3 semi-tones, the duet note difference data of 3 degrees above to be stored corresponding to the respective diatonic scale tones of the C major tonality are 4, 3, 3, 4, 4, 3, 3 respectively as shown in Table III. In the same manner, other memory elements 21-2 through 21-8 respectively store values corresponding to the number of semi-tones contained in respective intervals. Thus, the duet note difference data corresponding to the perfect 4th interval is 5, that corresponding to the augmented 4th interval is 6, that corresponding to the perfect 5th interval is 7, that corresponding to the diminished 5th interval is 6, that corresponding to the minor 6th interval is 8 and that corresponding to the major 6th interval is 9.

The addition/subtraction circuit 20 is a duodecimal addition/subtraction circuit utilizing the addition/subtraction circuit 24 as a higher order digit circuit and the addition/subtraction circuit 23 as a lower order digit circuit. The higher order circuit 24 is inputted with an octave code OC of the key code UKC of a depressed key on the upper keyboard, whereas the lower order circuit 23 is inputted with the duet interval data Δ KC given by the selector 22 and the note code NC of the key code UKC. A carry signal Cout from the lower order addition/subtraction circuit 23 is applied to the higher order addition/subtraction circuit 24. Both addition/subtraction circuits 23 and 24 are brought to an addition mode or a subtraction mode by the addition/-subtraction control signal A·S. Since the addition/subtraction circuit 23 is of the duodecimal type when the result of addition or subtraction operation of the note code NC and the duet interval data Δ KC becomes greater than 12 (at the time of addition) or less than 0 (at the time of subtraction) the carry signal Cout is produced (at the time of addition, to carry up while at the time of subtraction, to carry down). The addition/subtraction circuit 24 adds or subtracts the octave code OC and the carry signal Cout to vary the octave code one octave above or below. The results of operations of the addition/subtraction circuits 23 and 24 are outputted as the note code (NC) and the octave code (OC) of the key code DKC of a duet note.

One example of calculation where the octave is varied will be described hereunder. When a key B3 on the upper keyboard UK is depressed, the content of the key code UKC produced by the latch circuit 14 is such that the octave code OC is "010" and the note code NC is "1011" (see Tables I and II). Assume now that the performance key at this time is the C major tonality and that above 3rd interval is designated for the duet note interval, a duet note difference data of a value 3 would be read out from the memory element 21-1 (see Table IV) in response to a note code NC·B, and the read out data is selected by the selector 22 to be supplied to the addition/subtraction circuit 23 as a data Δ KC. Since the state is the above 3rd interval the addition/subtraction circuits 23 and 24 are in the addition mode so that the addition/subtraction circuit 23 execute a duodecimal addition operation as shown in the following to obtain a sum output "0010" as well as a carry signal Cout.

```
                  1011          (decimal 11)
              +  |0011          (decimal 3)
(carry up)        1 - 0011
```

The addition/subtraction circuit 24 adds the octave code "010" of the key code UKC to the carry signal to produce an octave code "011" one octave above. As a conseqence, the octave code OC of the duet note key code DKC becomes "011", whereas the note code NC becomes "0010", thus producing the key code of the D4 note (see Tables I and II) which is a scale note of 3rd above the depressed key B3 on the upper keyboard.

Suppose now that a key C4 is depressed at a C major tonality key and that the third below of the duet note interval is designated. Then the octave code OC of C4 is "011" and the note code NC is "0000". Since the interval of the lower 3 degrees of the note C at the C major tonality key is a minor interval, a value 3 (binary "0011") would be read out as the duet interval Δ KC. Accordingly the following duodecimal subtraction is executed in the addition/subtraction circuit 23 to produce an output "1001" and a carry signal Cout.

```
0000    carry down ->    1100    (decimal 12)
- |0011                 - |0011
                          1001
```

On the other hand, the addition/subtraction circuit 24 subtracts the carry signal Cout from the octave code "011" to produce an octave code "010" one octave lower. Hence the octave code of the key code DKC of the duet note becomes "010", while the note code becomes "1001" thus producing the key code of A3 note (see Tables I and II). This A3 note is a scale note of 3 degrees below the note of the depressed key C4 on the upper keyboard.

The key code DKC of the duet note is applied to a duet note tone generator 26 via a gate circuit 25 which is enabled when a duet switch 27 is closed. Where the performer wishes to obtain a duet tone performance effect, he sets desired designations with the tonality designator 16 and the degree designator 17 and then closes the selection switch 27. Until the selection switch 27 is closed, the duet note key code DKC is blocked by the gate circuit 25 so that it is impossible to obtain the desired duet note performance effect. The selection switch 27 may be constructed as a knee lever switch or a foot switch. This makes easy to designate the commencement or termination of the duet performance with a desired phrase at any intermediate point of the keyboard performance.

The duet tone generator 26 produces a musical tone signal having a tone pitch corresponding to the duet note key code DKC supplied through the gate circuit 25, and applies the musical tone signal to the sound system 13. Since the processing executed by the latch circuit 14, duet note key code forming circuit 15 and the duet tone generator 26 is executed in an actual time in response to a key depression on the upper keyboard, the musical tone signal of the upper keyboard depressed key given by the tone generator 12 and the duet tone signal given by the duet tone generator 26 are simultaneously converted into musical tones through the sound system 13 thereby providing a duet performance effect.

It is advantageous to cause the musical tone signal generated by the duet tone generator 26 to have the same tone color as that generated by the tone generater 12 by changing the tone color by interlocking the tone color selection for the upper keyboard. Then, an orthodox duet performance effect can be obtained. However, the tone color of the musical tone signal generated by the duet tone generator 26 may be different from the tone color of the upper keyboard in which case more efficient duet performance can be obtained (i.e., an effect specific to an electronic musical instrument that can not be realized with a single natural musical instrument).

For the sake of reference, one example of the performance of a duet performance provided by the electronic musical instrument embodying the invention is shown in FIGS. *2a* to *2c*. FIG. *2a* shows one example of a music of the C major totality manually performed with the keyboard unit 10, the tone of this music being produced by the musical tone signal generator 12. Where the interval of the duet is selected to be third below, a duet tone would be automatically produced from the duet tone generator 26 as shown in FIG. *2b* to correspond to the keyboard performance shown in FIG. *2a*. Accordingly, the tone produced by the sound system 13 would have a duet performance effect as shown in FIG. *2c*.

Where a plurality of systems each including a duet note key code forming circuit 15 as shown in FIG. 1 and a duet note generator 26 are provided and where the intervals of the musical tones generated by respective systems are made different, it is possible to produce a plurality of duet tones at the same time. Although in the embodiment shown in FIG. 1, 8 types of degrees from 3rd above to 3rd below are selectable, it should be noted that the invention is not limited to this specific embodiment. For example, the number of degrees of the duet tones may be fixed, that is not selectable, in which case the degree designator 17 can be omitted. Furthermore, although in the duet note key code forming circuit 15 shown in FIG. 1, the tone interval data are stored in the memory unit 21 for obtaining the key code DKC of the duet note by adding or subtracting the interval data to or from the key code of a depressed key, it is also possible to contruct the entire duet note key code forming circuit 15 with a read only memory device (ROM) so as to read out a predetermined duet note key code DKC by using three address signals consisting of the upper keyboard key code UKC, the key designation signal KD and the degree designation signal DD.

Figure 3:
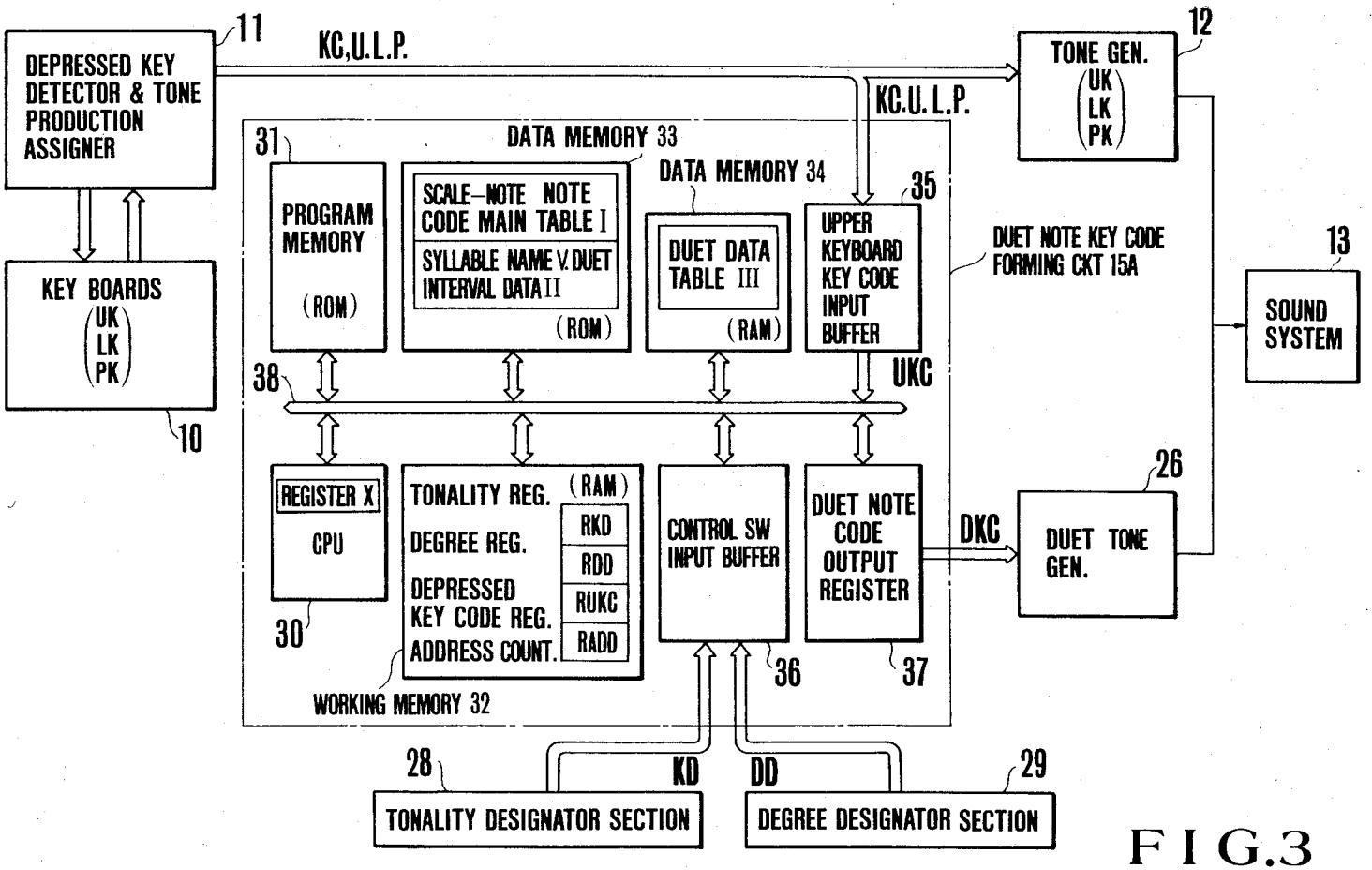
FIG. 3 is a block diagram showing a modified embodiment of this invention in which the ensemble tone key code forming circuit shown in FIG. 1 is constituted by a microcomputer.

FIG. 3 shows another embodiment of this invention in which a duet note key code forming circuit 15A is constituted by a microcomputer. The depressed key detector and tone production assigner 11, the tone generator 12 for generating the musical tone signal regarding a depressed key, the duet tone generator 26 which generates the musical tone signal of a duet note in accordance with a duet note key code DKC and the sound system 13 are identical to those shown in FIG. 1. In this modified embodiment, for the purpose of identifying a keyboard to which the depressed key code KC belongs, a keyboard identifying code U.L.P. is produced by the circuit 11 concurrently with the key code KC. A tonality designator section 28 is constituted by the tonality designator 16 and the encoder 18 shown in FIG. 1 and operates to produce a tonality designation signal KD. A degree designator section 29 is constituted by the degree designator 17 and the encoder 19 shown in FIG. 1 and operates to generates a degree designation signal DD.

The duet note key code forming circuit 15A constituted by a microcomputer comprises a central processing unit (CPU) 30, a program memory device 31 prestoring a processing program for forming the duet note key code KC, a working memory device 32 comprising a random access memory device (RAM), a data memory device 33 comprising a read only memory device (ROM) prestoring data necessary to form the duet note key code DKC, a data memory device 34 comprising a RAM storing data necessary to form the duet note key code DKC, an upper keyboard key code input buffer 35, a control switch input buffer 36, and a duet note key code output register 37, and the data of respective circuit elements are transmitted and received through a bus line 38.

The upper keyboard input buffer 35 operates in the same manner as the upper keyboard key code latch circuit 14 and operates to take in the upper keyboard key code UKC when the depressed key code KC supplied from the depressed key detection and tone generation assignment circuit 11 is judged to be a key code belonging to the upper keyboard by the keyboard identifying code U.L.P. The control switch input buffer 36 takes in the tonality designation signal KD and the degree designation signal DD supplied from the tonality designator section 28 and the degree designator section 29. The duet note key code output register 37 stores the duet note key code DKC obtained as a result of an arithmetic operation of the key code UKC, and signals KD and DD and outputs stored duet note key code DKC to the duet tone generator 26.

The working memory device 32 functions as a register that temporarily stores the data formed during the arithmetic operation processing. Principal registers are a tonality register RKD, a degree register RDD, a depressed key code register RUKC, and an address counter RADD. The tonality register RKD stores the tonality designation signal KD received by the control switch input buffer 36, while the degree register RDD stores the degree designation signal received by the input buffer 36. The depressed key code register RUKC stores the key code UKC received by the upper keyboard key code input buffer 35, while the address counter RADD designates the addresses of the data memory devices 33 and 34 (see Tables I, II and III to be described hereunder).

There are two types of memory Tables prestored in the data memory device 33 constituted by a ROM. One of the Tables is a scale-note code main Table I (hereinafter merely termed a memory table I) and the other is a syllable name v. duet interval data Table II (hereinafter merely termed a memory table II) for discrete scales. Memory Table I stores the note codes NC C–NC B of the seven scale notes C, D, E, F, G, A and B of the C major tonality in their addresses 0–6 as shown in the following Table. The addresses 0–6 respectively corresponding to the syllable names do, re, mi, fa, so, la and si.

TABLE V

| (Syllable Name) | Address | Note Code NC | Duodecimal Representation |
|---|---|---|---|
| (do) | 0 | NC.C | 0 |
| (re) | 1 | NC.D | 2 |
| (mi) | 2 | NC.E | 4 |
| (fa) | 3 | NC.F | 5 |
| (so) | 4 | NC.G | 7 |

TABLE V-continued

| (Syllable Name) Address | | Note Code NC | Duodecimal Representation |
|---|---|---|---|
| (la) | 5 | NC.A | 9 |
| (si) | 6 | NC.B | Z |

The relation between the reference characters NC·C through NC B of the note code and the binary represen-tions or the note is shown in Table II described above. As will be described later, the fundamental note codes corresponding to respective scales stored in the memory table I are used to determine the note codes of the notes corresponding to respective syllable names of the keys designated by the tonality designation signals KD.

As shown in Table VI, the memory table II stores the difference data representing the interval of the duet note in accordance with respective syllable names. So long as the syllable names are the same, the major/minor kind of the intervals are common irrespective of the tonality name so that the difference data stored in the memory table II can be used in common for all tonalities. The syllable names correspond to addresses 0–6 as above described. The memory table II comprises subtables II-1 and II-2 corresponding to respective degrees and designatably by the degree designation signals DD. For simplifying the description, in Table VI, the values regarding the duet note intervals of 3 degrees below (subtable II-1) and those regarding the duet note intervals of 5 degrees below (subtable II-2) are shown.

TABLE VI

| (Syllable Names) Address | | II-1 (3 Degrees Below) | II-2 (5 Degrees Below) |
|---|---|---|---|
| (do) | 0 | −3 | −7 |
| (re) | 1 | −3 | −7 |
| (mi) | 2 | −4 | −7 |
| (fa) | 3 | −3 | −6 |
| (so) | 4 | −3 | −7 |
| (la) | 5 | −4 | −7 |
| (si) | 6 | −4 | −7 |

A value "−3" of the duet note difference data shown in subtable II-1 of Table VI corresponds to a minor third interval, whereas a value "−4" to a major third interval. A value "−7" in the subtable II-2 corresponds to a perfect 5th interval while a value "−6" to a diminished 5th interval. The minus sign means that the key code DKC of the duet note can be obtained by subtracting a predetermined duet note data from a depressed key code UKC because the duet note has a lower tone pitch than that of a depressed key (melody tone).

In scale notes, the intervals between the syllable name representations si and do, and between mi and fa is of a semi-tone interval. The syllable name representations 3 degrees lower than respective syllable name representations do, re, mi, fa, so, la, and si are respectively la, si, do, re, mi, fa and so and thus the semi-tone intervals between si and do and between mi and fa are included in third intervals between do and la, between re and si, between fa and re and between so and mi. Accordingly, as shown in the memory table II-1 in Table VI, the 3rd intervals below the syllable name do, re, fa and so are minor intervals, and the difference data are "−3". The other intervals are major intervals having a value of "−4". The 5th interval below the syllable names do, re, mi, fa, so, la and si are fa, so, la, si, do, re and mi. Among the fifth intervals are included a case including one set of semi-tone intervals of si and do or mi and fa (i.e., do and fa, re and so, mi and la, so and do, la and re, si and mi) and a case including two sets of semi-tone intervals (i.e., fa and si). A perfect 5th interval contains one semi-tone interval and 3 whole-tone intervals which can be expressed as 7 semi-tones in terms of the number of semi-tone intervals. A diminished 5th interval contains two semi-tone intervals and 2 whole-tone intervals which can be expressed as 6 semi-tone tones in terms of the number of the semi-tone intervals. Consequently, as shown in the memory table II-2 of Table VI, the duet note difference data of 5 degrees below respective syllable names do, re, mi, so, la and si are "−7", while that 5 degrees below the scale representation fa is "6".

The data memory device 34 constituted by a RAM includes a tonality dependent duet data memory table III and the addresses 0–6 of this memory table correspond to the syllable names do through si. As shown in the following Table VII, the memory Table III has two memory positions corresponding to respective addresses 0–6, one memory position being written with note codes representing the scale notes (notes corresponding to respective scale representations) of the designated key, and the other being written with duet interval data corresponding to designated degrees in accordance with respective syllable names. Table VII is not with data.

TABLE VII

| address Syllable Names | 0 do | 1 re | 2 mi | 3 fa | 4 so | 5 la | 6 si |
|---|---|---|---|---|---|---|---|
| scale note codes of designated tonality | | | | | | | |
| duet tone difference data | | | | | | | |

Figure 4:
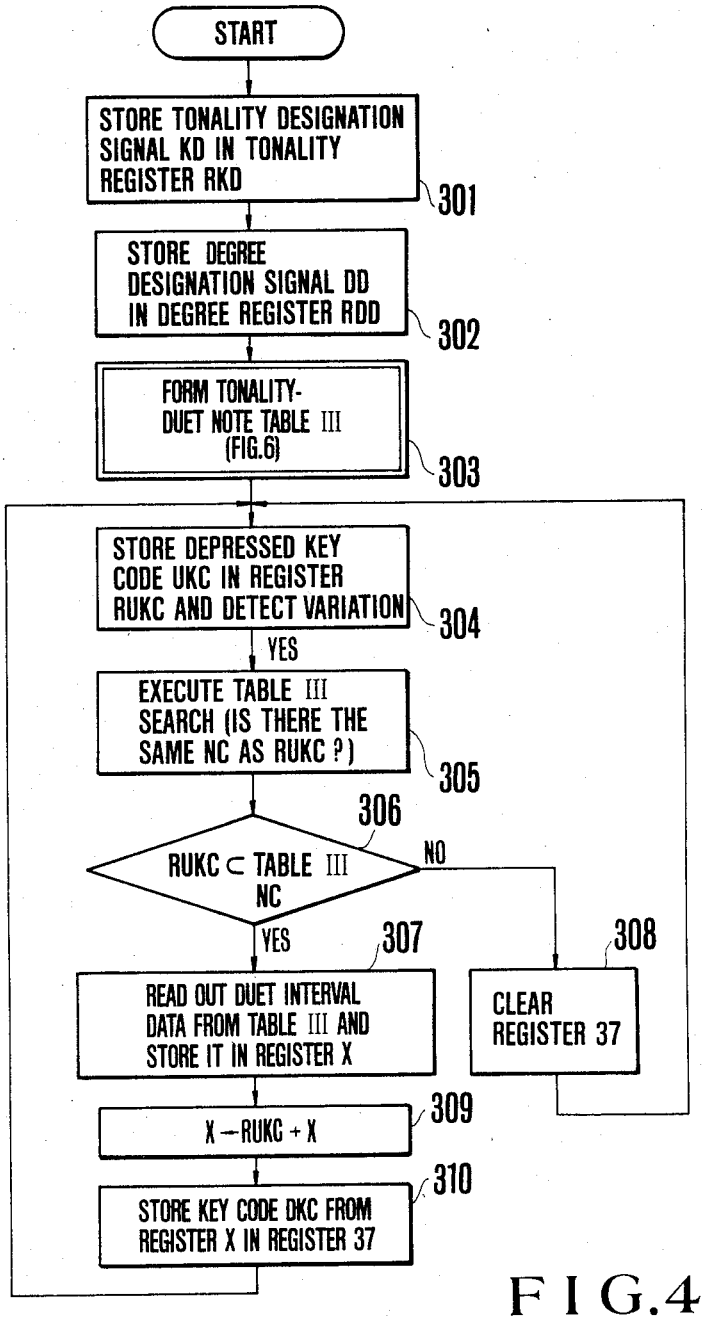
FIG. 4 is a flow chart showing the processing program of the ensemble tone key code forming circuit shown in FIG. 3.
Figure 5:
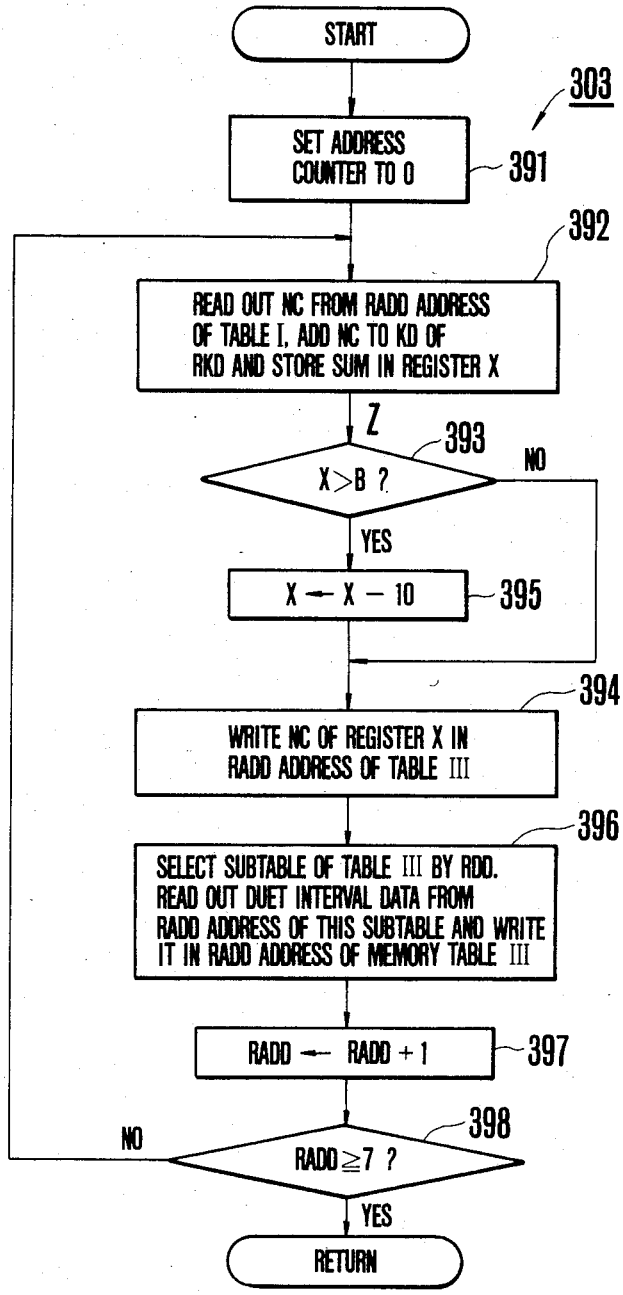
FIG. 5 is a flow chart showing the detail of the tonality v. ensemble tone table III forming the processing shown in FIG. 5.

The flow charts shown in FIGS. 4 and 5 show the outline of the duet tone key code forming processing executed by the CPU 30 according to the control program stored in the program memory device 31.

As shown in FIG. 4, at first step 301, the tonality designation signal KD is stored in the tonality register RKD in the working memory device 32 and at the next step 302, the degree designation signal DD is stored in the degree register RDD. Then, at a step 303, a duet data memory table III preparing processing is executed, the detail of this step 303 being shown in FIG. 5.

Referring now to FIG. 5, at first step 391, the count of the address counter RADD in the working memory device 32 is set to zero. At the next step 392, the memory table I (Table V) is addressed by the address counter RADD to read out the note code NC which is added to the tonality designation signal KD of the tonality register RKD and the sum is stored in a register X, not shown, in the CPU 30. At step 392, a signal representing the performance key is added to the fundamental note codes corresponding to respective scale representations (do through si), which are prestored in the memory table I, that is the note codes NC·C through NC·B of the scale notes of the C major tonality so as to determine the scale-note note codes NC of respective scale representations (do through si) at this performance tonality. As shown in Table III the tonality designation signal KD has the same value as a note code NC representing the note of the syllable name do of respective keys. More particularly, for the C major tonality through the B major tonality since the major notes C–B are do, the contents of their codes KD are the same as those of the note codes NC of the major notes C–B, and for the A minor tonality through the E minor tonality since the scale representations of the major notes A–E are la, the notes of the scale representation do are notes C–B 3 degrees spaced from the major notes A–E and the contents of the codes KD are the same as those of the note codes NC of the major notes C–B. For this reason, it is possible to determine the note codes NC at respective scale representations at a designated tonality (performance tonality) by adding the note code NC for that performance tonality to the fundamental note codes NC for respective syllable names.

Then at the next step 393 a judgment is made as to whether the count of the register X of the CPU is larger than Z (decimal 11) of duodecimal value. When the result of this judgment is NO, the program is advanced to step 394, whereas when the result is YES, a processing of "X←X−10" is executed at step 395 and then the program is advanced to step 394. As shown in Table II, since the maximum value of the note code NC is Z (decimal 11) of the duodecimal representation, in the judgment of X>Z it is judged that whether the data stored in the register X is larger than the maximum value Z of the note code NC or not. When the result is YES a processing "X←X−10" is executed which means that 10 (decimal 12) of the duodecimal digits is subtracted from the count of the register X and that the difference is stored in the register X. In other words subtraction of 12 converts the content of the register X to a duodecimal representation (i.e., a correct note code). This is necessary because the addition operation at step 392 executed by the CPU 30 is not the duodecimal addition.

At step 394, an address of the memory table III is designated by the address counter RADD to write a note code storing position (see Table VII) of the memory table III the data in the register X as the note code NC.

Then at step 396 one of the subtables (II-1 or II-2) of the memory table II is selected by the degree designation signal DD stored in the degree register RDD and then a duet interval data (Table VI) is read out from an address designated by the address counter of the subtable thus selected. The duet interval data thus read out from the subtable is written in a duet note difference data storing position (see Table VII) at an address of the memory table III designated by the address counter RADD.

As above described, the note code NC and the duet tone difference data are written respectively in two memory position at addresses of the memory table III designated by the address counter RADD. At the next step 397 for "RADD←RADD+1" processing the count of the address counter RADD is increased by one. In the next step 398 a judgment is made whether the count of the address counter RADD is equal to or larger than 7 or not. When the result of judgment is NO, the program is returned to step 392. On the other hand, when the result of judgment is YES the step is returned to the main program (step 304 of FIG. 4).

Under the assumption that the key designation signal KD stored in the tonality register RKD is a code "0010" representing the D major tonality and that the degree designation signal DD which has been stored in the degree register RDD is designating a duet note of third below, one example of forming the duet data table III shown in FIG. 5 will be described as follows.

Initially, since the address counter RADD is set to zero, all processings executed at steps 392–398 are executed with reference to an address 0.

At this time the note code NC read out from the memory table I (Table V) at the step 392 is NC·C, that is "0000" and "NC+RKD=0000+0010=0010" with the result that "0010" (duodecimal 2) would be stored in the register X of the CPU 30. At this time the result of judgement as to X>Z is NO.

By the processing executed at step 394, "0010", that is the note code NC·D is written into the note code storing position at address 0 of the memory table III (Table VII).

At step 396 the subtable II-1 (see Table VI) of 3rd degrees below is selected by the register RDD and a duet note difference data "−3" is read out from address 0, and this data "−3" is written into the duet note difference data storing position at the address 0 of the memory talbe III (Table VI).

A a result of processing of "RADD←RADD+1" executed at step 397, the count of RADD becomes one. At step 398 since the result of judgment as to whether RADD≧7 is NO, the program is returned step 392 thereby executing the steps 392, 394 and 396 in connection with address 1.

At this address 1, a note code NC·D, i.e., "0010" is read out from the memory table I (Table V). Accordingly, "NC+RKD=0010+0010=0100" which is stored in the register X (duodecimal 4). Under these conditions, the result of judgment made at step 393 as to whether X>Z is NO.

By the processing made at step 394 "0100" that is the note code NC·E (see Table II) of the register X is written into the note code storing position at address 1 of the memory table III (Table VII).

As a result of processing made at step 396 the value "−3" is read out from the address of the subtable II-1 (Table VI) and written into the duet interval data storing position at address 1 of the memory table III (Table VII).

Then the count of the address counter RADD is increased by one to two with the result that the processes at step 392–398 are executed with reference to address 2. Thereafter, the processings at steps 392–398 are sequentially executed with reference to addresses 3, 4, 5 and 6. Upon completion of the processing at step 396 regarding address 6 the count of the address counter RADD becomes 7 as a result of the processing "RADD←RADD+1" made at step 397. The result of judgment of "RADD≧7" executed at step 398 becomes YES and the program is returned to that shown in FIG. 5.

In the foregoing example, at address 6, the result of judgment X>Z executed at step 393 becomes YES. More particularly, at address 6, a note code NC·B, that is "1011" is read out from the memory table I (Table V) at step 392 and "NC+RKD=1011+0010=1101" so that "1101" (duodecimal 11) would be stored in the register X. Thus the result of judgment X>Z executed at step 393 is YES and 1 (binary "0001" is written into the register X as a result of processing "X←X−10" executed at step 395. Consequently, "0001" that is the note code NC·C# is stored at the note code storing position at the address 6 of the memory table III (Table VII).

In the above example, for D major tonality and 3rd-degrees below, data are finally written in the memory table III as shown in the Table VIII.

TABLE VIII

| Address Syllable Name | 0 do | 1 re | 2 mi | 3 fa | 4 so | 5 la | 6 si |
|---|---|---|---|---|---|---|---|
| Scale-note Note Code of A Designated Tonality | NC.D | NC.E | NC.F# | NC.G | NC.A | NC.B | NC.C# |
| duet note difference data | −3 | −3 | −4 | −3 | −3 | −4 | −4 |

Table VIII shows that at the note code storing positions of the memory Table III, and at respective memory addresses 0–6 corresponding to respective syllable name representations (do through si) are written the note codes NC of the scale notes D, E, F#, G, A, B and C# of the designated D major tonality. It also shows that the contents of the subtable II-1 (Table VI) corresponding to the degree of a designated duet note are shifted, as they are, to the duet note difference data storing positions of the memory Table III. Because the duet note difference data corresponding to respective syllable names do not vary regardless of the tonality.

Turning back again to FIG. 4, at step 304 the key code UKC of a depressed key on the upper keyboard from the upper keyboard key code input buffer 35 (FIG. 3) is written into a register RUKC in the working memory device 32 and the variation of the content of the key code UKC from a previous one is detected. More particularly, each time the key code UKC is written into the register RUKC, the old content thereof is stored in a separate register and when the content thereof is different from that of the register RUKC, the variation of the key code UKC (that is depression of a new key) is detected. As the variation of the key code UKC is detected as a result of the processing executed at step 304, the program is advanced to the processing of "Table III search" executed at step 305.

In the processing of this table III search executed at step 305 the same note code as the note code NC of the key code of the depressed key on the upper keyboard, which has been stored in the register RUKC, is searched out of the note code storing position (see Tables VII and VIII) of the memory table III. For example, the note code storing positions of the memory table III is sequentially read out starting from address 0 and the read out note code is compared with the note code of the register RUKC. Where the same note code as the depressed key note code of the register RUKC has been stored in the note storing position of the memory table III, the result of "RUKC table III NC" and the program is advanced to step 307. Where the same note code as the depressed key note code of the register RUKC is not stored in the note code storing position of the memory Table III, the result of "RUKC ⊂ Table III NC" is NO so that the program is transferred to step 308 after clearing the duet note key code output register 37. This means that the depressed key has not the scale note of the designated tonality. In this case, the register 37 is cleared and the duet note key code DKC and hence a duet tone would not be generated.

At step 307, a duet interval data is read out from an address of the memory table III storing the same note code as the note code NC of the register RUK and the read out data is stored in the register X in the CPU 30. Then at the processing of "X←RUKC+X" executed at step 309 the key code UKC of the depressed key stored in the register RUKC is added to the duet interval data stored in the register X and the sum is stored in the register X. In this example, it is assumed that the duodecimal addition operation is performed in the same manner as in the addition/subtraction circuit 20 shown in FIG. 1. For example, as shown by the processings of "X>Z" and "X←X−10" shown in FIG. 5 the data may be converted into duodecimal numbers after binary computation. As a result of this computation, a difference data necessary to form a duet note is added (or subtracted) to the depressed key code UKC so that the content of the register X becomes equal to the key code DKC of a duet note. Accordingly, at the next step 310 the content of the register X is transferred to and stored in the duet note code output register 37. Then, the program is returned to step 304 and held at a waiting state until the key code varies or a new key is depressed. As above described, the duet note key code DKC stored in the duet note code output register 37 is applied to the duet tone generator 26 so as to generate a musical tone signal of a duet tone.

On the assumption that the memory content of the memory table III is as shown in Table VIII, let us describe the processing when a key D4 on the upper keyboard is depressed with reference to the flow chart shown in FIG. 4. At the time of processing "Table III search" at step 305 a coincidence between the note code NC·D stored at address 0 of the memory table III and the D note code stored in the register RUKC is detected by the CPU 30. Consequently, at step 307 the duet difference data "−3" stored at address 0 of the memory table III is stored in the register X. At the next processing of "X←RUKC+X" executed at step 309, a value "3" ("0011") is subtracted from the key code "0110010" of the key D4.

Since "0011" is not subtracted from the duodecimal lower order "0010" of the key code, when the subtraction operation is made by shifting one digit toward the lower order the duodecimal upper order "011", the result becomes "0101011" which is stored in the register X. This data "0101011" is transferred to the duet note code output register 37 from the register X. This key code "0101011" corresponds to the B note (see Tables I and II) of the second octave that is B3 so that the note B3 which is 3rd degrees below of the depressed key D4 is produced as the duet tone.

In the embodiments shown in FIGS. 1 and 3, the duet tone is determined in relation to only the upper keyboard tone, that is the melody tone and where the melody tone contains a semi-tone, and the circuit is constructed such that a duet tone corresponding to the chromatic melody tone (a depressed key on the upper keyboard) would not be produced so that it is not considered to apply a duet tone to the chromatic tone. This can be understood from the fact that the duet interval data of the semi-tone is blank in the duet parameter memory device 21 illustrated in Table IV or the fact that the memory tables I, II and III are formed for only one scale tone as illustrated in Tables V through VIII. In this manner, in the foregoing embodiments, although theoretically satisfactory, duet performance is possible, it is not yet complete.

Figure 6:
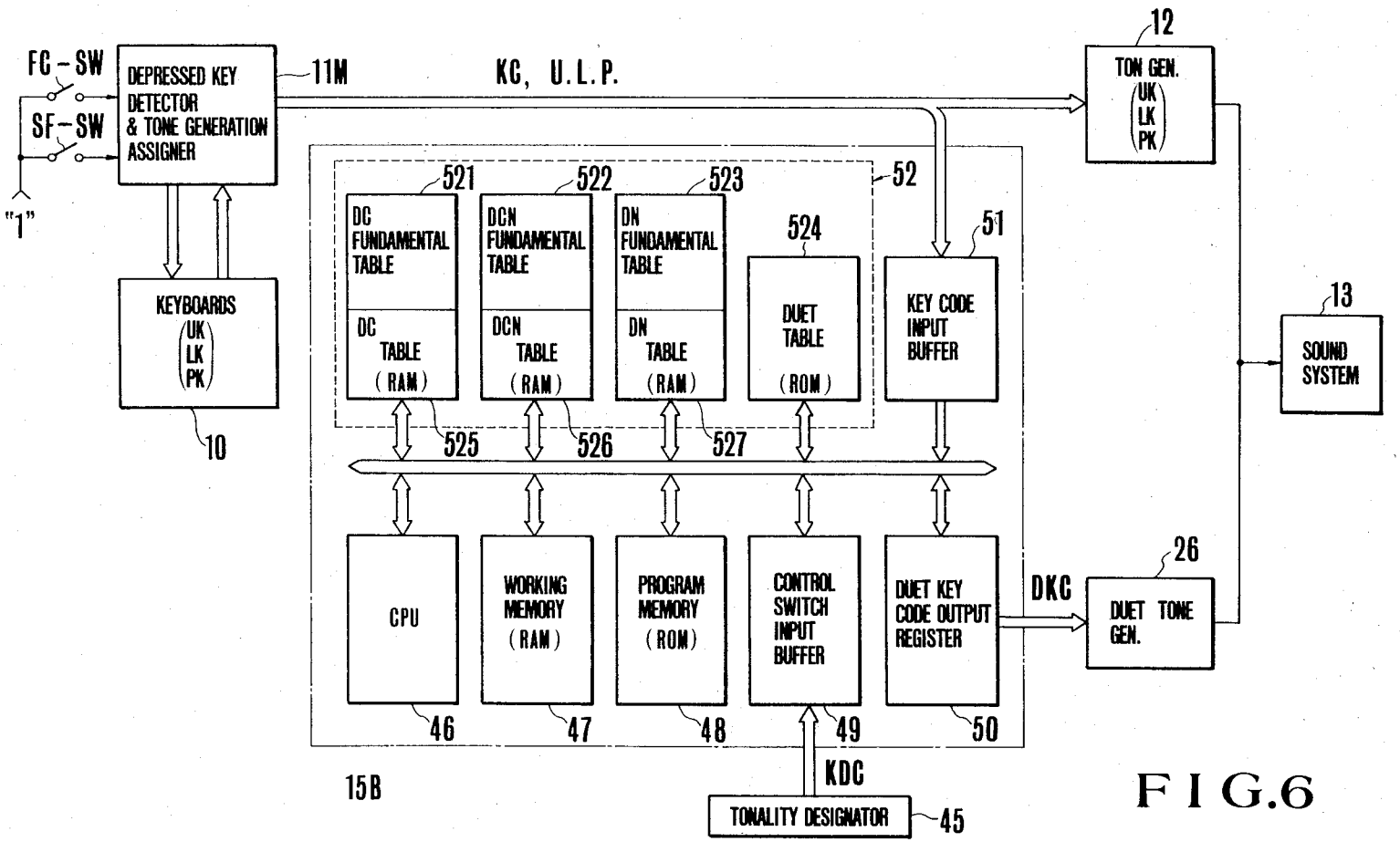
FIG. 6 is a block diagram showing still another embodiment of this invention.

More particularly, in the actual performance, the duet performance is made in relation to the accompaniment chord for the purpose of making the melody tone to be more heavy and beautiful. In the actual performance, at an intermediate point of a music the tonality is often changed. In such a case, a tone which is a chromatic scale of the original tonality would also be contained in the melody tone. Moreover, chromatic scale tones are often used regardless of the changing of the tonality. For this reason it is desirable to apply a suitable duet tone to a chromatic melody tone too. FIG. 6 shows another embodiment of this invention which takes into consideration these points and is more desirable from the standpoint of a music.

More particularly, in the embodiment shown in FIG. 6, a melody performance utilizing the upper keyboard of the keyboard unit and the accompaniment (chord) performance utilizing the lower keyboard are made simultaneously for adding a duet tone to the melody tone, the duet tone being determined in relation to not only the performance tonality and the note of the melody tone but also to the accompaniment chord. The basic principle of adding the duet tone in the embodiment shown in FIG. 6 is as follows.

Where the accompaniment chord (lower keyboard tone) is a diatonic chord and the melody tone (upper keyboard tone) is a diatonic scale note, a tone which is a predetermined degree spaced from the melody tone is produced as the duet tone. For simplifying the description, in the following, only a case wherein tones of 3rd degrees below the melody tones are generated as the duet tones will be described. Thus, above described predetermined degree is 3 degrees below.

The term "diatonic scale note" (hereinafter abbreviated as "diatonic tone") means a scale note of a designated tonality. In the case of the C major tonality, for example, they are 7 notes of C, D, E, F, G, A and B. On the other hand the term "non-diatonic scale note" (hereinafter termed non-diatonic tone) means tones other than the diatonic tones, that is chromatic tones. For example, in the case of a C major tonality they are five tones of C♯. D♯. F♯. G♯ and A♯.

The term "diatonic chord" means a chord constituted by scale notes of a designated tonality that is diatonic scale tones. Thus for example, in the case of a C major tonality, there are ten types of chords, that is C major chords (C, E, G), D minor chords (D, F, A), E minor chords (E, G, B), F major chords (F, A, C), G major chords (G, B, D), A minor chords (A, C, E), D minor seventh chord (D, F, A, C), E minor seventh chord (E, G, B, D), A minor seventh chords (A, C, E, G) and G seventh chords (G, B, D, F). On the other hand, the nondiatonic chord includes all chords other than above described chords.

One example of the application of the basic principle is as follows. Where the tonality is a C major tonality and the performance chords are C, E and G, that is the C major chords, as a key F4 is depressed to produce a melody tone, D4 tone 3rd degrees below the key F4 is produced as a duet tone according to the basic principle described above.

Furthermore, in the embodiment shown in FIG. 6, the duet tones are determined according to the following improved points (1)–(6) as an exception of the basic principle.

(1) Where the accompaniment chord (lower keyboard tone) is a nondiatonic chord, among the tones constituting the nondiatonic chord, a tone lower than the melody tone (upper keyboard tone) and closest to it is produced as a duet tone. In this case, however, the duet tone is selected such that the interval between the melody tone and the duet tone would be larger than the major 2nd. This is to prevent contamination of the tones which occurs when the interval between the melody tone and the duet tone is too small.

For example, where a C major tonality is designated, an E major chord (which is a nondiatonic chord for the C major tonality) constituted by notes E, G♯ and B is performed thereby showing that a key E4 is depressed for producing a melody tone. Among the tones (E, G♯, B) constituting a chord, the tone lower than the melody tone E4 and closest thereto is B note in the third octave, that is B3. Thus, B3 tone is generated as a duet tone. In the above described example, where a key C4 is depressed to generate a melody tone, although the chord forming tone closest to C4 is B3, as its interval is of a minor second degree, B3 would not be selected but instead G♯3 would be produced as the duet tone.

In this improvement (1), whether the melody tone is a diatonic tone or not is not considered. For this reason, even when the melody tone is a chromatic scale tone (nondiatonic tone) a duet tone is added thereto. This improvement is made for the following reasons. Thus, appearance of a nondiatonic chord may be considered as a tonality modulation, but since it is impossible to descriminate a modulated tonality, it is impossible to select a tone spaced a predetermined degree from the melody tone out of diatonic tones after the modulation. Accordingly, where a duet tone is selected from chord constituting tone rather than generating undesirable tone as a duet tone according to the original tonality (designated tonality) the scale tone after the tonality modulation is produced as a duet tone which is of course desirable.

(2) Where the accompaniment chord (lower keyboard tone) is a diatonic chord and where the melody tone (upper keyboard tone) is of the same note as those of the chord constituting tones, apart from the basic principle described above, a tone lower than the melody tone and closest thereto among the chord constituting tones (including tones having octave relations therewith) is produced as a duet tone because, where the duet tone is not a chord constituting tone in a case when the melody tone is the same note as the chord constituting tone, the resulting chord is unstable and lacks a tonality feeling. For this reason, the chord is made thick by forming the duet tone with a chord constituting tone.

A case wherein C major chord constituted by C, E, and G is performed when the C major tonality is designated and a key G4 is depressed to produce a melody tone is an example. In this case, a chord constituting tone E4 lower than the tone G4 and closest thereto is generated as a duet tone.

(3) According to the improvement (1) and (2) when a duet tone produced according to the above described improvement (1) or (2) or to an operation ② of the improvement (6) to be described later (that is when the duet tone is selected among the chord constituting tones as an exception of the basic principle) greatly differs from a duet tone produced immediately before, instead of the duet tone (that determined according to the improvement (1) or (2) or ② of (6)) a duet tone closest to that immediately before is produced as the duet tone among the chord constituting tones lieing between the first mentioned duet tone and a duet tone immediately before it. However, when there is no chord constituting tone between the duet tone determined according to the improvement (1) or (2) or ② of (6) and a duet tone immediately preceding the same, the chord constituting tone closest to the immediately preceding duet tone is the determined duet tone so that this duet tone is produced as it is.

Figures 7A, 7B:
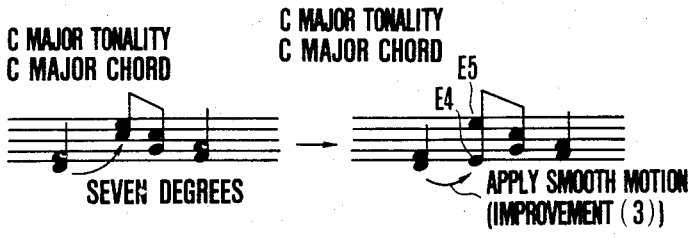
FIGS. 7*a* and 7*b* are scores showing examples of musically improved ensemble tone generation.

One example of the application of improvement (3) is shown in FIGS. 7A and 7B. It is now assumed that the designated tonality is the C major tonality, that the accompaniment chord is the C major chord, and that the melody tone progresses as F4→E5→C5→A4. Without this improvement, a duet tone D4→C5→G4→F4 is added as shown in FIG. 7*a*. More particularly, the basic principle is applied to the melody tone F4 and a D4 tone of three degrees thereunder is produced as the duet tone. The improvement (2) is applied to the next melody tone E5 to produce a C5 tone as a duet tone. The improvement (2) is applied to the next melody tone C5 to produce a G4 tone as a duet tone, and the fundamental principle is applied to the next melody tone A4 to produce a tone F4 as a duet tone. However, a melody tone C5 produced by applying the improvement (2) to the melody tone E5 is spaced 7 degrees from the immediately preceding duet tone D4. Accordingly, the improvement (3) is applied to the duet tone C5. Where the improvement (3) is applied, a duet tone is produced as shown in FIG. 7B. In other words, among the chord constituting tones C, E and G between the duet tone C5 exceptionally determined by the improvement (2) and the immediately preceeding duet tone D4, the tone E4 closest to the immediately preceding duet tone D4 is produced as the duet tone instead of the duet tone C5.

This improvement (3) is adopted for the following reason. To compose or arrange a music it is generally preferred that the tones are smoothly connected together. Where the duet tone greatly varies due to the application of the improvement (1) or (2) or the exceptional measure of (6)-②, a general rule of smoothly progressing a rhythm is given with a priority so as to make small the melodic interval of the duet tone (thus making smooth the rhythmical progression of the duet tone.

(4) When a perfect interval is obtained by the application of improvement (3) instead of a duet tone determined by the improvement (3) a chord constituting tone adjacent that duplicate tone is produced as a duet tone. The perfect interval described above means that the intervals of the duet tone determined by the improvement (3) and of the melody tone corresponding thereto become perfect 5 degrees or perfect 8 degrees. Since the frequency ratio is expressed by a simple integer, the interval relation of the perfect 5 degrees or perfect 8 degrees is such that, addition of a duet tone of this interval makes thin the tone, that is decreases the duet tone feeling. For this reason the perfect interval is prevented by producing another chord constituting tone as the duet tone. Otherwise unwanted parallel movement might occur.

Figures 8A, 8B, 8C:
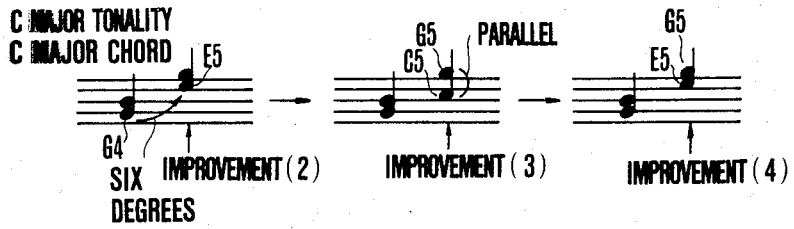
FIGS. 8*a*–8*c* are scores showing other examples of improved ensemble tones.

FIGS. 8A, 8B and 8C show some example of the application of improvement (4). In this case, it is assumed that the designated tonality is the C major tonality that the accompaniment chord is the C major chord, and that the melody progresses as B4, G5. FIG. 8A shows application of improvements (3) and (4), FIG. 8B shows a case where the improvement (3) is applied but the improvement (4) is not applied, and FIG. 8C shows the application of improvement (4). In FIG. 8A, the improvement (2) is applied to a melody tone G5 to determine a chord constituting tone E5 closest to the melody tone G5 as the duet tone. However, since the interval between it and an immediately preceding duet tone G4 is 6 degrees, the improvement (3) is applied, whereby a chord constituting tone C5 closest to the immediately preceding duet tone G4 is selected as a duet tone, as shown in FIG. 8B. However, since this duet tone selected by the improvement (3) has a perfect interval (perfect 5th interval) with respect to the melody tone G5, the improvement (4) is applied. In other words, as shown in FIG. 8*c*, a chord constituting tone E5 one order above the duet tone C5 determined by the improvement (3) is produced as a duet tone.

In the example shown in FIG. 7B, the interval between the duet tone E4 determined by the improvement (3) and the melody tone is perfect 8 degrees (parallel) but as the progression or motion is brought by 2 degrees, this can be permitted from the standpoint of the theory of harmony. In this embodiment, however, for simplifying the circuit construction, this is not used but the improvement (4) is applied.

(5) This improvement is made for the purpose of producing a duet tone according to Kadenz theory at the end of a music so as to give a terminal feeling.

According to Kadenz theory, at the end of a music, it is usual that a chord takes a motion of "V7 (a chord of dominant 7th)→I (root triad)", that a melody tone takes a motion of "IV tone (4th degree tone)→III tone (3rd degree tone") or of "VII tone (seventh degree tone)→I tone (first degree tone)". Where the motion of the accompaniment chord is "V7→I" and when a IV tone is produced as a duet tone, when the chord is V7, a III tone is generated as the duet tone for the chord I. On the other hand, when a VII tone is produced as a duet tone when the chord is V7, the circuit is constructed such that a I tone will be produced as a duet tone for the chord I.

For example, where the C major tonality is designated, when the chord motion varies from the G seventh G7 to the C major, this corresponds to the chord motion "V7→I" of Kadenz theory. At this time, when the duet tone generated at the time when the chord is the G seventh is F (IV tone) or B (VII tone), the improvement (4) is applied. More particularly, when the preceding tone is F, E (III tone) would be produced as a duet tone when the chord is C major chord (chord I) whereas when the preceding duet tone is B, C (I tone) would be produced as a duet tone when the chord is a C major chord. While an A minor tonality is designated, change of the chord motion from a E seventh chord to an A minor chord corresponds the chord motion "V7→I" of Kadenz theory. At this time, when a D tone (IV tone) or a G# tone (VII tone) is produced as a duet tone at the time of the seventh chord, a C tone (III tone) or an A tone (I tone) would be produced as a duet tone at the time of the A minor chord. The seventh tone of the A minor tonality was taken as the major seventh tone G#, this is because a harmonic minor scale was adopted as the minor scale in the embodiment shown in FIG. 6.

(6) When the accompaniment chord is a diatonic chord and the melody tone is a nondiatonic tone (chromatic scale) the duet tone is determined according to either one of the following ① and ②.

① Where the melody motion is equal to or shorter than major second (melodic interval is equal to or shorter than major second), the circuit is constructed such that the melodic interval between a presently produced duet tone and an immediately preceding duet tone would be the same as the melodic interval of the melody tone. In other words, the duet tone is shifted by the same interval as the melodic interval of the melody tone.

② Where the melody motion is longer than the major second, a tone which is closest to but more than major second interval apart from and lower than the melody tone is selected as a duet tone from among the component tones of the accompaniment chord (diatonic chord). Thus, an operation similar to that of the improvement (1) is made (however, this operation is different in that the chord is a diatonic chord.

Figures 9A, 9B:
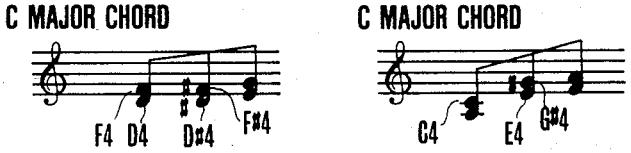
FIGS. 9*a* and 9*b* are scores showing still other examples of improved ensemble tones.

An example of ① is illustrated in FIG. 9A and an example of ② is illustrated in FIG. 9B. Both figures are depicted on the assumption that the designated tonality is C major tonality and that the accompaniment chord is C major chord. The second melody tone F#4 shown in FIG. 9A is a nondiatonic tone of the C major tonality and the interval between it and a preceding melody tone F4 is minor second. Accordingly the improvement (6)-① is applied so as to generate the D#4 tone as a duet tone corresponding to the melody tone F#4 by shifting the immediately preceding duet tone D4 by an interval same as the melodic interval (minor second) of the melody tones. The second melody tone G#4 shown in FIG. 9B is a nondiatonic tone of the C major tonality and the interval between it and the preceding melody tone C4 is minor sixth. Accordingly, the improvement (6)-② is applied to select as a duet tone a chord constituting tone E4 which is lower than G#4 and separate from G# by more than major second interval.

This improvement is made for the following reason. Thus, while the accompaniment chord is a diatonic chord when a nondiatonic note (chromatic scale note) is produced as a melody tone it is not considered as a modulation but as a passing note. Thus, it is a rule to shift the duet tone by an interval same as the melodic interval of the melody tones as in (1) (in other words the duet tone is also made a passing note). However, when the melody moves greatly (large melodic interval), the operation of (1) causes unstability so that it is safe to select the duet tone among the chord constituting tones as in (6)-②.

In FIG. 6, a keyboard unit 10, a musical tone generator 12 for respective keyboards, a duet tone generator 26, and a sound system 13 are identical to those shown in FIGS. 1 and 3. The depressed key detection and tone generation assignment circuit 11M shown in FIG. 6 contains a circuit for performing an automatic bass chord performance in addition to the circuit 11 shown in FIGS. 1 and 3 and is combined with a finger code selection switch FC-SW, and a single finger selection switch SF-SW which select whether the automatic bass chord performance is to be peformed by a fingered chord mode or a single finger mode. In the case of the fingered chord mode all tones of the depressed keys on the lower keyboard are produced as the accompaniment chord, but in the case of the single finger mode, the accompaniment chord is produced automatically by using a single tone of a depressed key on the lower keyboard as a root note. Not only the chord produced by the depressed key on the lower keyboards but also the chord automatically produced are treated as lower keyboard tones. For this reason, keyboard identifying codes U. L. P. attached to the key codes KC of the chord constituting tones outputted from the depressed key detection and tone generation assignment circuit 11M represent the lower keyboard. For example, this circuit 11M has the same construction as that disclosed in Japanese Preliminary Publication No. 43014/'79.

A duet note key code forming circuit 15B is constituted by a microcomputer. Like the tonality designator 28 shown in FIG. 3, a tonality designator 45 comprises a group of switches that select the root note of the key, another group of switches that select the major/minor distinction of the tonality, and an encoder that encodes the outputs of these switch groups to produce a tonality designation code KDC.

However, the content of the tonality designation code KDC of the embodiment shown in FIG. 6 differs somewhat from that of the tonality designation signal KD of the embodiments shown in FIGS. 1 and 3, because in the embodiment shown in FIG. 6, a harmonical minor scale is utilized as the minor scale. In the embodiments shown in FIGS. 1 and 3 since a natural minor scale is used, the tonality designation signals for the major tonality and the minor tonality utilize common codes. However, where a harmonical minor scale is used, the scale of the major tonality and the minor tonality is not common so that it is necessary to determine 24 types of the tonality designation codes KDC as shown in Table IX.

TABLE IX

| | KDC Binary Representation | | | | |
|---|---|---|---|---|---|
| Key | Key Note Code KNC | | | | Tonality (major/minor) |
| C major | 0 | 0 | 0 | 0 | 0 |
| C# major | 0 | 0 | 0 | 1 | 0 |
| D major | 0 | 0 | 1 | 0 | 0 |
| D# major | 0 | 0 | 1 | 1 | 0 |
| E major | 0 | 1 | 0 | 0 | 0 |
| . | | | . | | |
| . | | | . | | |
| . | | | . | | |
| B major | 1 | 0 | 1 | 1 | 0 |
| A minor | 1 | 0 | 0 | 1 | 1 |
| A# minor | 1 | 0 | 1 | 0 | 1 |
| B minor | 1 | 0 | 1 | 1 | 1 |
| C minor | 0 | 0 | 0 | 0 | 1 |
| C# minor | 0 | 0 | 0 | 1 | 1 |
| . | | | . | | |
| . | | | . | | |
| . | | | . | | |
| G# minor | 1 | 0 | 0 | 0 | 1 |

As shown in Table IX, the tonality designation code KDC comprises a four bit key note code KNC and a one bit code representing the major/minor distinction. The key note code KNC has the same content as the note code (Table II) of the key note. The tonality code represents a major tonality when it is "0" but a minor tonality when it is "1".

A CPU 46, a working memory device 47, a program memory device 48, a control switch input buffer 49 and a duet note code output register 50 operate in the same manner as those designated by the reference charactors 30, 31, 32, 36 and 37 in FIG. 3. FIG. 6 lacks an element corresponding to the degree designator 29 shown in FIG. 3. This is caused by fixing the interval of the duet tone provided in accordance with the basic principle described above to only 3rd degree below, thus making it impossible to select for simplicity.

The key code input buffer 51 discriminates the key codes KC sent out from the depressed key detection and tone generation assignment circuit 11M for upper and lower keyboards according to the keyboard identifying code U. L. P. and stores the selected key code.

Figure 10:
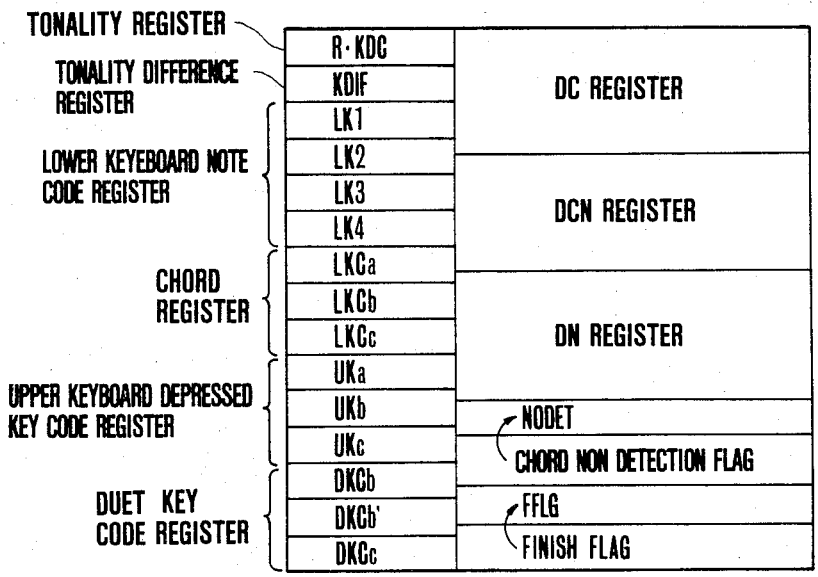
FIG. 10 shows one example of registeres included in a working memory device of the ensemble tone key code forming circuit shown in FIG. 6.

One example of the registers contained in the working memory device 47 is shown in FIG. 10. A tonality register R KDC stores a tonality designation key code KDC received through a control switch input buffer 49. A tonality difference register K DIF is provided for the purpose of storing the difference between a key note code (C for the major tonality and A for the minor tonality) of the fundamental tonality to be described later and a key note code KNC contained in the tonality designating code KDC in the tonality register R KDC. For note code registers LK1, LK2, LK3, LK4 for the lower keyboard respectively store note codes (i.e., the chord constituting tones of the keys on the lower keyboards which are depressed simultaneously (or generated automatically). In addition, the working memory device 47 comprises three chord registers LKCa, LKCb and LKCc which store chords, upper keyboard depressed key code registers UKa, UKb and UKc, duet tone key code registers DKCb, DKCb' and DKCc, a DC register, a DCN register, a DN register, a no-chord-detection flag register NODET, a terminal flag register FFLG.

The duet note key code forming circuit 15B is constructed to form a duet key code DKC when a chord produced by the depressed key (i.e., a melody tone) on the upper keyboard varies. A chord register LKCa, an upper keyboard depressed key code register UKa each applied with a suffix "a" are utilized to detect the variation described above (event detection). Registers LKCb, UKb and DKCb each applied with a suffix "b" are utilized to store a chord under processing or an upper keyboard depressed key code or a duet key code. Registers LKCc, UKc and DKCc each applied with a suffix "c" are used to store immediately preceding (already processed) chord or an upper keyboard depressed key or a duet tone key code.

The DC register DC stores the diatonic chords DC, while the DCN register stores the diatonic chord constituting notes DCN as will be described later in detail.

The data memory device 52 comprises memory tables 521 through 527 each constituted by a ROM or RAM. The memory table 521 is a diatonic chord (DC) fundamental table and constituted by a ROM. As shown in Table X, the memory table 521 comprises a major tonality portion and a minor tonality portion and one of them is selected according to a designated tonality. The diatonic chords (DC) of the major tonality are represented by ten chord symbols of I, II, II7, III, III7, IV, V, V7, VI and VI7. These ten types of the diatonic chords I–VI7 correspond to the address 0–9 of the major tonality portion of the memory table 521. The diatonic chords (DC) of the minor key tonality are represented by six chord symbols I, IV, IV7, V, V7 and VI which correspond to addresses 0–5 of the minor tonality portion of the data table 211.

TABLE X

| | Chord Symbol | Address | Memory Content: Chord Note Fundamental Code: Root-Note NC | m | 7th | Chord Constituting Tone Table Address (decimal) | Duet Table X Address (decimal) |
|---|---|---|---|---|---|---|---|
| Major Tonality Portion | I | 0 | NC.C | 0 | 0 | 0 | 0 |
| | II | 1 | NC.D | 1 | 0 | 1 | 1 |
| | II7 | 2 | NC.D | 1 | 1 | 2 | 2 |
| | III | 3 | NC.E | 1 | 0 | 3 | 3 |
| | III7 | 4 | NC.E | 1 | 1 | 4 | 4 |
| | IV | 5 | NC.F | 0 | 0 | 5 | 5 |
| | V | 6 | NC.G | 0 | 0 | 6 | 6 |
| | V7 | 7 | NC.G | 0 | 1 | 7 | 7 |
| | VI | 8 | NC.A | 1 | 0 | 8 | 8 |
| | VI7 | 9 | NC.A | 1 | 1 | 9 | 9 |
| Minor Tonality Portion | I | 0 | NC.A | 1 | 0 | 0 | 0 |
| | IV | 1 | NC.D | 1 | 0 | 1 | 1 |
| | IV7 | 2 | NC.D | 1 | 1 | 2 | 2 |
| | V | 3 | NC.E | 0 | 0 | 3 | 3 |
| | V7 | 4 | NC.E | 0 | 1 | 4 | 4 |
| | VI | 5 | NC.F | 0 | 0 | 5 | 5 |

In the memory table 521 are prestored codes representing the chode notes of respective diatonic chords taking a predetermined tonality as a reference. In the example shown in Table X, the C tonality key is taken as the basic for the major tonality portion, while the A minor tonality is taken as the basic for the minor tonality portion. In the memory table 521 are stored chord constituting tone table address data for addressing the memory table 522 (or 526) described later, and duet table X address data for addressing a memory table 524 to be described later. More particularly, as shown in Table X, while the memory table 521 stores a chord note fundamental code, chord constituting tone memory table address data and duet table X address data corresponding to respective addresses 0–9 (which correspond to chord symbols I–VI7 respectively) of the major tonality portion and the addresses 0–5 (corresponding to the chord symbols I–VI respectively) of the minor tonality portion.

The chord note fundamental code is made up of a root-note code NC, a minor chord indication code (m) and a seventh chord indication code (7th). Although in Table X, the note codes an shown by reference charactors NC·C, NC·D . . . , the relationship between these codes, binary codes and note has already been shown in Table II. Thus, the end characters C, D, etc. represents the notes. For example "NC·C, 0, 0" is stored as the chord note fundamental code at address 0 of the major tonality portion corresponding to the I chord (root triad). This means the C major chord, thus, since the fundamental tonality of the major tonality portion of the memory table 521 is made to be the C major tonality, a code representing the C major chord i.e., the I chord of the C major tonality is stored in address 0 as the chord note fundamental code representing the C major chord, that is the I chord of the C major tonality. In this manner, the addresses 0–9 of the major tonality portion respectively store codes representing the diatonic chords of the C major tonality (C, Dm, Dm7, Em, Em7, F, G, G7, Am, Am7) as fundamental codes. On the other hand the addresses 0–5 of the minor tonality portion respective store codes representing the diatonic chodes (Am, Dm, Dm7, E, E7 and F) of the minor tonality as the chord note fundamental codes.

The memory table 522 of the data memory device 52 constituted by a ROM is used as a diatonic chord constituting tone (DCN) fundamental table. Like the memory table 521 the memory table 522 too comprises a major tonality portion and a minor tonality portion and either one of them is selected according to the designated tonality. In this memory table 522 are prestored the note codes NC of the diatonic chord constituting tones by using the C major tonality as the basic for the major tonality and the A minor tonality as the basic for the minor tonality. The memory content of the table 522 is shown in Table XI, wherein the note codes are designated by reference charactors NC·C, NC·D . . . Addresses 0–9 and 0–5 respectively of the major tonality portion and the minor tonality portion correspond to the diatonic chords (I–VI7 and I–VI) in the same manner as in the memory table 521 shown in Table X. The addresses 0–9 of the memory table 522 respectively correspond to the values 0–9 of the chord constituting tone table address data stored in the memory table 521 (Table X).

TABLE XI

| | Chord | Address | Memory Content (Chord Constituting Tone) 1 | 2 | 3 | 4 |
|---|---|---|---|---|---|---|
| Major Tonality Portion | I | 0 | NC.C | NC.E | NC.G | |
| | II | 1 | NC.D | NC.F | NC.A | |
| | II7 | 2 | NC.D | NC.F | NC.A | NC.C |
| | III | 3 | NC.E | NC.G | NC.B | |
| | III7 | 4 | NC.E | NC.G | NC.B | NC.D |
| | IV | 5 | NC.F | NC.A | NC.C | |
| | V | 6 | NC.G | NC.B | NC.D | |
| | V7 | 7 | NC.G | NC.B | NC.D | NC.F |
| | VI | 8 | NC.A | NC.C | NC.E | |
| | VI7 | 9 | NC.A | NC.C | NC.E | NC.G |
| Minor Tonality Portion | I | 0 | NC.A | NC.C | NC.E | |
| | IV | 1 | NC.D | NC.F | NC.A | |
| | IV7 | 2 | NC.D | NC.F | NC.A | NC.C |
| | V | 3 | NC.E | NC.G# | NC.B | |
| | V7 | 4 | NC.E | NC.G# | NC.B | NC.D |
| | VI | 5 | NC.F | NC.A | NC.C | |

As shown in Table XI, with regard to the triads the note codes of three chord constituting tones are stored in respective addresses of the memory table 522, while with regard to the seventh chord the note codes of four chord constituting tones are stored in respective addresses. As the tone designations at the tail ends of the note code reference symbols, the note codes of the diatonic chord constituting tones of the C major tonality are prestored in the memory table 522 for the major tonality portion, while for the minor tonality portion, the note codes of the diatonic chord constituting tone of the A minor tonality are prestored in the memory table 522. Since in this embodiment, the minor tonality is made to be a harmonic minor scale it contains a major seventh interval (i.e., G# when A is taken as the key note) so that the chord of V and the chord of V7 constitute the diatonic chords (see addresses 3 and 4 of the minor tonality portion shown in Table XI).

Memory table 523 of the data memory device 52 is the fundamental table of the diatonic tone (DN) and constituted by a ROM prestoring the fundamental note codes representing seven diatonic tones of the major and minor tonalities. The memory content of the memory table 523 is shown in the following Table XII.

TABLE XII

| | DN Degree Representation | Address | Memory Content: DN Fundamental Note Code | Duet Table y Address (Decimal) |
|---|---|---|---|---|
| Major Tonality Portion | I | 0 | NC.C | 0 |
| | II | 1 | NC.D | 1 |
| | III | 2 | NC.E | 2 |
| | IV | 3 | NC.F | 3 |
| | V | 4 | NC.G | 4 |
| | VI | 5 | NC.A | 5 |
| | VII | 6 | NC.B | 6 |
| Minor Tonality Portion | I | 0 | NC.A | 0 |
| | II | 1 | NC.B | 1 |
| | III | 2 | NC.C | 2 |
| | IV | 3 | NC.D | 3 |
| | V | 4 | NC.E | 4 |
| | VI | 5 | NC.F | 5 |
| | VII | 6 | NC.G# | 6 |

The memory table 523 includes a major tonality portion and a minor tonality portion just like the memory tables 521 and 522 and either one of them are selected and utilized according to the designated tonality. Addresses 0–6 correspond to seven diatonic tones DN respectively (first to seventh tones). As shown in Table XII, for the major tonality portion, note codes NC·C through NC·B of the diatonic tones of the C major tonality are stored in respective addresses 0–6 as the fundamental note codes of respective diatonic tones (I–VII), whereas for the minor tonality portion, note codes NC·A through NC·G# of the diatonic tones of the A minor tonality are stored in addresses 0–6 respectively. Values 0–6 representing y addresses of a duet tone memory table 524 to be described later are also stored in the addresses 0–6 respectively of the memory table 523.

A memory table 524 of the data memory device 52 is a duet table and constituted by a ROM. This duet table 524 is used to prestore duet interval data ΔKC representing the interval of a duet tone (spacing from the melody tone, that is the upper keyboard tone) in relation to respective diatonic tones (DN) and diatonic chords (DC). More particularly, the duet interval data ΔKC corresponding to respective diatonic tones (I tone, II tone . . . VII tone) are prestored according to the kinds of the diatonic chords (I chord, II chord II7 chord . . .). Where the duet tone is determined according to the aforementioned fundamental rule or the improvement (2), this duet table 524 is utilized. One example of the memory table 524 is shown in the following Table XIII. The value of the duet interval data ΔKC corresponds to the number of included semi-tones described above.

TABLE XIII

| | DC Chord Symbol | x | DN Degree Representation I (y = 0) | II (y = 1) | III (y = 2) | IV (y = 3) | V (y = 4) | VI (y = 5) | VII (y = 6) |
|---|---|---|---|---|---|---|---|---|---|
| Major Tonality Portion | I | 0 | (−5) | −3 | (−4) | −3 | (−3) | −4 | −4 |
| | II | 1 | −3 | (−5) | −4 | (−3) | −3 | (−4) | −4 |
| | II7 | 2 | (−3) | (−5) | −4 | (−3) | −3 | (−4) | −4 |
| | III | 3 | −3 | −3 | (−5) | −3 | (−3) | −4 | (−4) |

TABLE XIII-continued

| | DC Chord Symbol | x | DN Degree Representation I | II | III | IV | V | VI | VII |
|---|---|---|---|---|---|---|---|---|---|
| | | | y | | | | | | |
| | | | 0 | 1 | 2 | 3 | 4 | 5 | 6 |
| | III7 | 4 | −3 | (−3) | (−5) | −3 | (−3) | −4 | (−4) |
| | IV | 5 | (−3) | −3 | −4 | (−5) | −3 | (−4) | −4 |
| | V | 6 | −3 | (−3) | −4 | −3 | (−5) | (−4) | (−4) |
| | V7 | 7 | −3 | (−3) | −4 | (−3) | (−5) | −4 | (−4) |
| | VI | 8 | (−3) | −3 | (−4) | −3 | −3 | (−5) | −4 |
| | VI7 | 9 | (−3) | −3 | (−4) | −3 | (−3) | (−5) | −4 |
| Minor | I | 0 | (−5) | −3 | (−3) | −3 | (−4) | −3 | −4 |
| Tonal- | IV | 1 | (−4) | −3 | −3 | (−5) | −4 | (−3) | −4 |
| ity | IV7 | 2 | (−4) | −3 | (−3) | (−5) | −4 | (−3) | −4 |
| Portion | V | 3 | −4 | (−3) | −3 | −3 | (−5) | −3 | (−4) |
| | V7 | 4 | −4 | (−3) | −3 | (−3) | (−5) | −3 | (−4) |
| | VI | 5 | (−4) | −3 | (−3) | −3 | −4 | (−5) | −4 |

Just like the memory tables 521, 522 and 523 this memory table 524 too has a major tonality portion and a minor tonality portion, and either one of them is used according to the designated tonality. In Table XIII, x shows x addresses and y shows y addresses. These x and y addresses correspond to the duet tone table x address and y address described in the memory tables 521 and 523. The y addresses 0–7 of the major tonality portion respectively correspond to the diatonic chords I, II, II7, III, III7, IV, V, V7, VI and VI7 of the major tonality while the x addresses of the minor tonality portion respectively correspond to the diatonic chords I, IV, IV7, V7 and VI of the minor tonality. The y addresses 0–6 of the major and minor tonality portions respectively correspond to the diatonic tones of I, II, III, IV, V, VI and VII degrees. The duet tone difference data at cross-point of x and y addresses in Table XIII are read out from the memory table 524.

As above described, according to the fundamental rule, since a tone 3 degrees lower than (i.e. a third interval below) a melody tone is selected as a duet tone, the value of a duet difference data stored in the duet memory table 524 and corresponding to the minor third interval is "−3", while that corresponding to a major third interval is "−4". In Table XIII, duet interval data "−5" of more than 3 degrees exist. Because the improvement (2) is applied to the diatonic tones (DNC) which constitute a diatonic chord (DC). The diatonic chord constituting tone which is lower than the root note (a note of the degree symbol, coinciding with the chord symbol, that is I degree tone for a I chord, and II degree tone for II chord and II7 chord) and is closest to that root note is a tone 4 degrees below the root note, so that a value −5 meaning "4 degrees below" is a duet tone difference data. In the case of other diatonic chord constituting tones, tones three degrees lower than them are the diatonic chord constituting tones so that −3 or −4 is the duet difference data just the same as in a case where the fundamental rule is applied. In Table XIII, the duet difference data bounded by parentheses corresponds to the diatonic chord constituting tones.

The duet tone table 524 shown in Table XIII can be used in common for any tonalities. For example, the diatonic tones I, II, III, IV, V, VI and VII (corresponding to the y addresses of the memory table 524) for the C major tonality are C, D, E, F, G, A and B respectively and the I chord is a C major chord. The chord constituting tones of this C major chord are C, E, and G and correspond to I, III and V of the degree representation. A duet tone determined by a duet interval data "−5" corresponding to the I tone at the time of I chord is a tone of 5 semi-tones lower than C of I tone, that is a tone G in the octave next lower to the melody tone C. This satisfies the condition of the improvement (2) that relates to a chord constituting tone lower than C but closest thereto. A duet tone determined by a duet interval data "−4" for III tone at the time of I chord is a tone which is 4 semi-tones lower than E (i.e. the III tone) is C tone, which also satisfies the condition of the improvement (2). A duet tone determined by a duet interval data −3 for V tone when the chord is I chord is a tone which is 3 semi-tones lower than G (i.e., the V tone) is E tone, which also satisfies the condition of the improvement (2). The nonchord constituting diatonic tones of a C major chord which is the I chord of the C major tonality are D, F, A and B and the degree representations thereof are II, IV, VI and VII. The duet tones determined by duet interval data "−3", "−3", "−4" and "−4" corresponding to these degree representations II, IV, VI and VII are B tone in the next lower octave which is the tone of 3 degrees below D, a D which is the tone of 3 degrees below F, an F tone which is the tone of 3 degrees below A, and a G tone which is the tone of 3 degrees below B. These tones also satisfy the fundamental rule.

Taking the D major tonality as an example, the diatonic tones I, II, III, IV, V, VI and VII are D, E, F♯, G, A, B and C♯ respectively and the I chord is a D major chord. The chord constituting tones of this D major chord are D, F♯ and A and their degree representations are I, III and V. Accordingly, the duet tone determined by the duet interval data "−5" for to the I tone when the chord is the I chord is a tone which is 5 semi-tones below D, that is an A tone in the next lower octave, which also satisfies the improvement (2). In the same manner, a duet tone determined by a duet interval data "−4" or "−3" for to III tone or V tone when the chord is the I chord is a D tone which is a chord constituting tone below F♯ or a F♯ tone which is a chord constituting tone lower than A tone, which also satisfies the improvement (2). The degree representations of the nonchord constituting diatonic tones E, G, B and C♯ of a D major chord which is the I chord of the C major tonality are II, IV, VI and VII respectively and the duet tones determined by the duet interval data "−3", "−3", "−4" and "−4" for to these degree representations are C♯, E, G and A which are respectively lower by 3 degrees than E, G, B and C♯, which also satisfy the fundamental rule.

As can be clearly noted from the above described illustration regarding the I chords of the C major tonality and the D major tonality, the major tonality portion of the memory table 254 can be used in common for all major tonalities, and likewise the minor tonality portion can be used in common for all minor tonalities.

Each of the memory tables 525, 526 and 527 of the data memory device 52 is constituted by a RAM. The memory table 525 is a diatonic chord (DC) table into which are written data showing diatonic chords at a designated tonality obtained by converting the content of the diatonic chord fundamental table 521, (Table X) described above according to the content of a tonality designation code KDC. A memory table 526 is a diatonic chord constituting tone (DCN) table into which are written data showing diatonic chord constituting tones at a designated tonality obtained by converting the content of the diatonic chord constituting tone fundamental table 522 (Table XI) in accordance with the designated tonality. A memory table 527 is a diatonic tone (DN) table into which are written data representing diatonic tones of a designated tonality obtained by converting the content of the diatonic tone fundamental table 523 (Table XII) in accordance with a designated tonality.

FIGS. 11 through 14 are flow charts showing one example of a duet tone key code forming processing program executed by the duet note key code forming circuit 15B shown in FIG. 6. This program is being stored in a program memory device 48 and executed under the control of the CPU 46.

Figure 11:
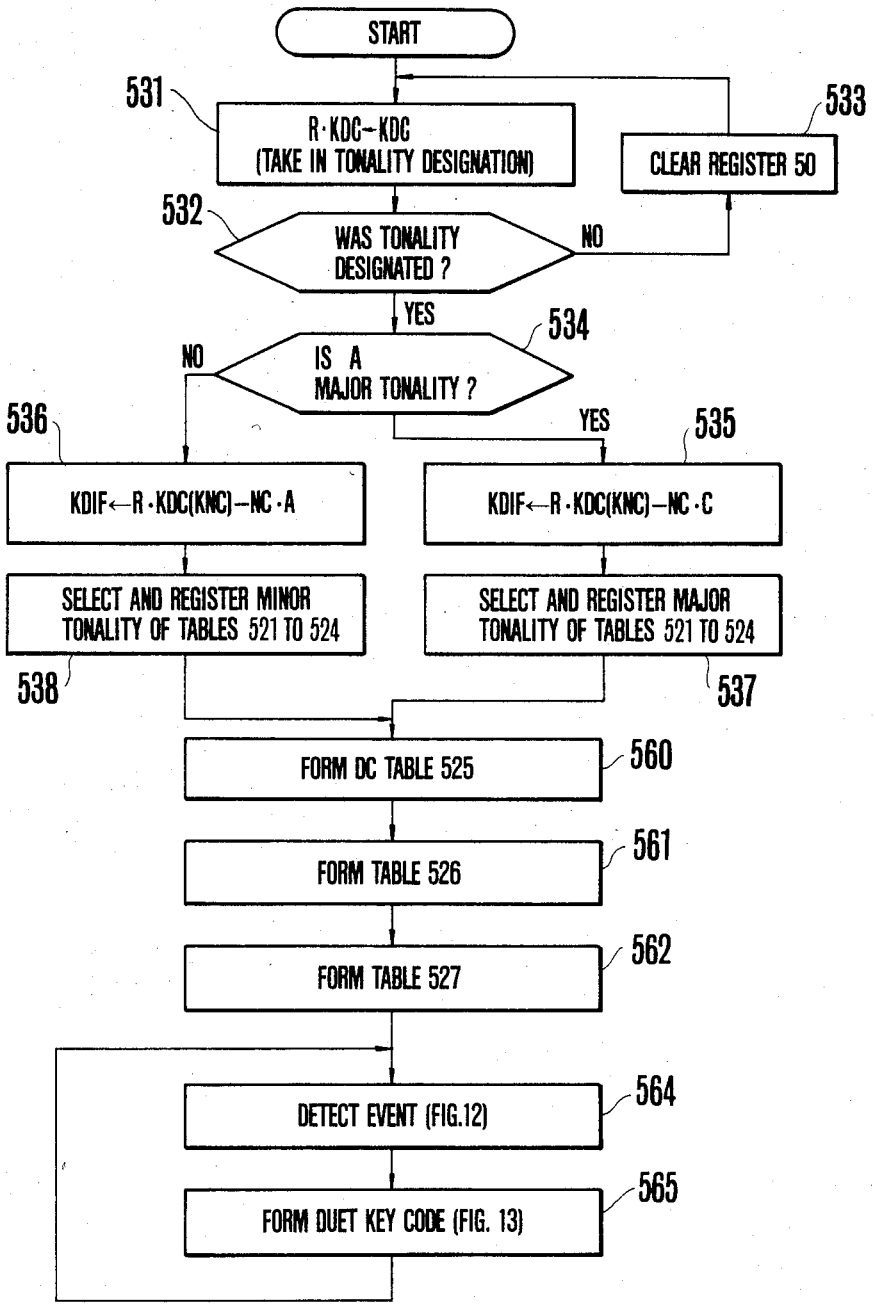
FIG. 11 is a flow chart diagrammatically showing one example of the processing program of the ensemble tone key code forming circuit shown in FIG. 11.

In the flow chart shown in FIG. 11, the program is started when the power source of the electronic musical instrument is closed, or a switch, not shown, which a duet automatic performance ability is closed, or when a tonality designation key code KDC changes. At a step 531 of processing "R·KDC←KDC" a key designation code KDC is derived out of a control switch input buffer 49 and the tonality designation code KDC is stored in the tonality register R·KDC (FIG. 10). When the result of judgment whether there is a tonality designation or not is YES, a judgment is made at step 532 whether the content of the tonality designation code KDC stored in the tonality register R·KDC has designated any a certain tonality or not. When the result of this judgment is NO, a duet tone key code output register 50 is cleared at step 533 and the program is returned to the step 531 of "R·KDC←KDC" and maintained at a waiting state until a tonality is designated. Where the result of judgment as to whether there is a tonality designation or not is YES, in the next step 534 a judgment is made as to whether the key is a major tonality or not, and the judgment is made whether the tonality is a major tonality or a minor tonality according to the major/minor descrimination code (see Table IX) of the key designation code KDC. In the case of the major tonality the processing of YES is executed, whereas in the case of the minor tonality the processing of NO is executed. In the case of YES, the program is advanced to step 535. At the time of processing "KDIF←R·KDC(KNC)−NC·C", the note code NC·C of the C tone is subtracted from the note code KNC (see Table IX) of the key note among the tonality designation codes KDC of the tonality register R·KDC, and the difference thus obtained is stored in the tonality difference register KDIF (FIG. 10) of the working memory device advanced to step 536 where "KDIF←R·KDC(KNC)−NC·A" is executed and the note code of A tone is subtracted from the note code KNC of the key note among the tonality designation code KDC in the tonality register R·KDC, and the difference thus obtained is stored in the tonality difference register KDIF. The tonality difference register KDIF stores the difference between the key note codes of the tonality of the note codes stored in the fundamental memory tables 521–523 of the data memory device 52, that is the fundamental tonality and of the designated tonality. As above described, in the major tonality portions of the fundamental memory tables 521, 523 the C major tonality is made fundamental, while in the minor tonality portions the A minor tonality is the fundamental. For this reason, in the case of the major tonality the key note code NC·C of the C major tonality subtracted from the tonality designation code KDC(KNC) whereas in the case of the minor tonality, the key note code NC·A of the A minor tonality is subtracted. Since in this embodiment the value of key note code NC·C is zero (see Table II) in the case of the major chord, the content of the tonality difference KDIF becomes the key note code KNC of the designated tonality. The content of the tonality difference register KDIF becomes important where the memory tables 525–527 of the diatonic chord (DC), the diatonic code constituting tone (DCN), and the diatonic tone (DN) are formed at a designated tonality in accordance with the contents of the fundamental tables 521–523.

The processing at step 537 for the major tonality portion selection and registering of the memory tables 521–524 is to register the fact that the major tonality portions of the fundamental tables 521–524 (see Tables X through XIII) are selected and utilized. The processing of the minor tonality portion selection and registering executed at step 538 means registration of the fact that the minor tonality portions of the fundamental tables 521–524 are selected and utilized. This registration makes possible subsequent read out of the minor tonality portions of the memory tables 521–524 in the case of the minor tonality.

After completing the storing of the tonality difference register KDIF and the selection and registration of the major tonality portions or minor tonality portions of the memory tables 521–524, a DC table 525 a DCN table 526 and a DN table 527 are formed.

The forming of the DC table 525 is performed at step 560 in the following manner. Thus, the memory contents of respective addresses 0, 1, 2 . . . of the diatonic chord (DC) fundamental table 521 (Table X) of the data memory device 52 are successively read out and the read out data are successively written into corresponding addresses of the diatonic chord (DC) table 525 of the same data memory device 52. At this time, the root note NC among the chord note fundamental codes read out from the memory table 521 is not directly stored in the memory table 525. Instead after adding the root note NC to the difference between the tonality note codes of the content of the tonality difference register KDIF, that is the fundamental tonality (C major tonality or A minor tonality) and of the designated tonality. The sum thus obtained is written into the table 525. This addition operation is made duodecimal. Of course, all addition and subtraction operations regarding the note codes are duodecimal. Like the fundamental table 521 shown in Table X, the addresses 0–9 (0–5 in the case of the minor tonality) of the diatonic chord table 525 thus formed correspond to the chord symbols I–VI7 (I–VI in the case of the minor tonality) and the content of the table 525 comprises chord note code, a chord constituting tone table address and a duet table x address. Where the result of the aforementioned addition operation is written as a root-note note code (NC) among the chord note code, in some cases, the content of the root-note NC often differs from that of the memory table 521, but the contents of other codes, i.e., a minor chord indication code m, a seventh chord indication code 7th, a chord constituting tone table address, and the duet table x address are the same as those of the memory table 521 (Table X). When the result of addition operation is written as the root-note note code NC, the chord notes of respective diatonic chords (I, II, II7, III, III7, IV, V, V7, VI and VI7) are stored in the memory table 521 for a designated tonality.

For example, where the C major tonality is selected as the designated tonality the content of the DC table 525 is just equal to the memory content of the major tonality portion of the memory table 521 shown in Table X. This is because, since the content of the tonality difference register KDIF is zero, the root-note note code NC of the memory table 521 is stored in the memory table 525 as it is. Where the designated tonality is the D major tonality as a result of the aforementioned processing "KDIF←R·KDC (KNC)−NC·C", "2 (decimal representation of NC·C)−0 (decimal representation of NC·C)=2" would be stored in the tonality difference register DIF, so that 2 is added to all root-note note code NC in respective addresses of the memory table 521. As a consequence, as the root-note note codes (NC) of the chord note codes of the memory table 525, NC·D, NC·E, NC·E, NC·F#, NC·F#, NC·G, NC·A, NC·A, NC·A, NC·B, NC·B are stored respectively. Where the designated tonality is the A minor tonality, as a result of the aforementioned processing "KDIF←R·KDC (KNC)−NC·A" at step 536, "9 (deciaml representation of KNC)−9 (decimal representation of NC·A)=0" is stored in the tonality difference register KDIF so that the content of the DC table 525 becomes just equal to the memory content of the minor tonality portion of the memory table 521.

The DCN table 526 is formed at step 561 in the following manner. Thus, the root-note note codes (NC) are read out, one after one, from respective addresses of the fundamental table 522 (Table XI) storing the diatonic chord constituting tones (DCN), and the content of the tonality difference register KDIF is added to respective note codes (NC) and the results of the additional operations are written in corresponding addresses of the diatonic chord constituting tone (DCN) table 526. As a consequence, note codes (NC) representing the constituting tones of respective diatonic chord of the designated tone are stored in the table 526. For example, where the C major tonality is designated, the content just same as that of the major tonality portion of the memory table 522 shown in Table XI is stored in the table 526. On the other hand, where the D major tonality is designated note codes, 2 chromatic notes (sharped notes) above respective note codes are stored in the table 526. In other words, a value obtained by shifting the memory content of the table 522 in accordance with the difference between the key notes of the fundamental tonality (C major tonality or the minor tonality) and of the designated tonality would be stored in table 526.

A DN table 527 is formed at step 562 in the following manner. Similar to the diatonic tone (DN) fundamental table 523 shown in Table XII, the DN table 7 has memory positions for the note codes and the duet table y addresses. Memory data are sequentially read out from addresses 0–6 of the DN fundamental table 523 and the duet table y addresses are transferred to and stored in the DN table 527 as they are. On the other hand, the DN fundamental note codes (Table XII) read out from the DN fundamental table 523 are respectively added to the content of the tonality difference register KDIF and the resulting sums are stored in corresponding addresses of the DN table 527. As a result of addition of the DN fundamental note code of the fundamental tonality to the content of the tonality difference register KDIF, note codes representing the note of the diatonic tone of the designated tonality are stored at respective degree representations I–VII, that is in corresponding addresses 0–6.

After forming the memory tables 525–527, an event detection is made at step 564 wherein a check is made as to whether an upper keyboard depressed key, that is a melody tone or an accompaniment chord produced by the lower keyboard has varied or not only when a variation of either one of the variation is detected a duet note key code DKC is formed at step 565, which is stored in the duet key code output register 50. Thus, when the melody tone or the accompaniment chord varies, the duet note key code DKC is formed which is stored in the output register 50. Accordingly, a duet note key code DKC corresponding to a melody tone or an accompaniment chord after variation is stored in the output register.

Figure 12:
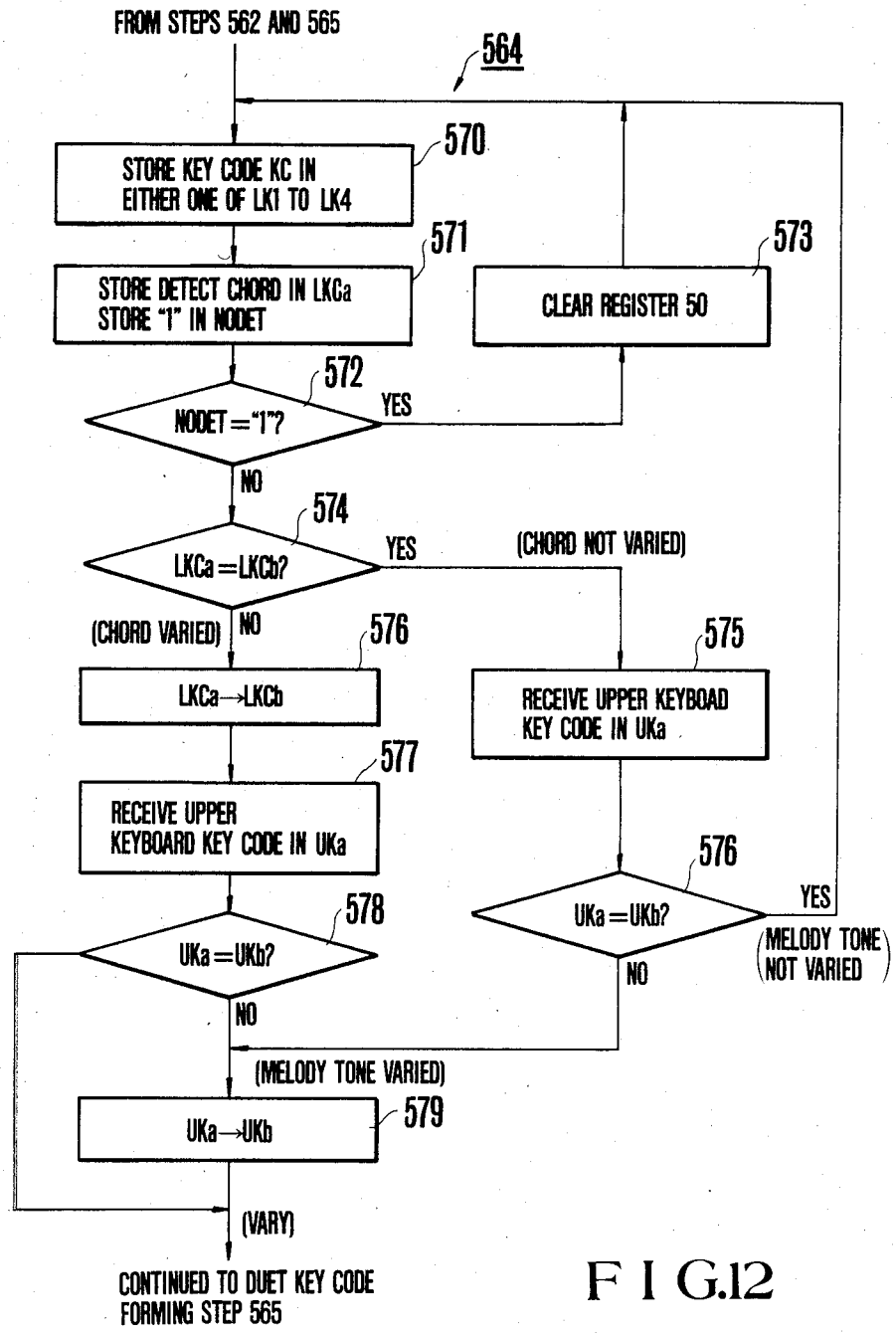
FIG. 12 is a flow chart showing the detail of an event detecting and processing of the circuit shown in FIG. 12.

FIG. 12 shows the details of the step 564 for event detection. At first, at step 570 a key code KC regarding the lower keyboard is received from the key code input buffer 51 and its note code NC is stored in either one the lower keyboard note code registers LK1, LK2, LK3 and LK4 of the working memory device 47. Thus the note codes of the key codes of simultaneously depressed keys on the lower keyboard (or key codes produced at the same time as the lower keyboard identification codes from the depressed key detecting and tone generation assignment circuit 11M are stored in all register LK1–LK4. Since the number of keys simultaneously depressed for forming a chord does not exceed 4, 4 registers LK1–LK4 are sufficient. The contents of the registers LK1–LK4 not supplied with note codes are cleared, so that the contents of the registers LK1–LK4 which have been stored the note codes of the released keys are cleared at once.

Then at step 571, a chord is detected based on a combination of note codes stored in the lower keyboard note code registers LK1–LK4. When a chord is detected, the chord name is stored in a chord register LKCa (FIG. 10). If a chord is not detected, "1" is set in a non chord detection flag register NODET (FIG. 10). The chord detected by supposing one of note codes in the register LK1–LK4 as a quasi root note, investigating whether the note codes of a major third or a minor third and a perfect fifth with reference to the quasi root note are stored in the registers Lk1–LK4 or not, and further investigating whether note codes of a seventh note code are stored in the registers Lk1–LK4 or not. This investigation is repeatedly carried out by sequentially varying the quasi root note one after another until the chord establishment is detected.

At the next step 572 a judgment is made as to whether the code NODET is "1" or not and the result of judgment YES means that a chord is not detected. Then at step 573 the duet note code output register 50 is cleared and the flag register NODET is reset to "0" and thereafter the program is returned to step 570. Thus, in this embodiment, in the absence of an accompaniment chord the register 50 is cleared to prevent producing of a duet tone.

When the result of judgment at step 572 is NO, at step 574 a judgment is made as to whether LKCa is equal to LKCb is storing a code representing a chord note which has been performed up to that time. At this step a judgment is made whether the chord note in the register LKCa now detected coincides with a chord note in the register LKCb which has been performed until that time or not. The result YES (coincidence) means that there is no change in the chord. Then, the program is advanced to step 575 where a judgment is made whether the depressed key on the upper keyboard has changed or not. At this step, the key code of the upper keyboard depressed key is received via the key code input buffer 51 to store it in an upper keyboard depressed key code register UKa of the working memory device 47. Then at step 576 a judgment is made whether the content of UKa is equal to that of UKb. The register UKb is storing an upper keyboard depressed key code, of a key which has been depressed. Consequently, so long as the upper keyboard depressed key (melody tone) does not vary the result of judgment at step 574 is YES whereas when the upper keyboard depressed key varies the result is NO. The result YES, means neither a chord or melody tone changes and the program is returned to step 570. Where the result of judgment at step 574 is NO, at step 576, a chord of a new chord note in register LKCa is stored the register LKCb. Then at step 577 the upper keyboard key code is stored in register UKa. At the next step 578 a judgment is made whether the upper keyboard depressed key, that is the melody tone has changed or not. The result YES (not changed) the event means that event detection has completed and that the program is transferred to step 565 at which the duet key code is formed shown in FIG. 12.

As a result of the processing "UKa UKb" executed at the time of changing of an upper keyboard depressed key, that is a melody tone, the content of the register UKa, that is the key code of a new melody tone after change is stored in the register UKb. Then at step 565, a duet key code is formed when either one or both of a melody tone and a chord change. At this time a code representing a new or present chord note is stored in the register LKCb, whereas a key code representing a new or present melody tone is stored in the register UKb.

Figure 13:
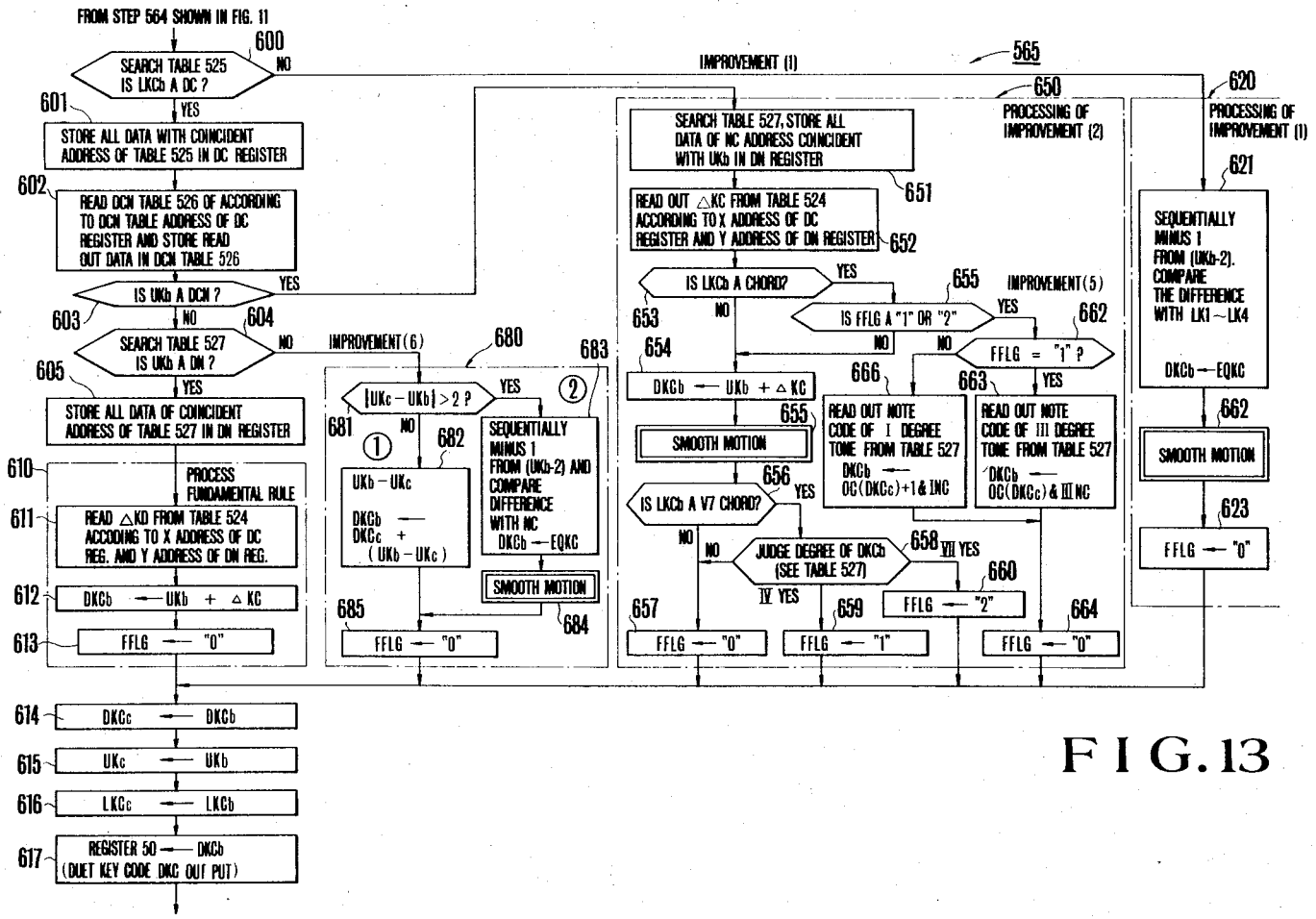
FIG. 13 is a flow chart showing the detail of the ensemble tone forming processing shown in FIG. 11.

The detail of the step 565 for forming a duet key code is shown in FIG. 13 in which at the first step 650 in which the diatonic chord (DC) table 525 read out according to the order of addresses and the chord name code (constituted by root note code NC, minor chord indication code m and the chord note code of the register LKCb) among the read out data is successively compared with the chord name code of the register LKCb so as to judge whether the chord notes coincide with each other or not. In other words, a judgment is made whether the accompaniment chord is a diatonic chord (DC) or not. Where the accompaniment chord is a diatonic chord of a designated tonality, as above described since the chord notes of all diatonic chords of the designated tonality are stored in the diatonic chord (DC) table 525, a chord name code stored in a certain address of the DC table 525 coincides with the chord name code of the register LKCb. Where the accompaniment chord is not a diatonic chord (that is NO), the above described improvement (1) is applied so that a processing regarding the improvement (1) is executed, whereas when the accompaniment chord is a diatonic chord (i.e., YES), the program is advanced to step 601 at which all data (chord name code, chord constituting tone table address, duet table x address) stored in the addresses of the DC table 525 adapted to store chord name codes coinciding with the chord name codes of the register LKCb are stored in the DC register (FIG. 10) of the working memory device 47. As an example, the stored contents of the DC register when the accompaniment chord is a C major chord at the time of a C major tonality are shown in the following Table XIV. To confirm the contents of this Table reference is made to table 521 shown in Table X.

TABLE XIV

| chord name code | | | chord constituting | |
|---|---|---|---|---|
| root note NC | m | 7th | tone (DCN) table address | duet table x address |
| NC.C | 0 | 0 | 0 | 0 |

At step 602, the addresses of the diatonic chord constituting tones (DCN) of the data memory device 52 are designated according to the chord constituting tone (DCN) table addresses stored in the DC register to read out all note codes of chord constituting tones stored in the designated addresses and the read out note codes of the diatonic chord constituting tones are stored in the DCN register (FIG. 10) of the working memory device 47. Consequently all note codes representing the chord constituting tones of the accompaniment chord (in this example, it is a diatonic chord) are stored in the DCN register. In the case illustrated in Table XIV, since "0" is stored in the DC register as the DCN table address, three note codes of NC·C, NC·E and NC·G are read out from address 0 (see Table XI) of the memory table 526 and these read out note codes are stored in the DCN register.

At the next step 603 a judgment is made as to whether UKb is DCN or not, that is whether the upper keyboard depressed key, i.e., the note code of a melody tone stored in the register UKb coincides with either one of the note codes of the diatonic chord constituting tone DCN stored in the DCN register or not. When the result of judgment is YES, the condition of the improvement (2) is satisfied so that the program is advanced to process the improvement (2). Because, the result of YES at step 600 confirms that the accompaniment chord is a diatonic chord and the result of YES at step 603 confirms that the melody tone is a chord constituting tone.

When the result of judgment executed at step 603 is NO, at step 604, the content of the memory table 527 is searched and a judgment is made whether UKb is DN or not. At this step, the diatonic tone (DN) table 527 is read out according to the order of addresses, and a judgment is made as to whether the note code of the read out diatonic tone coincides with the note code of a melody tone stored in the register UKb or not. When the melody tone is a nondiatonic tone, that is a chromatic tone, the result of this judgment is NO, which satisfies the condition of improvement (6) so that the program is advanced to process the improvement (6). On the other hand, when the melody tone is a diatonic tone (DN), the result of the judgment is YES and the program is advanced to step 605 in which all data stored in the addresses (coincidence addresses) of the memory table 527 adapted to store the same note codes as those of the melody tone stored in the register UKb (as shown in memory table 523 of Table XII, the DN note codes and the duet tone table y addresses) are stored in the DN register (FIG. 10) of the working memory device 47. As an example, the memory content of the DN register when the accompaniment chord is the C major chord and the upper keyboard depressed key tone (UKb) is the F4 tone at the time of the C major tonality is shown in the following Table XV.

TABLE XV

| note code | duet table y address |
|---|---|
| NC.F | 3 |

In the case of the C major tonality, the memory content of the DN memory table 527 is the same as that of the major tonality portion of the DC fundamental table 523 shown in Table XII. All memory contents of address 3 storing a note code NC·F coinciding with the note code of F stored in the register UKb are transferred to and stored in the DN register from the table 527 so that the content of the DN register becomes as shown in Table XV.

When the result of the judgment made at step 604 is YES, it means that the condition to which the fundamental rule is applicable is satisfied. More particularly, the result of YES at step 605 confirms that the accompaniment chord is a diatonic chord, the result of NO at step 603 confirms that the melody tone is a nondiatonic chord constituting tone (that means that the improvement (2) is not applicable), and the result of YES at step 604 confirms that the melody tone is a diatonic tone (DN) (that is it is not a chromatic scale tone). Thus, at this stage the condition of application of the fundamental rule is confirmed. Accordingly, after completing the processing of step 605, at step 610 bounded by dot and dash lines a duet key code is formed according to the fundamental rule.

In the processing of the fundamental rule, firstly at step 611, a duet interval data (ΔKC) is read out from the duet table 524 (see Table XIII) according to the duet table x address stored in the DC register at step 601, and the duet table y address stored in the DN register at step 602. Then at step 612 for processing "DKCb←UKb+ΔKC" the duet interval data ΔKC is added, to (or subtracted from) the upper keyboard depressed key code (the key code of the melody tone) in the register UKb to obtain a duet key code DKC which is stored in the duet key code register DKCb (FIG. 10) in the working memory device 47. Then at step 613, "0" is set in a finish flag register FFLG (FFLG "0"). Setting of "0" in the register FFLG means that a music is not yet finished.

Where the contents of the DC register and the DN register are as shown in Tables XIV and XV, at the step of processing the fundamental rule, an x address "0" and a y address "3" of the major tonality portion of the duet table 524 (Table XIII) are designated and "−3" is read out as the duet interval data ΔKC. In the example shown in Table XV, since the melody tone (UKb) is made to be F4, in the processing of "DKCb←UKb−ΔKC", a duodecimal subtration operation of "0110101" (F4 tone)−"0011" (3) is executed to obtain a solution of "0110010" which is stored in the register DKCb. As a consequence, the duet note key code DKC stored in the register DKCb represents a D4 tone (see Tables I and II). This duet tone D4 is a tone of 3 degrees below the melody tone F4, meaning that the fundamental rule is satisfied.

At the step 614 for executing "DKCc←DKCb" following the step 610, the duet note key code DKC stored in the register DKCb is also stored in the register DKCc. At the next step 615 of processing "UKc←UKb" the melody tone key code of the register UKb is stored in the register UKc. At the next step 616 of processing "LKCc←LKCb" the chord note code of the register LKCb is stored in the register LKCc. At the next step 617 for processing "register 50←DKCb" the duet key code DKC stored in the register DKCb is stored in the duet key code output register 50. The duet key code DKC stored in the register 50 is supplied to the duet tone generator 26 (FIG. 6) for producing a musical tone having a tone pitch corresponding to this key code DKC. After this processing, the program is returned to the step 564 for the event detection (FIGS. 11 and 12) to wait for the variation of the accompaniment chord or a melody tone. Consequently, a chord name code representing an already processed accompaniment chord (that is subsequently depressed melody tone or a preceding chord), a melody tone key code, and a duet note key code are stored in the registers LKCc, UKc and DKCc respectively.

The processings regarding respective improvements (1) through (6) will now be described.

When the result of judgment executed at step 601 is NO, that is when the accompaniment chord is not a diatonic chord, processing 620 regarding improvement (1) is executed. At first, step 621 of the processing 620 will be described. Firstly, a value 2 is subtracted from the key code of the present melody tone stored in the upper keyboard depressed key code register UKb (UKb−2). This is made for the purpose of satisfying the condition of improvement (1) that the duet tone is apart from the melody tone by more than major second value 2 corresponds to the major second interval, that is two semi-tones. Then 1 is sequentially subtracted from (UKb−2) and the result is compared with the note codes NC of the chord constituting tones stored in the lower keyboard note code registers LK1-LK4. When the note code portion of the result of the subtraction operations coincides with the note code stored in either one of the registers LK1-LK4, a key code EQKC regarding the result of the subtraction operations is stored in a duet note key code register DKCb (DKCb←EQKC).

One example of this processing is as follows:

Assume now that the C major tonality is designated, that the accompaniment chord is an E major chord, and that the melody tone is E4. The lower keyboard note code registers LK1, LK2 and LK3 are now storing note codes of E, G# and B which are the E major chord constituting tones. Since the E major chord is a nondiatonic chord of the C major tonality, the improvement (1) is applied. The value of (UKB−2) is "0110010" which is a key code representing the D4 tone. When 1 is substracted from this value a code "0110001" is obtained and its note code portion represents C#. Since this value does not coincides with the contents of registers LK1-LK4. "1" is again subtracted to obtain a code "0110000". However, since C is not contained in the registers Lk1-LK4, "1" is again subtracted. As a result of duodecimal subtraction a code "0101011" is obtained whose note code portion is B which coincides with the note code of B stored in the register LK3. Accordingly, at the time of processing "DKDb←EQKC" the result of subtraction operations "0101011" (EQKC) obtainable at the time of coincidence would be stored in the duet note key code register DKCb. Consequently, the duet note key code DKC represents B3. This satisfies the condition of improvement (1) that a tone (B3) lower than the melody tone E4, separated by more than a major second interval from and closest to E4 is selected as a duet tone among the chord constituting tones (E, G#, B).

In the processing 620 regarding the improvement (1), after the step 621, that is the duet key code has been stored in the register DKCb a subroutine (smooth motion) is executed. In this subroutine, the processings regarding the improvements (3) and (4) are executed. After completing the smooth motion, at step 623, "0" is set in the finish flag register FFLG (FFLG←"0") and the processings following "DKCc←DKCb" are executed in the same manner as above described.

Figure 14:
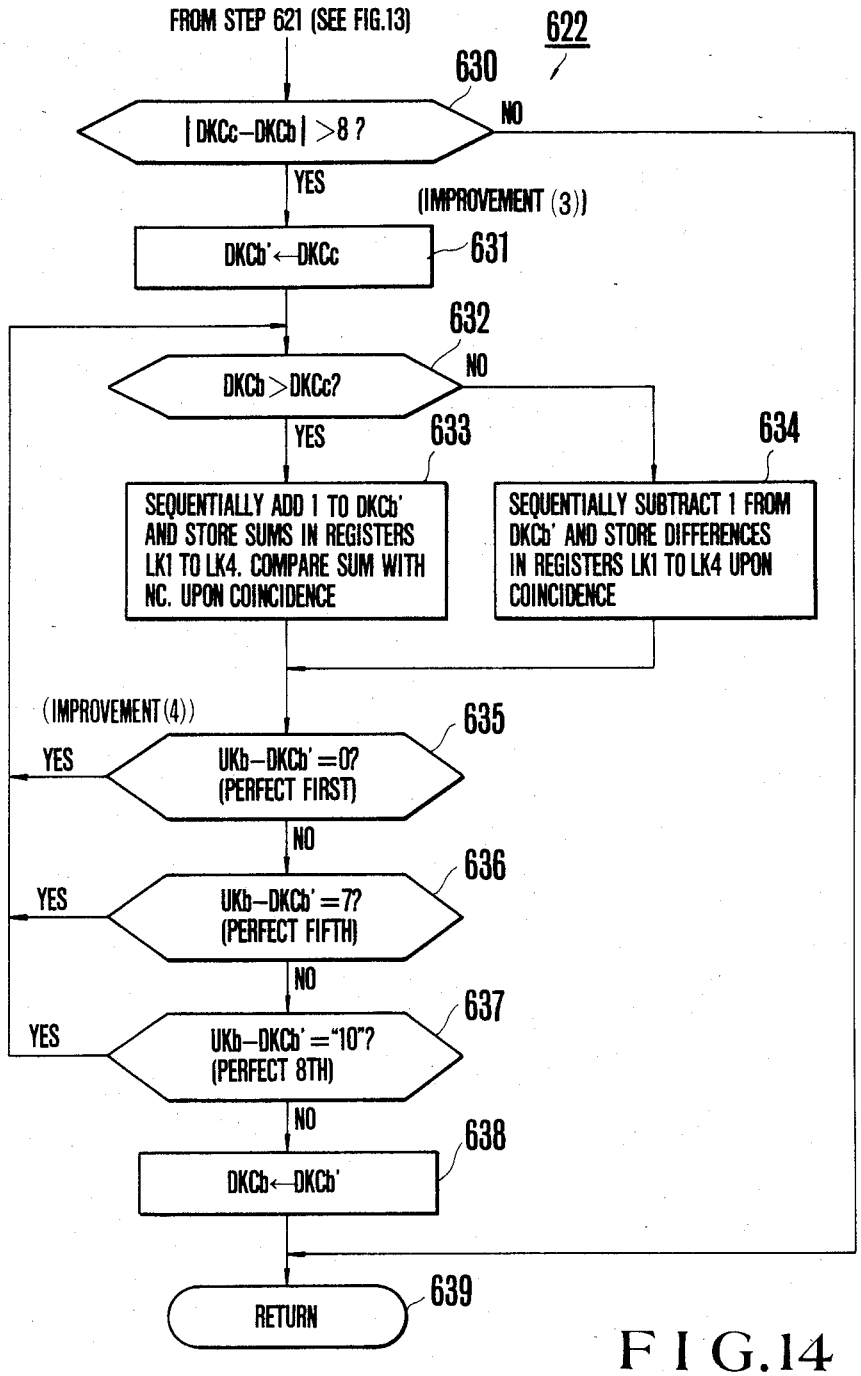
FIG. 14 is a flow chart showing one example of the subroutine-smooth progress shown in FIG. 14.

The flow chart of the subroutine (smooth motion) is shown in FIG. 14. At the first step a judgment is made as to whether the absolute value of a preceding duet key code DKC stored in the register DKCc and a present duet key code stored in the register DKCb (which is not yet stored in the register 50 and hence is not yet produced as a musical tone) is larger than "8" (|DKCc−DKCb|>8?).

This is made for the purpose of checking whether the condition to which the condition (3) is applicable is satisfied or not. More particularly, a value 8 corresponds to 8 semi-tones, and where the interval between the presently selected duet tone and a duet tone previously produced as a musical tone is larger than 8 semi-tones, the result of judgment at step 630 is YES. Then at step 631, the improvement (3) is applied. When the interval is less than 8 semi-tones, the result is NO and the improvements (3) and (4) are not applied. The program is advanced to "RETURN" step 639 back to the main program. Accordingly, where the improvements (3) and (4) are not applied the duet note key code DKC (which is stored in the register DKCb) determined at the step 623 is stored in the output register 50 without any modification. The value "8" is only one example and any other value may be used.

When the result of judgment executed at step 630 is YES, at step 631, a previous duet note key code stored in the register DKCc is stored in a register DKCb' (FIG. 10) (DKCb'←DKCc). Then at step 632, a judgment is made as to whether the presently selected duet tone (DKCb) is higher (YES) than the previous duet tone code (DKCc) or lower (No) (DKCb>DKCc?).

When the result is YES, at step 633, "1" is sequentially added to the content of the register DKCb', and each time "1" is added, the note code portion (NC) of the sum is compared with the note code NC of the chord constituting tones in the registers LK1–LK4. Upon coincidence, a sum (EQKC) resulting in the coincidence is stored in the register DKCb'. (DKCb'←EQKC) at first, the register DKCb' is storing the previous duet note key code. Accordingly, during the above described processing the key code of a tone closest to the previous duet tone among the chord constituting tones between a duet tone previously produced as a musical tone and the presently selected duet tone is stored in the register DKCb'.

When the result of judgment at step 632 is NO, the step is advanced to step 634 where opposite to the processing at step 633 "1" is sequentially subtracted from the content of the register DKCb' and each time "1" is subtracted the note code portion NC of the difference is compared with the note codes NC of the chord constituting tones in the registers LK1–LK4. The difference at which a coincidence is obtained is stored in the register DKCb'.

The reason that addition or subtraction is selected depending upon the heights of the duet tone previously produced as a musical tone and of a presently selected duet tone lies in that, regarding the improvement (3), it is necessary to select a chord constituting tones between the previous and present duet tones. Taking FIG. 8 as an example, the processing regarding the improvement (3) will be described as follows. The chord is the C major chord, the previous duet tone is G4, and the duet tone now firstly selected is E5 (FIG. 8A). The difference between the key code G4 and the key code of E5 is 9 so that the result of judgment at step 630 is YES and the result of judgment at step 632 is also YES. Accordingly, at step 631, as "1" is sequentially added to the previous duet note key code G4 (DKCb'). When the sum becomes a value representing the key code of C5, it coincides with the chord constituting tone C with the result that the key code of C5 would be stored in the duet note key code register DKCb' (FIG. 8B).

When the processing regarding the improvement (3) is completed, the processing regarding the improvement (4) is then executed. More particularly, a check is made as to whether the interval between the duet tone (its key code is stored in the reister DKCb') and the present melody tone (its key code is stored in the register UKb) is a perfect interval (unison, perfect 5th, or perfect 8th) or not. More particularly, when the result of judgment at step 635 is YES, it means a unison, whereas when the result of judgment executed at step 636 "UKb−DKCb'=7?" is YES, it means a perfect fifth (because it corresponds to 7 semi-tones). When the result of judgment at step 637 "UKb−DKCb'=10?" (this is a duodenary representation corresponding to decimal 12) is YES, it corresponds to the perfect 8th (because it corresponds to 12 semi-tones). When the results of these three judgments are all NO, it means a not perfect interval (hence it does not correspond to the improvement (4)).

Where the duet tone obtained by applying the improvement (3) and the present melody tone are not in a perfect interval relation, at step 638, a processing "DKCb←DKCb'" is executed to store the key code of the register DKCb' in the register DKCb. In other words, the duet note key code (which has been stored in the register DKCb determined by the improvement (1) or (2) or ② of (6), is erased, and instead the key code (a duet key code determined by the improvement (3)) in the register DKCb' is stored in the register DKCb. When the program is returned to the main program (FIG. 13) through the RETURN step 639, the duet note key code in the register DKCb is stored in the duet note key code output register 50, so that a key code determined by the improvement (3) would be outputted as the duet note key code DKC.

Where the result of judgment regarding a perfect interval executed in FIG. 14 is YES, the program is returned to step 633 or step 634 via the step 632 of DKCb>DKCc? at this time, in the register DKCb' is stored a duet note key code (in the example shown in FIG. 8B, the key code of C5) selected at the time of executing the processing regarding the inprovement (3). Accordingly, by the processing executed at step 633 or 634, 1 is sequentially added to (or subtracted from) the content of the register DKCb', and a check is made whether the sum or difference coincides with the note codes of the chord constituting tones stored in registers LK1–LK4 so as to newly select a chord constituting tone adjacent (one above or lower) the duet tone determined by applying the improvement (3) as a duet which is stored in the register DKCb'. As above described, three judgments are made again as to whether the duet tone selected by applying the improvement (4) is a perfect interval or not. When the result is YES, the same processing as above described is repeated, whereas when the results of three judgments are all NO, the program is advanced to the "RETURN" step 639 via step 638 for processing "DKCb←DKCb'".

Taking FIGS. 8B and 8C as an example, the processing regarding the improvement (4) will be described as follows. Thus, as a result of processing regarding the improvement (3), the key code of C5 is stored in the register DKCb' (FIG. 8B). At this time, since the melody tone is G5, the interval between C5 and G5 is a perfect fifth so that the result of judgment "UKb−DKCb'=7?" executed at step 636 is YES. As a consequence, the processing of the improvement (4) is applied and "1" is again sequentially added to the key code of C5 stored in the register DKCb' by the processing executed at step 633. When the resulting sum becomes a key code representing E5, the sum coincides with E, one of the chord constituting tones stored in the registers LK1–LK4, so that the key code E5 would be stored in the register DKCb' (FIG. 8C). Since E5 is not in a perfect interval relation with the melody tone G5, the results of judgment regarding the perfect interval relationship are all NO, so that the key code of E5 stored in the register DKCb' would be stored in the register DKCb.

In FIG. 13, the processing 650 regarding the improvement (3) is executed when the result of judgment executed at step 603 is YES, in other words, when the melody tone (upper keyboard depressed key) is a diatonic chord constituting tone (DCN). In the processing 650 regarding the improvement (2), as shown by step 651, at first the contents of the DN table 525 are sequentially read out, and a judgment is made as to whether the note code of the melody tone stored in the register UKb coincides with the note code of the diatonic tone DN of a certain degree, so as to store the contents (note code NC, and the duet tone table y address) of the DN table 527 stored in a coincided address is stored in the DN register in the working memory device 47. As example, the memory content of the DN register when the accompainment chord is the C major chord and the melody tone is E4 tone at the time of the C major tonality is shown in the following Table XVI.

TABLE XVI

| note code | duet table y address |
|---|---|
| NC.E | 2 |

In this example, the content of the DN table 527 is the same as that of the DN fundamental table 523 shown in Table XII, so that the note code NC·E stored in the address 2 of DN table 527 coincides with the note code of the E4 key code stored in the register UKb whereby all data stored in address 2 are transferred to and stored in the DN register.

Then at step 652, a duet interval data ΔKC is read out based on the duet tone table x address in the DC register stored at the time of processing executed at step 601, and the duet tone table y address stored in the DN register at the time of the processing executed at step 651. The duet interval data ΔKC read out at this time correspond, to any one of the data shown in parentheses in Table XIII. In other words, a duet interval data ΔKC is preset such that the result of the improvement (2) can be accomplished is read out. For example, as shown in Tables XIV and XVI, where data are stored in the DC register and the DN register "−4" is read out as the duet interval data ΔKC from the cross-point between the x address 0 and the y address 2 of the memory table 524 shown in Table XIII.

At the next step 653, a judgment is made as to whether the LKCb is storing an I chord or not. Thus, a judgment is made as to whether the x address stored in the DC register is an address 0 corresponding to the I chord (major third chord) or not. Since as a result of processing executed at step 601, data obtained by converting the chord note in the register LKCb into the kind of the chords (I, II . . . ), that is the duet table x address in table 525 is stored in the DC register, the kind of the chord can be judged from the x address data in this DC register. The step 653 is provided for judging the termination of the improvement (5).

When the result of judgement executed at step 653 is NO, at step 654 a calculating processing "DKCb←UKb+ΔKC" for obtaining the duet note key code DKC is made. On the other hand when the result of judgment executed at step 653 is YES, at step 655, a check is made as to whether the content of the finish flag register FFLG is 1 or 2. When the content is other than 1 or 2 (that is NO), the program is returned to step 654 to execute the calculating processing.

As has been described in connection with the fundamental rule processing 610, the duet interval data ΔKC read out from the duet tone table 524 is added to or subtracted from the melody tone key code stored in the register UKb and the resulting sum or difference is stored in the duet key code register DKCb. Consequently, the duet note key code DKC determined by applying the improvement (2) is stored in the register DKCb. Thereafter, at step 655 the subroutine regarding smooth motion is executed. This step is identical to the aforementioned step 622. Because the improvement (3) and (4) executed by the subroutine (smooth motion—FIG. 14) is aplicable not only to the improvement (1) but also to the improvement (2). After completion of the step 655 for the subroutine, at step 656 a judgment is made as to whether LKCb is a V7 chord or not. This is made for the purpose of judging the termination of the improvement (5).

At step 656, a judgment is made whether the address is 7 where the duet table address x address is V7 chord (minor 7th chord or address 4 in the case of a minor tonality). Because, as above described the x address representing the kind of the chord of the chord name stored in the register LKCb has already been stored in the DC register as a result of the processing executed at step 601. When the result of this judgment is NO, it does not correspond to the Kadenz theory in which the tone is varied from the chord V7 to the chord I. Then the program is advanced to step 657 to set "0" in the finish flag register FFLG. Thereafter at step 614, a processing of "DKCc←DKCb" is executed to store the duet note key code DKC of the register DKCb in the output register 50 at step 617. As above described a duet tone according to the improvement (2) is generated.

The improvement (5) will now be described. This improvement (5) is processed by the processing of improvement (2) executed at step 650. More particularly, when the result of judgment executed at step 656 is YES, there is a possibility of applying the Kadenz theory in which the movement of the tones procedes from chord V7 to chord I and then finishes. Then at the next step 658, the degree of DKCb is determined, in other words, a judgement is made whether the newly formed duet tone (stored in the register DKCb) according to the chord V7 is a IV degree tone or a VII degree tone.

At step 658, a detection is made as to whether the note code NC equal to the note code portion of the duet key code stored in the register DKCb is stored in which one of the addresses of the memory table 527 by comparing the diatonic tone (DN) table 527 with the content of the duet key code register DKCb. As shown in Table XII, in memory table 523 (also the table 527) address 3 corresponds to the IV degree tone, while address 6 to the VII degree tone. Accordingly, where the note code of the duet note key code stored in the register DKCb coincides with the note code NC stored at the address 3 of the memory table 527, this duet note key code means (IV YES) the IV degree tone and the program is advanced to step 659 where "1" is set in the termination flag register EFLG. A case wherein the duet note code stored in the register DKCb coincides with the note code NC stored at address 6 of the memory table 527 means that the duet tone is the VII degree tone (VII YES). Then at step 660 a processing of "FFLG←2" is executed. Where the duet tone stored in the register DKCb does not correspond (No) to IV degrees or VII degrees, at step 657, "0" is set in the finish flag register FFLG.

Symbolic representations "FFLG←1", "FFLG←2" and "FFLG−0" respectively mean that "1", "2" and "0" are set in the finish flag register. Consequently, the FFLG is "1" means that one of the conditins of Kadenz theory is satisfied that the melody (duet tone) is IV degree tone at the time of chord V7. Further, "FFLG is 2" means that another one of the conditions of the Kadenz theory is satisfied that the melody tone (duet tone) is a VII degree tone at the time of the chord V7. Immediately after "1" or "2" has been set in the finish flag register FFLG, the accompainment chord changes from V7 chord to I chord. Only when the note of the melody tone (upper keyboard depressed key tone) at that time is a constituting tone of I chord, a duet tone key code for finish is formed according to the improvement (5).

More particularly, where the accompaniment chord is the I chord and the melody tone is a constituting tone of the I chord, as above described, the processing 650 regarding the improvement (2) is executed as a result of the processing 650 executed at step 653, a judgment is made whether LKCb is the I chord (YES). The result of judgment executed at step 655 as to whether FFLG is "1" or "2" is also YES so that the program does not advance to step 654 where a calculation processing "DKCb←UKb+ΔKC" regarding the improvement (2) is executed, but advances to step 662 where a judgment is made whether FFLG is "1" or not regarding the improvement (5).

When "1" is set in the finish flag register FFLG, the result of judgment executed at step 662 as to whether FFLG is "1" or not is YES showing that the duet tone produced immediately before was the IV degree tone. In this case, the duet note key code is made to be the III degree tone for the purpose of finishing the music with the III degree tone according to the Kadenz theory as a result of the processing executed at step 663. More particularly, at step 663, the note code NC (III NC) of the III degree tone is read out from address 2 (see Table XII) of the diatonic tone (DN) table 7, and the read out note code (III NC) is combined with the octave portion OC of the previous duet note key code stored in the register DKCc to form a new duet note key code [OC (DKCc) and III NC]. Then, the new duet note key code is stored in the duet note key code register DKCb. In the diatonic tone (DN) table 527 are stored note codes NC representing the notes of respective diatonic tones at a designated tonality according to the processing of forming the DN table 7 shown in FIG. 12. Then, when the note code NC is read out from address 2 of table 527 corresponding to the III degree tone it is possible to obtain the note code NC of the III degree tone at the designated tonality. The register DKCc is storing the key code of a duet tone (in this case, the IV degree tone) which was produced previously. Consequently, by combining the III degree note code III NC with the octave code portion OC of the previously formed duet key code, a III degree duet note key code is formed. After the step 663, at step 664, "0" is set in the finish flag register FFLG and at step 617 the duet note key code DKC stored in the register DKCb is stored in the output register 50 after executing the step 614 of "DKCc←DKCb".

One example of a case wherein the music is terminated at the III degree tone will now be described. Where the C major tonality is designated, when a F4 tone (that is IV degree tone) is generated as a duet tone at the time of the G major seventh chord (V7 chord), "1" is set in the finish flag register FFLG and a key code of F4 is stored in the duet note key code register DKCc. Immediately thereafter, as the accompaniment chord changes to the C major chord (that is I chord) as a result of the processing executed at step 663, the note code NC.E of E which is the III degree note is read out from the DN table 527. The octave code of the previous duet note F4 is added to the read out note code NC E and the E4 key code is stored in the duet note key code register DKCb. In this manner, after the F4 note has been produced as a musical tone together with the G major seventh chord, the C major chord and the E4 note are formed as a duet tone thus giving a finish feeling.

Where the finish flag register FFLG is set with "2", the result of judgment at step 662 is NO showing the duet note produced immediately before is a VII degree note. Then processing at step 666 is executed to make the duet note to be a I degree note. More particularly, at step 666, the note code NC (INC) of the I degree note is read out from the address 0 (see Table XII) of the diatonic note (DN) table 527, and the read out note code (INC) is combined with a code obtained by adding 1 to the octave code IC of the previous duet note key code (which is a VII degree note stored in the register DKC, thus increasing one octave, to form a new duet note key code which is stored in the duet note key code register "DKCb (DKCb←OC(DKCc)+I and INC". Thereafter, at step 664, "0" is set in the finish flag register FFLG, and at step 614 a processing "DKCc−DKCb" is executed. Then, at step 617 the duet note key code DKC stored in the register DKCb is stored in the output register 50 and outputted. One example of this will be discussed with reference to the C major tonality. When a B4 note (corresponding to the VII degree note) is produced as a duet tone at the time of the G major seventh chord (V7 chord), "2" is set in the finish flag register FFLG, and the key code of B4 is stored in the register DKCc. Immediately thereafter, as the accompaniment chord changes to the C major chord (I chord), at step 666, the note code NC·C of I degree is read out from the DN table 527, and the read out note code NC·C is added with an octave code one octave higher than that of the previous duet note B4, whereby the key code of C5 is stored in the duet note key code register DKCb. In this manner after the G major seventh chord and the B4 tone have been produced as musical tones, the C5 duet tone can be produced as a musical tone together with the C major chord, thus giving a finish feeling.

Now, the improvement (6) will be described.

Referring again to FIG. 13, when the result of judgment executed at step 604 is NO a processing 680 regarding the improvement (6) is executed. At step 681, a judgment is made as to whether the absolute value of the difference between the key code of the previous melody tone (upper keyboard depressed key tone) stored in the register UKc and the key code of the present melody tone stored in the register UKb is larger than 2 (two semi-tones). The result NO of this judgment means that the melody motion is less than major 2 degrees, so that the ① of the improvement (6) is applied. The result YES means that the melody motion is greater than the major 2nd interval, so that the ② of the improvement (6) is applied.

The processing executed at step 682 concerns ① of the improvement (6). More particularly, the content of the register UKc is subtracted from that of the register UKb to determine the interval (the number of the semi-tones) between the previous and present melody tones. The interval thus determined is added to the previous duet note key code stored in the register DKCc and the sum is stored in the duet note key code register DKCb "DKCb−DKCc+(UKb−UKc)". As a result of this processing, the interval between the present duet note key code stored in the register DKCb and the previous duet note key code stored in the register DKCc would become the same as the melodic interval of the melody tone. In the case shown in FIG. 9A, ① of the improvement (6) is applied when the melody tone changes from F4 to F♯4. The difference (UKb−UKc) between the key codes of F4 and F♯4 is "1" so that when this "1" is added to the key code of the previous duet tone D4 corresponding to F4 the key code of D♯4 is obtained. In this manner the key code of D♯4 is stored in the duet note key code register DKCb.

The processing executed at step 683 concerns ② of the improvement (6) and the content thereof is similar to that of the processing executed at step 621 except that the note codes NC stored in the lower keyboard note code registers LK1-LK4 constitute a diatonic chord. As a result of the processing executed at step 683, a key code having the same note as a chord constituting tone which is lower than the melody tone (the key code stored in the register UKb), separated therefrom by more than major 2nd interval, and closet to the melody tone would be stored in the duet note key code register DKC. Thereafter, at step 684 (see FIG. 14) a subroutine (smooth motion) is executed in the same manner as in steps 622 and 655.

As a result of the processing executed at step 682 or 683, a duet note key code determined ① or ② of the improvement (6) is stored in the duet note key code register DKCb. Then the program is advanced to step 685 to set "0" in the finish flag register FFLG to commence the processing of "DKCc←DKCb". Finally, the duet note key code DKC in the register DKCb would be stored in the output register 50, at step 617.

Although an embodiment utilizing the fundamental rule and improvements (1)-(6) has been described, it is not sufficient from the musical theory. Accordingly, in the following, another embodiment will be described which is applied with the following improvements (7), (8) and (9) in addition to the fundamental rule and improvements (1)-(6).

Improvement (7)

According to this improvement, a modulation is automatically judged to form a duet tone in accordance with a tonality after the modulation. In an embodiment to be described later a modulation from a major tonality to a minor tonality of the same tonality symbol or vice versa is judged automatically. Upon judgement of a modulation a duet is determined according to a diatonic chord (DC) and a diatonic tone (DN) at the tonality after modulation, instead of a presently designated tonality. For example, where the A minor tonality is designated it is judged that the tonality has been modulated to the C major tonality upon detection of the C major chord or G major chord or G major seventh chord which is the non-dianic chord of the A minor tonality, and a duet tone 3 degrees below is selected among the diatonic tones of the C major tonality for applying the fundamental rule. On the contrary, when the A minor chord is detected where the C major tonality is designated a duet tone 3 degrees below is selected among the diatonic tones of the A minor tonality on the assumption that the tonality has been modulated to A minor tonality.

Improvement (8)

According to this improvement such nonchord notes (nonchord constituting tones) as a passing note, an embroidery note, appogiatura note and suspension note which are closely related to the chord note are treated similarly as the chord constituting tones. More particularly, melody tones corresponding to the passing note, embroidery note, appogiatura note and suspension note are deemed as chord constituting tones and processed according to the improvement (2). The passing note means a nonchord tone which interconnects two chords according to a scale. The embroidery note means a nonchord tones of an adjacent note degree interposed between two chords having the same level, whereas the appogiatura note means a first nonchord tone where the first chord tone of the embroidery note is omitted with the result that the motion is started from a nonchord tone of the adjacent note degree and continued to a chord of an adjacent note degree. The suspension tone means extension of the appogiatura note connected to a previous chord.

The embroidery note etc. described above are located adjacent chord constituting tones. Nondiatoic tones (chromatic scale tones) appear in most cases in nonchords closely related to the embroidery note etc., described above except the modulation. In the following embodiment, for applying the improvement (8), tones one semi-tone higher or lower than the chord constituting tones are deemed as the embroidery note or the like, that is chord constituting tones so as to execute a processing similar to that of the improvement (2).

Improvement (9)

According to this improvement, not only the harmonic minor scale but also a natural minor scale and a melodic scale are treated as a minor scale. Taking the A minor tonality as an example, a harmonic minor scale comprises A, B, C, D, E, F and G♯, a natural minor scale comprises A, B, C, D, E, F and G, and a melodic minor scale comprieses A, B, C, D, E, F# and G#.

Thus, those having the VIIth degree as a major 7 degree (G#) are the harmonic minor scales, those having the VIIth degree as the 7 degrees (G) are the natural minor scales, and those having the VIth and VIIth degrees as the major 6 and 7 degrees (F# and G#) are the melodic minor scales. In the embodiment to be described later, for the purpose of treating all three minor scales, 4 notes including the key note, minor 6 degree note, major 6 degree note, minor 7 degree note and major 7 degree note are deemed as the diatonic tones (DN) of VIth degrees or VIIth degrees, and then the fundamental rule is applied.

Figures 15, 19:
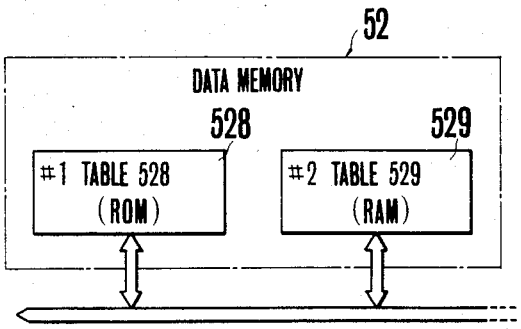
FIG. 15 is a block diagram showing a modified example of the data memory device in the ensemble tone key code forming circuit shown in FIG. 6.
FIG. 19 shows the construction of the memory #2 in the data memory device shown in FIG. 15, which is useful to explain the correspondence of the performances of the memory table #2 with the memory table in the data memory device shown in FIG. 6.

An electronic musical instrument to which all of the fundamental rule and the improvements (1) through (9) are applicable can be constructed by modifying the data memory device 52 shown in FIG. 6 to such as shown in FIG. 15, and by modifying the memory program of the program memory device 48 to that described later.

In the data memory device 52 shown in FIG. 15, the #1 memory table 528 comprising a ROM is used to prestore such fundamental data as the chord name, chord constituting tones, scale tones, duet interval data, etc. regarding the major and minor tonalities, and to prestore data regarding the C major tonality in the case of the major tonality and the data regarding the A minor tonality in the case of the minor tonality as the fundamental data. The #2 memory table 529 comprising a RAM is used to store the chord names, chord constituting tones, scale tones, duet interval data, etc. at a designated tonality so as to form data to be stored in the #2 trable 529 by utilizing the fundamental data prestored in the #1 table 528.

The fundamental data to be stored in the #1 table 528 are determined as follows by considering the fundamental rule, the improvements (2) and (7)–(9). In this case the notes of the duet tones determined by the relationship between the type of the chords and the melody tones are shown in the following Table XVII for the C major tonality, whereas are shown in the following Table XVIII for the A minor tonality. In these Tables, C, Dm etc. shown in the column of the chord represents the chord notes as D minor etc., and the notes representations in parentheses represent the chord constitutig tones. Symbols I, II . . . are chord symbols of the diatonic chords (DC) 12 notes of C–B shown in the column of the melody tone represents the notes to be performed as melody tones. Small circles on these notes represent diatonic scale notes (DN). In Table XVIII, G# is shown as a diatonic scale notes which utilizes the harmonic minor scale as the fundamental.

TABLE XVII

| | Melody Tone | | | | | | | | | | | |
|---|---|---|---|---|---|---|---|---|---|---|---|---|
| | | (O → DN) | | | | | | | | | | |
| Chord | $\mathring{C}$ | C# | $\mathring{D}$ | D# | $\mathring{E}$ | $\mathring{F}$ | F# | $\mathring{G}$ | G# | $\mathring{A}$ | A# | $\mathring{B}$ |
| (I) C (CEG) | (G) | G1 | B | C1 | (C) | D | C1 | (E) | E1 | F | X | G |
| (II) Dm (DFA) | A | A1 | A | A1 | C | (D) | D1 | E | F1 | (F) | F1 | G |
| (II7) Dm7 (DFAC) | (A) | A1 | (A) | C2 | C | (D) | D1 | E | F1 | (F) | F1 | G |
| (III) Em (EGB) | A | X | B | B1 | (B) | D | B1 | (E) | E1 | F | G1 | (G) |
| (III7) Em7 (EGBD) | A | G1 | (B) | B1 | (B) | D | D2 | (E) | E1 | F | G1 | (G) |
| (IV) F (FAC) | (A) | A1 | B | X | C | (C) | C1 | E | F1 | (F) | F1 | G |
| (V) G (GBD) | A | G1 | (B) | B1 | C | D | D1 | (D) | D1 | F | G1 | (G) |
| (V7) G7 (GBDF) | A | G1 | (B) | B1 | C | (D) | D1 | (D) | F2 | F | G1 | (G) |
| (M)* Am (ACE) | (A) | A1 | B | C1 | (C) | D | X | E4 | E | (E) | E1 | G# |
| (M)* Am7 (ACEG) | (A) | A1 | B | C1 | (C) | D | C1 | (E4) | E | (E) | G2 | G# |

*M: Modulation

TABLE XVIII

| | Melody Tone | | | | | | | | | | | |
|---|---|---|---|---|---|---|---|---|---|---|---|---|
| | | (O → DN) | | | | | | | | | | |
| Chord | A | A# | $\mathring{B}$ | $\mathring{C}$ | C# | $\mathring{D}$ | D# | $\mathring{E}$ | $\mathring{F}$ | F# | G | $\mathring{G}$# |
| (I) Am (ACE) | (E) | E1 | G# | (A) | A1 | B | C1 | (C) | D | D5 | E4 | E |
| (T)* C (CEG) | F | X | G | (G) | G1 | B | C1 | (C) | D | C1 | (E) | E1 |
| (IV) Dm (DFA) | (F) | F1 | G# | A | A1 | (A) | A1 | C | (D) | D1 | E4 | F1 |
| (IV7) Dm7 (DFAC) | (F) | F1 | G# | (A) | A1 | (A) | C2 | C | (D) | E1 | E4 | F1 |
| (V) E (EG#B) | E1 | E1 | (G#) | A | X | B | B1 | (B) | D | D5 | E1 | E |
| (V7) E7 (EG#BD) | E1 | E1 | (G#) | A | G#1 | (B) | B1 | (B) | D | D5 | E1 | E |
| (VI) F (FAC) | (F) | F1 | G# | (A) | A1 | B | X | C | (C) | C1 | E4 | F1 |
| (M)* G (GBD) | F | G1 | (G) | A | G1 | (B) | B1 | C | D | D1 | (D) | D1 |
| (M)* G7 (GEDF) | F | G1 | (G) | A | G1 | (B) | B1 | C | (D) | D1 | (D) | F2 |

*M" Modulation

In Tables XVII and XVIII, the notes at the cross-points between the row of the chord name and the column of the melody tone show duet tones. Numerals, underlines, and parentheses attached to the note representations of the duet tones have the following meaning.

An underline shows that the belonging octave of a specific duet tone is lower than that of a melody tone. It is to be noted that it does not means a low value of the octave code OC but means that the octave is lower than an octave utilizing the key note as the lowerst tone. For example, in Table XVII, B is shown as the duet tone for the melody tone D at C major chord and this means a B tone lower than the D tone therefore than the key note C i.e., a B tone having an octave code of one octave lower than that of D. In Table XVIII, G# is shown as a duet tone for the A minor chord and melody tone, and the duet tone is shown as G# lower than the key note A of the minor tonality, the content of the octave code OC is the same for B and G#.

Parentheses means a duet tone selected according to the improvement (2). For example, in the C major chord column of Table XVII, the chord constituting tones are C, E and G, and the duet tones G, C and E of the melody tones C, E and G corresponding to these three chord constituting tones are shown with parentheses. Since according to the improvement (2), a melody constituting tone lower than the melody tone, spaced therefrom by more than major 2nd intervals and closest to the melody tone is selected as a duet tone, the duet tones (G), (C) and (E) corresponding to the melody tones C, E and G satisfied the condition of the improvement (2).

Characters not applied with parentheses or a numeral on the right side show duet tones determined according to the fundamental rule according to which the tones are made to be tones (diatonic tones) of 3 degrees below the melody tone when the accompainment chord is a diatonic chord (DC) and the melody tone is a diatonic tone (DN). For example, in the column of the C major chord of Table XVII, as shown B, D, F and G as duet tones corresponding to melody tones D,F,A,B which are diatonic tones. All these duet tones are diatonic tones (DN) of 3 degrees below the melody tone and satisfy the condition of the fundamental rule.

Numerals 1, 2, 4 and 5 attached to the right side of the duet note have meanings as follows.

Numeral 1 means that the duet tone is determined according to the improvement (8). More particularly, where a melody tone (a nondiatonic tone) is higher or lower by a semi-tone than a chord constituting tone it is deemed as a passing note, a embroidery note, etc., closely related to the chord, and a duet tone corresponding theseto is selected among the chord constituting tones like the improvement (2). For example, in the C major chord row of Table XVII, melody tones C#, D#, F# and G# which are the nondiatonic tones are shown adjacent the chord constituting tones C, E and G and the duet tones corresponding thereto are expressed as G1, C1, C1 and E1. Thus, the duet tones G, C, C, E are chord constituting tones closest to and lower than the melody tones C#, D#, F# and G# respectively and not within major 2nd interval.

Similar to numeral 1, the numeral 2 applied to the right side shows a duet tone determined according to the improvement (8), but as it is the seventh chord the number of the chord constituting tones is 4 so that it shows a duet tone of a note different from the nonseventh chord. For example, the duet tone corresponding to the melody tone D# at the time of the D minor chord (Dm) shown in Table XVII is a A tone (expressed by A1), but a duet tone corresponding to the same melody tone D# for the D minor seventh chord (Dm7) is shown as a C tone (expressed by C2).

There is no C for the chord constituting tone at the time of the chord Dm but in the case of the chord Dm7, C is included in the chord constituting tone. For this reason, the chord constituting tone lower than the melody tone D#, spaced by more than major 2nd interval and closest to the melody tone D# is A for the Dm chord but C for the Dm7 chord.

The numeral 4 attached to the upper side relates to the improvement (9) and represents a duet tone corresponding to the VIIth degree tone at a natural minor scale. The VIIth degree tone of the natural minor scale at the A minor tonality is the G tone so that the fundamental rule is applied by considering the melody tone G as the diatonic tone (DU) of the A major tonality and the E tone which is a diatonic tone 3 degrees thereunder is taken as a duet tone expressed by E4. As above described, since in Table XVIII the harmonic minor scale is used as the fundamental, E tone of 3 degrees below is selected as a duet tone corresponding to G# which is the VIIth degree tone of the harmonic minor scale.

The numeral 5 also relates to the improvement (9) and represents a duet tone corresponding to the VIth degree tone is melodic minor scale. Since the VIth degree tone of the melodic minor scale for the A minor tonality is F#, the fundamental rule is applied by taking the melody tone F# as the diatonic tone of the A minor tonality and a D tone which is a diatonic tone of 3 degrees thereunder is taken as a duet tone expressed by D5.

The chords (with M) shown in the column of the chords in Tables XVII and XVIII, represent chords that can be considered as modulation. Thus, when a A minor chord (Am) or a A minor seventh chord (Am7) is detected at the time of the C major tonality it is taken as the modulation to the A minor tonality so that in the rows of Am chord and Am7 chord of Table XVII are shown is the duet tones at the time of the A minor tonality. In other words, the melody tone G# is deemed as a diatonic tone (of harmonic minor scale) and E which is a diatonic tone of 3 degrees below is selected as a duet tone. Also the melody tone G is taken as a diatonic chord (of natural minor scale) and E tone of 3 degrees thereunder is selected as a duet tone. Further, a diatonic tone (of harmonic minor scale) of 3 degrees below a melody tone B is selected as a duet tone corresponding to the melody tone B.

Where a C major chord, a G major chord or a G seventh chord (G7) is detected at the time of the A minor tonality it is considered as a modulation to the C major tonality so that even when the designated tonality is the A minor tonality, chords C, G, G7 are processed in the same manner as the diatonic chords. For this reason, in Table XVIII, the C chord, G chord and G7 chord are shown and in their rows are shown the duet tones for the C major tonality. More particularly, the melody tone G lacks diatonic chord constituting tones at the A minor tonality, but G is treated as a diatonic constituting tone because of a modulation. Accordingly, the representations of the duet tones corresponding to the melody tone G shown in the row of the C chord, G chord and G7 chord in Table XVIII are (E), (D) and (D) respectively showing application of the improvement (2). The diatonic tones selected as the duet tones in the rows of C chord, G chord and G7 chord in Table XVIII are not the diatonic tone G# of the A minor tonality but the diatonic tone G of the C major tonality.

Symbol X in Tables XVII and XVIII means that the fundamental rule and the improvements (2) and (8) are not applied that is a melody tone corresponding to symbol X is not taken as a diatonic tone or a diatonic chord constituting tone. Accordingly, a duet tone with symbol X is determined according to the improvement (6). In other words, although the accompainment chord is a diatonic chord according to a modulation judgment, since the melody tone is a diatonic tone, the improvement (6) is applied.

To obtain the duet tones shown in Tables XVII and XVIII, a duet interval data ΔKC showing the interval (the number of semi-tones) between a duet tone to be formed and a melody tone showed be set as shown in the following Tables IXX and XX. The meaning of the value of the duet interval data KC shown in Table IXX can be readily understood by referring to Table XVII. Table XX can also be readily understood by referring to Table XVIII. For example, Table XVII shows that for the C major chord and melody tone C, note G of one octave below is selected as a duet tone. The interval between C and lower G is 5 in terms of chromatic tones. Consequently, −5 is shown as the duet interval data ΔKC at the same portion of Table IXX. Although (−) signs are omitted from Tables IXX and XX, it should be understood that all duet interval data except those applied with symbols X have (−) signs, because the duet tones are lower than the melody tones.

TABLE XIX

| | Melody Tone | | | | | | | | | | | |
|---|---|---|---|---|---|---|---|---|---|---|---|---|
| Chord | C | C# | D | D# | E | F | F# | G | G# | A | A# | B |
| C (CEG) | 5 | 6 | 3 | 3 | 4 | 3 | 6 | 3 | 4 | 4 | X | 4 |
| Dm (DFA) | 3 | 4 | 5 | 6 | 4 | 3 | 4 | 3 | 3 | 4 | 5 | 4 |
| Dm7 (DFAC) | 3 | 4 | 5 | 6 | 4 | 3 | 4 | 3 | 3 | 4 | 5 | 4 |
| Em (EGB) | 3 | X | 3 | 4 | 5 | 3 | 7 | 3 | 4 | 4 | 3 | 4 |
| Em7 (EGBD) | 3 | 6 | 3 | 4 | 5 | 3 | 4 | 3 | 4 | 4 | 3 | 4 |
| F (FAC) | 3 | 4 | 3 | X | 4 | 5 | 6 | 3 | 3 | 4 | 5 | 4 |
| G (GBD) | 3 | 6 | 3 | 4 | 4 | 3 | 4 | 5 | 6 | 4 | 3 | 4 |
| G7 (GBDF) | 3 | 6 | 3 | 4 | 4 | 3 | 4 | 5 | 3 | 4 | 3 | 4 |
| Am (ACE) | 3 | 4 | 3 | 3 | 4 | 3 | X | 3 | 4 | 5 | 6 | 3 |
| Am7 (ACEG) | 3 | 4 | 3 | 3 | 4 | 3 | 6 | 3 | 4 | 5 | 3 | 3 |

TABLE XX

| | Melody Tone | | | | | | | | | | | |
|---|---|---|---|---|---|---|---|---|---|---|---|---|
| Chord | A | A# | B | C | C# | D | D# | E | F | F# | G | G# |
| Am (ACE) | 5 | 6 | 3 | 3 | 4 | 3 | 3 | 4 | 3 | 4 | 3 | 4 |
| C (CEG) | 4 | X | 4 | 5 | 6 | 3 | 3 | 4 | 3 | 6 | 3 | 4 |
| Dm (DFA) | 4 | 5 | 3 | 3 | 4 | 5 | 6 | 4 | 3 | 4 | 3 | 3 |
| Dm7 (DFAC) | 4 | 5 | 3 | 3 | 4 | 5 | 3 | 4 | 3 | 4 | 3 | 3 |
| E (EG#B) | 5 | 6 | 3 | 3 | X | 3 | 4 | 5 | 3 | 4 | 3 | 4 |
| E7 (EG#BD) | 5 | 6 | 3 | 3 | 5 | 3 | 4 | 5 | 3 | 4 | 3 | 4 |
| F (FAC) | 4 | 5 | 3 | 3 | 4 | 3 | X | 4 | 5 | 6 | 3 | 3 |
| G (GBD) | 4 | 3 | 4 | 3 | 6 | 3 | 4 | 4 | 3 | 4 | 5 | 6 |
| G7 (GBDF) | 4 | 3 | 4 | 3 | 6 | 3 | 4 | 4 | 3 | 4 | 5 | 3 |

C through B in the melody tone column in Table IXX corresponds to a scale tone (including a semi-tone) utilizing C as the key note and the chords C through Am7 in the chord row correspond to chords I through VI7. Even when the tonality is changed with the result that the scale (key note) of the melody tone varies and the chord name also varies, the interval relationship among chord constituting tones or the interval relationship among the scale tone does not vary so that the duet interval data ΔKC shown in Table IXX is applicable to all major tonalities. In the same manner, the duet interval ΔKC shown in Table XX is applicable to all minor tonalities.

The duet interval ΔKC shown in Tables IXX and XX are prestored in the #1 table 528 of the data memory device 52 shown in FIG. 15 corresponding to respective melody tones for each chord. One example of the constructin of this #1 table 528 is shown in FIGS. 16A and 16B. The #1 table 528 comprises a C major tonality storing area shown in FIG. 16A and an A minor tonality storing area shown in FIGS. 16B.

In #1 table 528 continuous 16 addresses are assigned to every one chord, each address including two memory positions M1 and M2 each constituted by about 4 to 6 bits. As shown at a portion of FIG. 16A, the data of the C major tonality shown in Table IXX are stored in addresses 0 through 159 of the C major tonality memory area of the #1 table. Thus 16 addresses are sequentially assigned to each one of 16 diatonic chords C, Dm, Dm7, Em, Em7, F, G, G7, Am and Am7 of the C major tonality shown in Table IXX so that addresses 0 through 159 can be utilized to store data of the C major tonality. In FIG. 16A, addresses 0–15 are assigned to the C major chord, whereas addresses 16–31 are assigned to the Dm chord. As shown by a portion of FIG. 16B, the data of the minor tonality shown in Table XX are stored in addresses 0–143 of the A minor tonality storing area of the #1 table 528. Thus, by sequentially assigning 16 addresses for each of 9 diatonic chords (as well as chords that can be considered as diatonic chords as a result of modulation) Am, C, Dm, Dm7, E, E7, F, G, G7 a total of 144 addresses of 0 through 143 can be used for storing the data of the A minor tonality.

A memory unit comprising 16 addresses corresponding to one chord is herein called an "area". Thus the #1 table 528 contains 19 areas including both C major tonality and A minor tonality. The memory format of each area is the same. Thus, as shown in FIGS. 16A and 16B, a chord note code is stored in the memory area M1 comprising first four addresses, while note codes of the chord constituting tones are stored in the memory area M2. Like the chord note code shown in Table X, this chord note code comprises a root note code, a minor chord indication code m and a seventh chord indication code 7th. Where there are there chord constituting tones note codes NC of respective constituting tones are stored in a memory area M2 including the first 3 addresses, while all "1" (meaning that all bits are "1") is stored in the address 4. This all "1" means that no data is stored. The chord note codes are stored in the memory area M1 corresponding to the addresses storing the note codes NC of the chord constituting tones, and where the memory area M2 of address 4 is all "1", the memory area M1 of the address 4 is also all "1".

The area of addresses 0–15 corresponds to the C major chord so that chord name codes "NC·C, 0, 0" representing the C major chords are stored in the memory position M1 comprising addresses 0, 1 and 2. Thus, the key note code is NC·C, the minor chord indication code m is "0" and the seventh chord indication code 7th is also "0". The note codes NC·C, NC·E and NC·G representing the chord constituting tones C, E and G are stored in the memory position M comprising addresses 0, 1 and 2, and the memory positions M1 and M2 of address 3 are respectively all "1". An area comprising addresses 32–47 partially shown in FIG. 16A is an area corresponding to the chord Dm7, in which note codes NC·D, NC·F, NC·A and NC·C of four chord constituting tones D, F, A and D are respectively stored in the first addresses 32, 33, 34 and 35.

The note chords NC of scale tone (12 tones including a chromatic tone) are sequentially stored in the memory positions M1 comprising from 5th to 16th addresses of respective areas, starting from the key note. Duet interval data ΔKC corresponding to the note (melody tone) stored in the memory position is stored in the memory position M2 of the same addresses of from 5th to 16th addresses. The relation between the scale tone (melody tone) and the duet interval data ΔKC thus stored is shown in Tables IXX and XX. For example, in an area corresponding to the C major chord of the C major tonality, note codes NC·C through NC·B are sequentially stored in the memory position M1 comprising addresses 4 through 15 and the duet interval data "−5", "−6" and "−4" having the same values as shown in Table IXX are stored in the memory position M2. Since there is no duet interval data, at positions marked with X in Tables IXX and XX, all "1" are stored in these positions.

The chords (chord notes and chord constitutig tones), melody tones (scale tones), duet interval data (total 19) show in Tables IXX and XX are stored according to the area memory format described above, thus constituting the #1 memory table 528 so that the content thereof may be considered to be substantially the same as those of Tables IXX AND XX.

Figure 17:
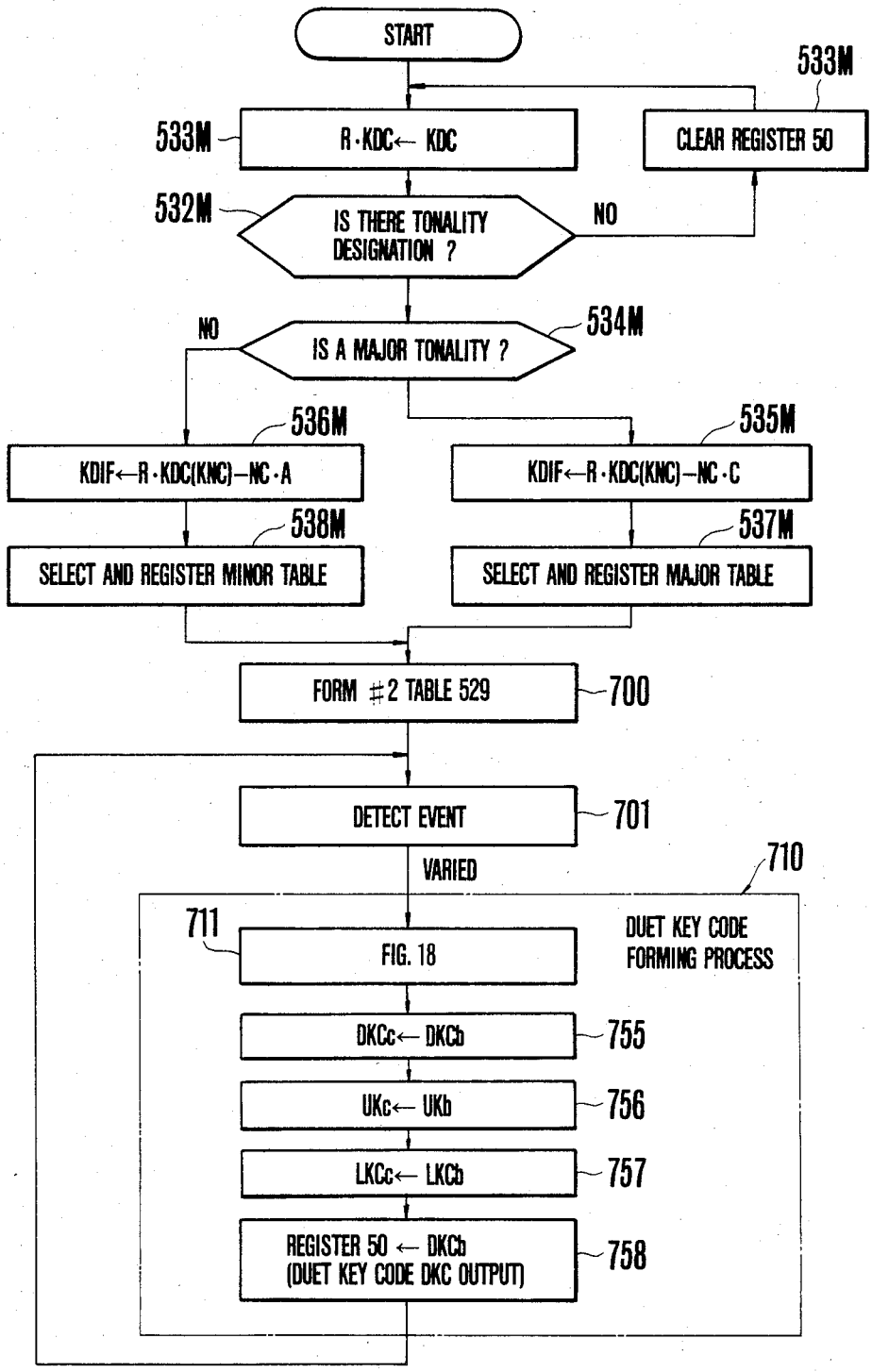
FIG. 17 is a flow chart modified in accordance with the modification shown in FIG. 15.
Figure 18:
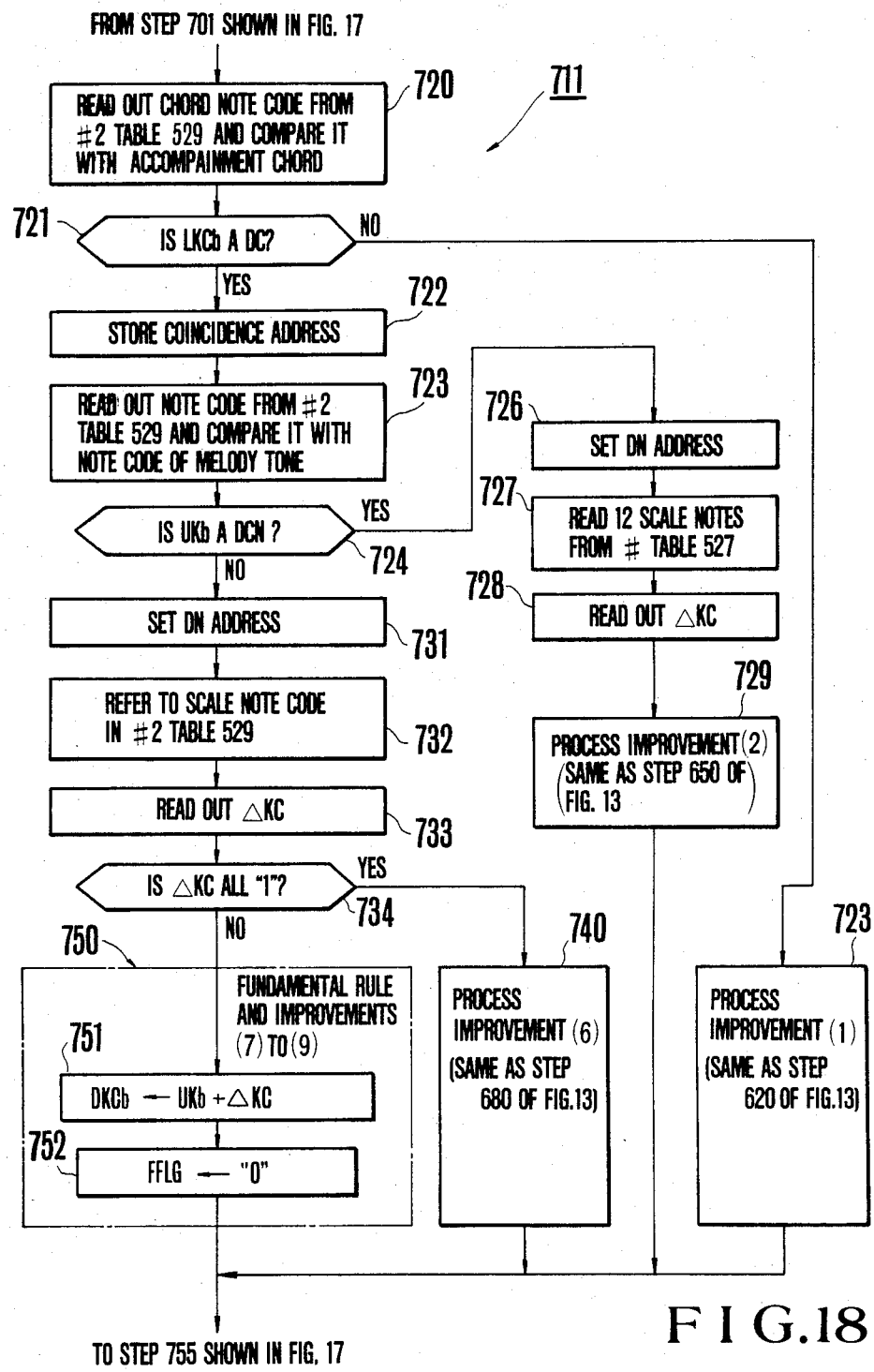
FIG. 18 is a flow chart showing the detail of principal processings of the ensemble tone key code forming and processing shown in FIG. 17.

The flow charts shown in FIGS. 17 and 18 show the steps of forming the duet key code with the duet key code forming circuit 15B, that is by the application of the fundamental rule and the improvements (1) through (9) where a portion of the data memory device 52 shown in FIG. 6 is replaced by the #1 table 528 and #2 table 528 shown in FIG. 6. Thus, by modifying as shown in FIGS. 17 and 18 a control program to be prestored in the program memory device 48 shown in FIG. 6 it becomes possible to form the duet tone key code according to the fundamental rule and the improvements (1) through (9). The registers R·KDC, KDIF etc. in the working memory device 48 (FIG. 6) are identical to those shown in FIG. 10 and operate similarly.

Since the processing, shown in FIGS. 17 and 18 have many points common to those of FIGS. 11 through 14 oly the principal difference will be described.

A processing from start to major table selection and registration or to minor table selection and registration shown in FIG. 17 is identical to the processing executed at step 537 from start to major tonality selection and registration of tables 521 through 524 or the processing (executed at step 528) to minor tonality selection and registration of tables 521–524 shown in FIG. 11. Accordingly, the steps corresponding to the steps shown in FIG. 12 are added with M. More particularly, at step 535M, the difference between the note code (KNC) of the tonality designation code KDC and the note code of the C tone (where a major tonality is designated) or the note code NC A or A tone (where a minor tonality is designated) is determined and the difference is stored in a tonality difference register KDIF. At step 537M, the C major tonality storing portion (FIG. 16A) of the memory table 528 of the memory table 52 (FIG. 15) is selected and registered (major table selection and registration). At step 538M the A minor memory portion (FIG. 16B) of the memory table 528 of the data memory device 52 is selected and registered (minor table selection and registration).

At the next step 700 all data stored in one of the C major tonality storing portion of the table 528 and the A minor tonality storing portion selected and registered as above described are sequentially read out. The note code among the data thus read out is added to the content of the tonality difference register KDIF (duodecimal addition) and the sum is written into a corresponding memory position of the #2 table 529 while the read out duet interval data ΔKC is written into a corresponding memory position of the #2 table 529.

As shown in FIG. 19, #2 table 528 comprising a RAM icludes at least 159 addresses and has two memory position M1 and M2 for each address and the memory areas are partitioned at every 16 addresses. Data read out from #1 table 528 are written in the same address and memory position (M1 or M2) of the #2 table 529 as those of the #1 table 528. Addition of the content of the tonality difference register KDIF to the note code read out from #1 table 528 converts the note codes stored in the #2 table 529, that is the key note code and the chord constituting code of the chord note codes and note codes of the dueodecimal scale tones corresponding to the melody tone, into the note codes corresponding to the designated tone (KDC). However, the value of the duet interval data ΔKC which is the same as that stored in the #1 table 528 is stored in the same address and at the same memory position of #2 table 529. This is because the duet interval data ΔKC can be used in common inespective of the tonality as already has been pointed out.

For example, when the designated tonality is the C major tonality, the content of the data written into the #2 table 529 would be just same as that of the major tonality memory portion (FIG. 16A and Table IXX). Where the designated tonality is different from the C major tonality, all note codes shown is FIG. 16A are shifted by the same extent and then stored in the #2 table 529. A minor tonality is processed in the same manner.

The correspondence between the duet table 524, the DC table 525, the DCN tables 526 and the DN table 527 in the data memory device 52 shown in FIG. 6, and the memory content of the #2 table 529 shown in FIG. 19 will now be described. A memory position M1 comprising first 4 addresses of respective areas in the #2 table 529 partitioned at every 16 addresses, that is the memory position of the chord name code corresponds to the diatonic chord (DC) table 525. A memory position M2 comprising first 4 addresses of respective areas, that is the memory position of the note codes of the chord constituting tones corresponds to the diatonic code constituting note (DCN) table 526, and a memory position M1 comprising from fifth to 16th addresses of respective areas corresponds to the diatonic tone DN table 527. A memory position M2 comprising from the 5th to 16th addresses of respective areas corresponds to the duet table 524.

The event detection processing step 701 shown in FIG. 17 corresponds to the event detection processing step 564 shown in FIG. 12. Thus, when the accompaiment chord or the upper keyboard depressed key tone (melody tone) varies its chord note code or an upper keyboard depressed key code is stored in the register LKCb or UKb (see FIG. 10) then the program is advanced to the next duet key code forming step 710. The detail of the processing executed at step 711 in the duet key code forming step 710 is shown in FIG. 18. At step 711, a duet key code is formed according to the fundamental rule or improvements (1) through (9) and then stored in the register DKCb at step 720, the chord note codes are sequentially read out from the memory position M1 (see FIG. 16) comprising the first addresses 0, 16, 32, 48 . . . of respective areas of #2 table 529 storing the chord note codes and the read out codes is compared with the poresent accompaniment chords stored in the chord register LKCb. When the chord name code read out from the #2 table 529 coincides with the chord name code stored in the register LKCb, the result of judgment whether LKCb is DC or not executed at step 721 is YES so that at step 722, coincident addresses are stored. This means that the present accompaniment chord stored in the register LKCb is a diatonic chord (DC). Where there is no coincidence, the result of judgment executed at step 721 is NO so that the program is transfered to step 723 regarding the improvement (1). Thus, where the accompainment chord (LKCb) is not the diatonic chord (DC), the processing regarding the improvement (1) is executed in the same manner as in FIG. 13. This step 723 in FIG. 18 is just the same as step 620 shown in FIG. 13 regarding the improvement (1), the steps 621, 622 and 623.

At step 723, the note codes of the diatonic chord constituting tones (DCN) are read out from the memory position M2 of the #2 table 529 corresponding to the addresses stored at step 722 and the read out addresses are advanced to sequentially read out 3 or 4 chord constituting tone note codes stored therein and the read out note codes are compared with the note code portion of the present upper keyboard depressed key tone (melody tone). For example, when the designated tonality is the C major tonality and the accompaniment chord is the C major tonality, at step 723 following the step 722 the note codes NC·C, NC·E and NC·G are sequentially read out from the memory position comprising addresses 0, 1 and 2 of the #2 table 729. In other words, the note codes of 3 or 4 chord constituting tones DCN of the chord (LKCb) are read out only from an area corresponding to the chord name of the accompaniment chord.

When the chord constituting tone note code read out from the #2 table 529 coincides with the note code portion of the register UKb the result of judgment executed at step 724 is YES. This means that the melody tone (UKb) is the same note as the diatonic chord constituting tone DCN (or a constituting tone of a chord treated in the same manner as a diatonic chord as a result of a modulation judgment) so that the step is advanced for the processing of the improvement (2). More particularly, after passing through step 726 where a DN address is set, step 727 where the scale note code of #2 table 528 is referred to and step 728 where duet interval data ΔKC is read out at step 729, a processing regarding improvement (2) is executed.

At step 726, the first address (that is the fifth address of a given area) of the scale tone note code memory portion of an area from which a chord constituting tone note chord has been read out at the preceding step 723 is set. #1 and #2 tables respectively store note codes of 12 scale tones including chromatic scale tones. Although all of these note codes are not true diatonic tones, the #1 table 528 is constructed to process also the chromatic scale as noting it to be identical to a diatonic tone (or a diatonic chord constituting tone) by applying the improvement (8) or (9) as above described. Consequently, in this embodiment the note codes of 12 scale tones including a chromatic scale stored in #2 table 529 (and #1 table) are processed as diatonic tones (DN), as will be described later, all "1" is read out as the duet interval data ΔKC it can be noted that they should not be processed as the diatonic tones DN, in other words should be processed as an inherent chromatic scale tone.

At step 727, 12 scale note codes stored in the memory position M1 of #2 table 528 stored in the first and succeeding addresses of the scale note codes set at the preceding step 726 are sequentially read out and, the read out note codes are compared with the note code position of the melody tone key code stored in the upper keyboard depressed key code register UKb and when they coincides with each other the read out address of #2 table 599 is stopped. More particularly, an address storing the scale note code of the same note as the present melody tone is searched out of one area of the #2 table 529 corresponding to the present accompaniment chord.

At step 728, the duet inteval data ΔKC is read out from the memory position M2 of the #2 table 529 corresponding to the address searched out at step 727. Accordingly, for example, when a C major tonality is designated, the accompaniment chord is a C major chord and when the melody tone is the E note, "−4" would be read out from address 8 of #2 table 529 as the duet interval data KC (see Table XVII a).

The processing executed at step 729 regarding the inprovement (2) is substantially the same as that regarding the improvement (2) executed at step 650. More particularly, the first processing executed at step 650 shown in FIG. 13, that is steps 651 and 652 are omitted at step 729 shown in FIG. 18, and at step 729 shown in FIG. 18 the same processing executed at step 650 shown in FIG. 13 are executed including processings executed at the suceeding steps of from step 653 through step 658. In FIG. 18, the duet interval data ΔKC is read out by a method different from that shown in FIG. 13 so that the steps up to step 652 of step 650 are omitted. At steps 663 and 666 of step 650 shown in FIG. 13 note codes (IIINC and INC) of the III degree and I degree are read out from the DN table 527. As shown in FIG. 19, the memory portion of #2 table 529 corresponding to the DN table comprises the memory position M1 constituted by the fifth to 16th addresses of respective areas, that is the scale note memory portion. Accordingly, for the purpose of executing a processing at step 729 shown in FIG. 729 which corresponds to those executed at step 663 and 666, it is only necessary to read out the scale note code stored in the memory position M1 comprising the addresses corresponding to I degree or III degrees from the area of the # table 529 which was referred to at the preceding step 727. At the time of the major tonality, the address corresponding to I degree is the fifth address of an area, whereas the address corresponding to III degree is the 9th address of the area. In the case of a minor tonality, I degree corresponds to the 5th address and III degrees to the 8th address. When executing step 658 in step 650 shown in FIG. 13 the DN table 527 is also referred to. To execute at step 727 shown in FIG. 18 a processing corresponding to above described processing for determining the degree of DKCb, IV degrees or VII degrees are detected by referring to the memory portion (FIG. 19) corresponding to the DN table of a predetermined ara of #2 table 529 in the same manner as above described.

As a result of executing step 729 (FIG. 18) regarding the improvement (2), as has been already described with reference to step 650 shown in FIG. 13, a duet key code DKC determined according to the improvement (2) or (5) is stored in the duet note key code register DKCb.

Where the key code stored in the register UKb is not a chord constitutig tone, the result of judgment executed at step 724 shown in FIG. 18 is NO, at which in the same manner as the result of YES described above, the steps 731, 732 and 733 are executed to read out a duet interval data ΔKC corresponding to a melody tone key code stored in the register UKb is read out from the #2 table 529. At the next step 734 a judgment is made as to whether the value of the read out ΔKC is all "1" or not. When the result of the judgment is YES, the program is advanced to step 740 regarding improvement (6). The data ΔKC equal to all "1" correspond to symbols X shown in Tables XVIII and XX so that the fundamental rule and the improvements (2), (7), (8) and (9) are not applied but instead the processing of the improvement 6 for the chromatic scale tone (nondiatonic tone) is applied. The processing regarding inprovement (6) executed at step 680 shown in FIG. 18 is just the same as that of step 680 shown in FIG. 13. Consequently, by executing step 740, the duet tone at positions marked with X shown in Table IXX or XX is determined according to ① or ② of improvement (6) and a key code representing the duet tone stored in the register DKCb.

When the result of judgment executed at step 734 is NO, the step is advanced to step 750 at which a processing related to the fundamental rule or improvements (7), (8) and (9) is executed. More particularly, the processing up to step 750 means that the duet interval data read out from the #2 table 529 is determined according to either one of the fundamental rule, and improvements (7), (8) and (9) because the processing routine for reading out the duet interval data ΔKC determined by the improvement (2) is branched as a different routine when the result of judgment of step 724 is YES.

At step 751 of step 750, similar to the processing shown by step 60 of FIG. 13, the key code of a melody tone (upper keyboard depressed key tone) is duodecimally added (actually substracted because ΔKC has a minus sign) to the duet interval data ΔKC read out from the #2 table and the sum or difference is stored in the duet key code register DKCb. At the next step 752, "0" is set in the termination flag register FFLG. As has been described with reference to Tables XVII and XVIII or Tables IXX and XX, since the #1 and #2 tables are preset with a duet interval data ΔKC having a value preset so that the improvements (7), (8) and (9) can be realized, a duet key code formed according to improvements (7), (8) and (9) (or the fundamental rule) by merely adding or sutracting the duet interval data ΔKC to and from the melody key code (UKb) at step 750.

Succeeding processings stored in the duet key code register DKCb, that is the steps 755, 756, 757, 758 executed succeeding to the step 711 shown in FIG. 18 are quite the same as those of the steps 614 through 617 shown in FIG. 13. After storing the duet key code DKC in the duet key code output register 50 the step is returned to the step 701 for detecting an event and maintained at a waiting state upper until the acoompaniment chord or the upper keyboard depressed key tone (melody tone) varies.

By utilizing the construction described above the duet key code DKC is formed according to the fundamental rule or improvements (1) through (9) and the duet tone generator 26 (FIG. 6) produces a duet musical tone signal, whereby a duet automatic performance of improved musical theory according to improvements (1) through (9) can be made.

In the above embodiment shown in FIG. 6, the duet key code forming circuit 15B adapted to form duet note key codes according the fundamental rule and the improvements (1) through (9) is constituted by a microcomputer. However, the duet code forming circuit can also be constituted by discrete circuits, one example thereof being shown in FIG. 20. For the sake of simplifying the drawing, circuits regarding improvements (3), (4) and (5) are not shown in FIG. 20.

Figure 20:
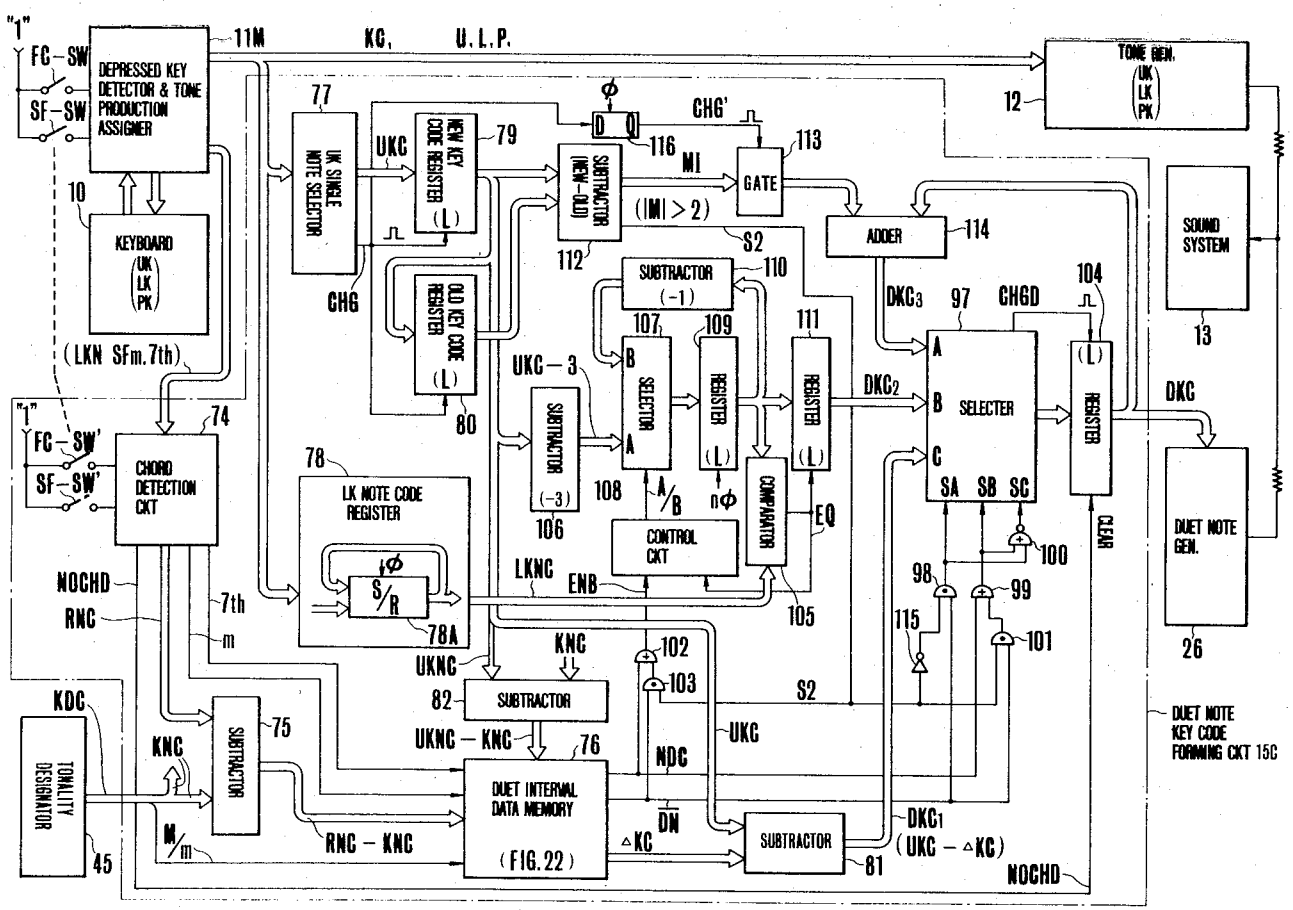
FIG. 20 is block diagram showing still another embodiment of this invention in which the ensemble tone peformance effect similar to that provided by the embodiment shown in FIG. 6 is accomplished by discrete circuits according to programs shown in FIGS. 11 to 14 or FIGS. 17 and 18.

In FIG. 20, the keyboard unit 10, the depressed key relating and assigning circuit 11M, the tone generator 12 for producing depresses key tones (or automatic bass chord tones) or respective keyboards, the sound system 15, the duet tone generator 26 and the tonality designater 45 are identical to those shown by the same reference characters in FIG. 6. However, it should be understood that the depressed key detection and the tone generation assignment circuit llM producesd a signal representing the note of a depressed key on a lower keyboard and a code type selection signal SFm·7th at the time of the single finger mode of the automatic bass chord performance. These signals are supplied to the chord detection circuit 74 of the duet note key code forming circuit 15C. For example, signal LKN is a 12 bit signal corresponding to each of 12 notes C or B, in which a bit corresponding to the note of the lower keyboard depressed key is "1" and the other bits are "0".

The chord detection circuit 74 comprises a well known circuit which detects a chord note according to a combination of lower keyboard depressed keys shown by the lower keyboard depressed key note signal LKN. For example, such circuit is disclosed in U.S. Pat. No. 4,184,401. Where a chord is not detected a chord nondetection signal NOCHD is produced, whereas when a chord is detected a root-note note code RNC representing the root note of the chord is generated a minor chord indication chord m or a seventh chord indication code 7th are made to be "0" or "1" depending upon the type of the chords, that is major, minor and seventh. The root-note note code RNC is applied to the subtraction circuit 75. Switches FC-SW' and SF-SW' are respectively interlocked with the finger code mode selection switch FC-SW and the single finger mode selection switch SF-SW. Where the single finger mode (SF) is selected, the chord type can not be discriminated with only the signal LKN so that a code m or 7th is produced according to a signal SFm·7th.

To the other input of the subtraction circuit 75 is applied the key note code portion KNC of the tonality designation code KDC (see Table IX) from the tonality designator 45 while the key note code KNC of the designated tonality is subtracted from the root note code RNC applied to one input. The resulting data "RNC-KNC" corresponding to the chord symbols I, II . . . , the minor chord indication code m, the seventh chord indication code 7th and the tonality designation code KDC is applied to the duet interval data memory device 76.

Key codes representing the depressed keys on respective keyboards and produces by the depressed key detection and tone production assignment circuit llM and the keyboard identification code U.L.P. are applied to the UK single note preferential selector 77 and the lower keyboard note code register 78. The UK single note preferential selector 77 preferentially selects only one of the keycodes UKC of the depressed UK keys and when the content of the thus selected key code UKC (that is when the melody tone varies) for producing a variation detection pulse CHG. The variation detection pulse CH9 is applied to a new key code register 79 and a writing control input (L) of an old key code register 80. To the data input of the new key code register 79 is applied an upper keyboard depressed key code UKC selected by the selector 77, whereas the output of the new key code register 79 is applied to the data input of the old key code register 80. Accordingly, as the upper keyboard depressed key (melody tone) varies, a new, that is present upper keyboard depressed key code UKC is stored in the new key code register 79 an immediately preceding old upper keyboard depressed key code is stored in the old key code register 80, the content thereof being used to process the improvement (6).

The present key code UKC stored in the upper keyboard depressed key (melody tone) stored in the new key code register 79 is applied to the subtraction circuit 81 and the note code portion UKNC of the key code UKC is applied to the subtraction circuit 82. The key note code KNC of a designated tonality is applied to the other input of the subtraction circuit 82 to effect a duodecimal subtraction of the key note code KNC from the upper keyboard depress key note code. The data "UKNC-KNC" thus produced by the subtraction circuit 82 represents the degrees (the interval from the key tone of the upper keyboard depressed key (melody tone) at the designated tonality. Thus, the result of subtraction "UKNC-KNC" corresponds to the degree representations I, II . . . . These degree resenting data "UKNC-UKC" are applied to the duet interval data memory device 76.

Figure 21:
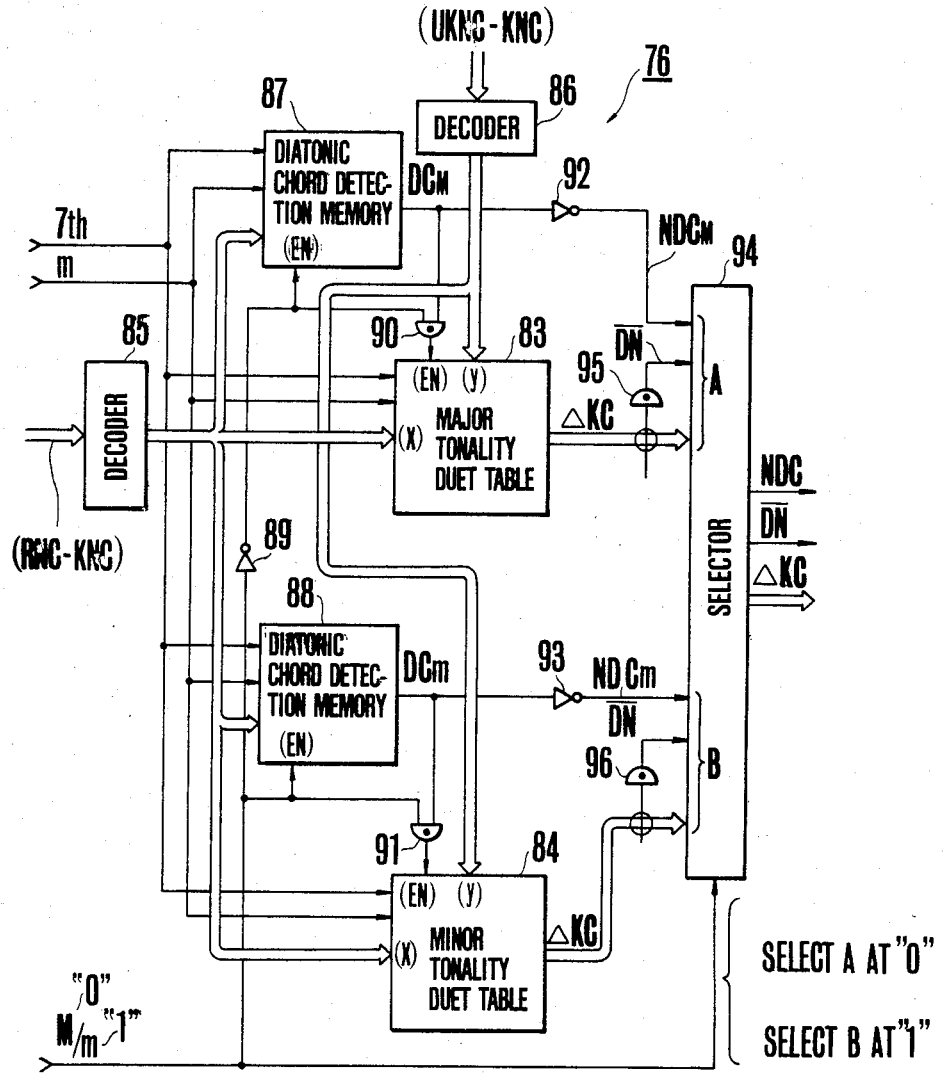
FIG. 21 is a block diagram showing the detail of the ensemble tone difference data memory device shown in FIG. 20.

The detail of this memory device 76 is shown in FIG. 21 in which the duet interval data memory device 76 is shown as comprising a major tonality duet table 83 and a minor tanlity duet table 84. Where it is desired to provide similar effects as the embodiment shown in FIGS. 11–14, that is an embodiment [for convenience herein after termed an improved example (1)] applied with the fundamental rule and the improvements (1)–(6), duet tables 83 and 84 are prepared in the same manner as the duet table 524 shown in Table XIII. More particularly, the duet interval data ΔKC corresponding to the scale degree representation and the chord symbols of the accompaniment chord respectively are prestored in the major tonality duet table 83 as shown by the major tonality portion of the duet table 524 shown in Table XIII, and the duet interval data ΔKC are prestored in the minor tonality duet table 84 as shown by the minor tonality portion of Table XIII.

Where it is desired to provide similar effects as those of the embodiment shown in FIGS. 17 and 18, that is an embodiment (for convenience, hereinafter called improved example 2) applied with the fundamental rule and the improvements (1) through (9) the major tonality duet table 83 is constructed as shown in Table IXX, whereas the minor tonality duet table 84 is constructed as shown in the following Table XX. Only the absolute values of the duet interval data ΔKC are stored in the tables 83 and 84 and minus (−) signs are not stored. Because the duet key codes are calculated by the subtraction circuit 81 (FIG. 20).

The output "RNC–KNC" of the subtraction circuit 70 showing the degrees I, II . . . of the root note of the accompaniment chord is applied to a decoder 85 to decode respective degrees. The output "UKNC-KNC" of the subtraction circuit 82 which represents the scale degrees of the melody tone (including chromatic scale notes) is applied to a decoder 86 to decode respective degrees. Thus the output of the decoder 86 comprises a total of 12 bits for each chromatic scale tone. The output of the decoder 85 is applied to x addresses of the duet tables 83 and 84 and also to the diatonic chord detection memory devices 87 and 88. The output of the decoder 86 is applied to the y addresses of the duet tables 83 and 84. Indication codes m and 7th are also applied to the x addresses of the tables 83 and 84 for the purpose of descriminating the minor and seventh of the chords of the same root note degree (for example II and II7).

The diatonic chord detection memory devices 87 and 88 determine whether the accompaniment chord is a diatonic chord (DC) or not according to the output (a signal representing the root note degree of the chord) of the decoder 85 and codes m and 7th representing the type of the chord. The codes m and 7th are applied to the chord detection circuit 74 (FIG. 20). The memory device 87 prestores a data (comprising a combination of a signal representing the root note degree and the codes m and 7th) representing the diatonic tonality of the major tonality. Where the inputted chord data coincides with either one of the stored diatonic chord data, the memory device 87 produces a diatonic tone detection signal DCM. In the same manner, the memory device 88 prestores data representing the diatonic chord of the minor tonality so that when the inputted chord data coincides with either one of the stored diatonic chord data, the memory device 88 produces a diatonic chord detection signal DCm. A signal obtained by inverting the signal M/m representing the designated tonality is applied to an enabling input EN of the diatonic chord detection memory device 87 for the diatonic tonality, while the signal M/m applied to an enabling input EN of the diatonic chord detection memory device 87 for the minor tonality. As shown in Table IX, "0" of the 1 bit signal M/m showing the designated tonality means the major tonality whereas "1" means the minor tonality. Consequently, when the designated tonality is the major tonality, it becomes possible to read out the diatonic chord detection memory device 87 for the major tonality, whereas when the designated tonality is the minor tonality, it becomes possible to read out the diatonic chord detection memory device for the minor tonality.

In the case of the improved example 1 (fundamental rule and improvements (1) through (6)) chord data corresponding to 10 diatonic chords I, II, II7, III, III7, IV, V, V7, VI and VI7 representing the major tonality portion shown in Table X (diatonic chord fundamental table 521) are prestored in the diatonic chord detection memory device 87 for the major tonality. Chord data corresponding to 6 diatonic chords I, IV, IV7, V, V7 and VI shown in the minor tonality portion of Table X are preset in the diatonic chord detection memory device for the minor tonality.

In the case of the improved example (fundamental rule and improvements (1) through (9)), chord data representing 10 diatonic chords shown in the column of the chord of Table IXX are prestored in the diatonic chord detection memory device 87 for the major tonality. Since the note code of C has the same value as the data representing I degree, the chord data of the chords C–Am7 shown in Table IXX may be the same as the chord data of the chord symbols stored in the memory device 87 at the time of the improved example 1. Chord data showing 9 diatonic chords shown in the chord column in Table XX or chords that can be considered as the diatonic chords as a result of modulation are prestored in the diatonic chord detection memory device 88 for the minor tonality.

Since the root note data outputted by the decoder 85 have been replaced by degrees from the key note, the diatonic chord data to be stored in the diatonic chord detection memory device 88 for the minor tonality should also be converted into perfect degrees. For example, the minor tonality portion of Table X or the Am chord shown in Table XX are stored after being converted into degree representation I degree for the minor tonality instead of A degree representing VI degrees for the major tonality. Thus, a combination of data representing root note degree "I degree" and data showing a minor chord is stored in the memory device 88 as the chord data of the diatonic chord Am shown in Table XX or the minor tonality portion of Table X.

The outputs DCM and DCm of the diatonic chord detection memory devices 87 and 88 are applied to AND gate circuits 90 and 91 respectively and to a selector 94 as nondiatonic chord signals NDCM or NDCm after being inverted by inverters 92 and 93. Where the memory device 87 detects that the accompaniment chord is a diatonic chord, signal DCM or DCm is "1" and a nondiatonic chord signal NDCM or DCm obtained by inverting signal DCM or DCm is "0". Where the accompaniment chord is a nondiatonic chord, the diatonic chord detection signal DCM or DCm is "0" and a nondiatonic signal NDCM or NDCm obtained by inverting the signal DCM or DCm is "1".

A signal obtained by inverting the signal with an inverter 89 is supplied to the other input of the AND gate circuit 90 and its output is applied to the enabling input (EN) of the duet table 83 of the major tonality. The signal M/m is applied to the other input of the AND gate circuit 91 and its output is applied to the enabling input (EN) of the duet table 84 of the minor tonality. Accordingly, it is possible to read out the major tonality duet table 83 only when the designated tonality is the major tonality (M/m is "0") and the accompaniment chord is the diatonic chord (DCM is "1"). The minor tonality duet table 84 can be read out only when the designated tonality is the minor tonality (M/m is "1") and the accompaniment chord is the diatonic chord (DCm is "1").

In the duet table 83 or 84 which is rendered to be readable by the signal "1" applied to the enabling input (EN), a predetermined duet interval data ΔKC is read out in accordance with the chord data (indication codes m and 7th are also taken into consideration) from the decoders 85 and 86 applied to their x and y addresses, and the scale degree data of the melody tone. Where the improved example is applied, all "1" similar to the #1 and #2 tables is stored in tables 83 and 84 as the duet interval data ΔKC corresponding to the symbols X in Tables IXX and XX. In the case of the improved example, only 7 tones of the whole scale and shown at the y address of the Table XIII, but the duet tables 83 and 84 include 12 y addresses corresponding to 12 outputs (including a chromatic scale note) of the decoder 86. In this case, as shown in Table XIII the duet interval data ΔKC is stored in tables 83 and 84 according to the melody note scale degrees corresponding to the whole scales, but where the melody comprises chromatic scale notes, as the duet interval data ΔKC [which is determined by the fundamental rule and the improvement (2)] does not contained in Table XIII, all "1" is stored as the data ΔKC in the same manner as above described.

The duet interval data ΔKC read out from the duet tone table 83 and 84 are applied to a selector 94. In the case of the improved example 1, these duet interval data ΔKC contribute to the formation of a duet key code according to the fundamental rule and the improvement (2), whereas in the case of the improved example (2) contribute to the formation of the duet key code in accordance with the fundamental rule and the improvements (2), (7), (8) and (9).

All bits of the duet interval data ΔKC read out from the major tonality duet tone table 83 are applied to one input of the AND gate circuit 95, while all bits of the duet interval data ΔKC read out from the minor tonality duet tone table 84 and applied to one input of the AND gate circuit 96. AND gate circuits 95 and 96 produce an output "1" when the data ΔKC applied thereto are all "1". This output "1" means the melody tone (upper keyboard depressed key tone) is not a diatonic tone or a tone that can not be considered as a diatonic tone or a diatonic chord constituting tone by the application of improvements (7), (8) and (9). The output "1" of the AND gate circuits 95 and 96, that is a nondiatonic tone (chromatic scale) signal $\overline{DN}$ is applied to the selector 94.

A signal M/m showing a major tonality or a minor tonality is applied to the control input of the selector 94 so that where the major tonality is designated (M/m is "0"), the selector selects and outputs a nondiatonic chord signal NDCM regarding the major tonality, a nondiatonic chord signal DN, and duet interval data ΔKC (that is A input of the selector 94), whereas when the minor tonality is designated (M/m is "1") the selector 94 selects and outputs a nondiatonic chord signal NDCm regarding the minor tonality, a nondiatonic tone signal $\overline{DN}$, and the duet interval data ΔKC (that is B input). The nondiatonic chord signal NDC, the nondiatonic tone signal DN and the duet interval data ΔKC of either one of the major and minor tonalities outputted from the selector 94 are outputted from the duet interval data memory device 76 (FIG. 20).

In FIG. 20, when the nondiatonic chord signal NDC outputted from the duet interval data memory device 76 is "1", it means that the duet key code should be formed according to the improvement (1). On the other hand, when the nondiatonic tone signal $\overline{DN}$ is "1", the duet key code should be formed according to the improvement (6). When signals NDC and $\overline{DC}$ are both "0", the duet key code should be formed according to the fundamental rule or improvement (2) or (7), (8) and (9), that is by utilizing the data ΔKC.

The duet interval data ΔKC outputted from the duet interval data memory device 76 is applied to a subtraction circuit 81 where the duet interval data ΔKC is duodecimally subtracted from the key code UKC of the present upper keyboard depressed key (melody tone) given by the new key code register 79 to obtain a key code DKC1 (UKC−ΔKC) representing a duet. The duet key code DKC1 produced by the subtraction circuit 81 was formed according to the fundamental rule or the improvement (2) or (7)-(9).

The duet key code DKC1 produced by the subtraction circuit 81 is applied to the C input of a selector 97. To the A selection control input SA of the selector 97 is applied the output of an AND gate circuit, to the B selection control input SB is applied the output of an OR gate circuit 99 and to the C selection control input SC is applied the output of an NOR gate circuit 100 which is supplied with the outputs of the AND gate circuit 98 and the OR gate circuit 99. The nondiatonic chord signal NDC outputted from the duet interval data memory device 76 is applied to OR gate circuits 99 and 102, while the nondiatonic signal $\overline{DN}$ is applied to AND gate circuits 98, 101 and 103. The output of the AND gate circuit 101 is applied to the OR gate circuit 99. As a consequence, where a duet key code is to be formed by utilizing the duet interval data ΔKC, since the nondiatonic chord signal NDC and the nondiatonic tone signal $\overline{DN}$ are both "0", the outputs of AND gate circuit 101, OR gate circuit 99 and the AND gate circuit 98 are all "0" and the output of the NOR gate circuit 100 becomes "1". Accordingly, the C input of the selector 97 is selected to select and produce the duet key code DKC1 formed according to the fundamental rule or the improvement (3) or (7)-(9).

The selector 97 is provided with a circuit (not shown) that detects variation in the content of the selected and outputted duet note key code so that the selector 97 produces a variation detection pulse CHGD as the content of the selected duet note key code varies. The variation detection pulse CHGD is applied to the write control input L of a register 104 to rewrite the data stored therein. To the data input of the register 104 is applied the duet key code selected by the selector 97. Consequently, when the content of the duet note key code varies, a new duet note key code after the variation is written into and stored by the register 104. The duet note key code DKC stored in the register 104 is supplied the duet musical tone signal generator for producing a musical tone signal having a pitch corresponding to this key code DKC.

A circuit for forming a duet note key code according to the improvement (1) will bow be described.

The lower keyboard note code register 78 stores all note code portions of the key codes regarding the lower keyboard depressed keys (including key codes of the chord constituting tones automatically formed by automatic performance) among key codes KC supplied from the depressed key detection and tone production assignment circuit 11M, and then repeatedly outputs stored note code LKC, one after one, on the time division basis. For example, the register 78 comprises a circulating type shift register 78A and the note codes LKNC of respective depressed key tones of the lower keyboard are written into respective stages of the shift register 78A so as to output respective note codes, on the time division basis, as the content of the shift register 78 is shifted. Since the lower keyboard is utilized for the chord performance, the note codes LKNC outputted from the lower keyboard note code register 78 represent the chord constituting tones and one applied to a comparator 105.

The key codes UKC of the upper keyboard depressed key tones (melody tones) outputted from the new key code register are supplied to a subtractor 106 which produces an output obtained by subtracting "3" from the key code UKC, the data "3" corresponding to the interval of minor three degrees. The result of subtraction satisfies the condition (1) wherein the interval between the melody tone and the duet is made to be larger than major 2nd interval (that is equal to or more than minor 3rd interval). The output "UKC−3" of the subtractor 106 is applied to the A input of a selector 107 which in response to a signal from a control circuit 108 selects and outputs either one of the A and B inputs. The data outputted by the selector 107 is applied to a register 109. The write control input L of the register 109 is supplied with a clock pulse no slower than the shift control clock pulse $\phi$. The output of the register 109 is applied to a comparator 105, subtractor 110 and register 111. The subtracter 110 operates to subtract 1 from the key code given by the register 109 and the resulting difference is applied to the B input of the selector 107. The comparator 105 compares the note code portion of the key code given from the register 109 with the note code LKNS of the chord constituting tone given by the lower keyboard note code register 78 and produces a coincidence signal EQ upon cincidence is obtained. The coincidence signal EQ is applied to the control input L of the register 111 and to the control circuit 108 which is supplied with the output of the OR gate circuit 102 s an enabling signal ENB. The OR gate circuit 102 is also supplied with the nondiatonic chord signal NDC and the output of the AND gate circuit 103.

The control circuit 108 holds its output A/B at "1" for a definite time when the enabling signal ENB builds up to "1", thereby causing the selector 107 to select A input. Also when the coincidence signal EQ is produced the control circuit 108 holds the output A/B at "1" for a definite time, thus causing the selector 107 to select A input. In a case other than those described above, that is when the coincidence signal EQ is not generated, the control circuit 108 makes "0" the output A/B, thus causing the selector 107 to select B input.

Let us assume now that the period of the clock pulse $n\phi$ utilized to control writing of the register is n times (n represents the number of stage of the shift register 78A) of the period of the shift clock pulse $\phi$ used for the shift register 78A in the lower keyboard note code register 78. For instance, in order to store a maximum of 4 chord constituting tones in the shift register 78A, the number of the stages should be 4, so that the period of the clock pulse $n\phi$ is made to be 4 times of that of the clock pulse $\phi$. For this reason, the content of the key code outputted from the register 109 does not vary until note codes LKNC of all chord constituting tones have been outputted from the lower keyboard note code register 78 on the time division basis.

As above described, where a duet key code is formed according to the improvement (1), the nondiatonic chord signal NDC becomes "1". When the enabling signal ENB produced by the OR gate circuit 102 becomes "1" as a result of building up to "1" of the signal NDC, the output A/B of the control circuit 108 is maintained at "1" for a definite time (for example, one period of the clock pulse $n\phi$). Consequently, a key code "UKC−3" minor 3 degrees lower than the melody tone outputted from the subtracter 106 (that is an interval lower than the melody tone, apart from the major 2 degrees and closest to the melody tone) is selected through the A input of the selector 107 and stored in the register 109 by the timing action of the clock pulse $n\phi$. Thus, at first note code portion of the key code "UKC−3" outputted from the register 109 is sequentially compared with respective note codes LKNC of the chord constituting tones by comparator 105. Where no coincidence signal is produced, the output "UKC−4" of the subtracter 110 corresponding to subtraction of 1 from the output "UKC−3" of the register 109 is selected through the B input of the selecter 107 and stored in the register 109 by the timing action of the clock pulse $n\phi$. Of course, in the subtracters 106 and 110 subtraction operations are duodecimal.

Until a coincidence signal EQ is generated as above described, 1 is sequentially subtracted from the key code "UKC−3" and each time "1" is subtracted, comparison of the difference with each note code LKNC of the chord constituting tones is repeated. Upon generation of the coincidence signal EQ from the comparater 105, the output key code of the register 109 is transfer stored in the register 111 and the output A/B of the control circuit 108 is maintained at "1" for a definite time, so that A input "UKC−3" is selected again by the selector 107. By the timing action of the next clock pulse no the key code "UKC−3" is stored in the register 109 and the comparison of this key code with a key code obtained by subtracting "1" therefrom is repeated in the same manner as above described.

The key code outputted by the register 109 at the time of generation of the coincidence signal EQ is a duet key code formed according to the improvement (1) and stored in a register 111. More particularly, this duet key code satisfies a condition of improvement (1) that it is lower than the melody tone (UKC), that apart by the major 2nd interval, that has the same note as either one of the chord constituting tones (LKNC) and that closest to the melody tone. By repeating the comparison for detecting the coincidence, each time a coincidence signal EQ is generated the content of the register 111 is rewritten but so long as the accompaniment chord (LKNC) and the melody tone (UKC) do not vary, the key code of the same value is always written in the register 111 so that the value of the duet key code DKC outputted from the register 111 does not vary in any appreciable extent. When the accompaniment chord or melody tone varies, the value of the duet note key code DKC2 stored in the register 111 also varies.

The duet note key code DKC2 outputted from the register 111 is applied to the B input of the selector 97. When the nondiatonic chord signal NDC showing the application of improvement (1) is "1" is applied to the B selection control input SB of the selector 97 via the OR gate circuit 99 so that the duet note key code DKC2 applied to the B input would be selected and outputted by the selector 97. The selected duet note key code is stored in the register 104 by the variation detection pulse CHGD. As above described, the key code DKC formed according to improvement (1) is stored in the register 104 and then applied to the duet tone generator 26.

A circuit for forming a duet key code according to the improvement (6) will be described hereunder.

A duodenary subtracter 112 subtracts the key code of a previous melody tone stored in the old key code register 80 from the key code of the present melody tone stored in the new key code register 79 to obtain data MI representing the melodic interval of a melody tone. The subtracter 112 contains a comparator, not shown, so that where the absolute value MI of the data MI representing the interval is larger than 2, the comparator produces a signal S2. "1" of this signal S2 means that the melodic interval of the melody is apart by major 2nd interval, that is one of the conditions of ② of the improvement (6) is satisfied. On the other hand "0" of signal S2 means that the melodic interval of the melody is shorter than the major 2 degrees, that is one of the conditions of ① of improvement (6) is satisfied.

The data MI representing the melodic interval of the melody is applied to an adder 14 via a gate circuit 113, and to the control input thereof is applied a short pulse CHG' which is obtained by delaying by 1 bit time the variation detection pulse CHG of the melody tone outputted by the upper keyboard single note selection circuit 77 with a delay flip-flop circuit 116. The reason for delaying one bit time lies for waiting variation in the contents of the registers 79 and 80. Accordingly, the gate circuit 113 is enabled for a short time when the melody tone varies so that a difference between the key code (content of register 79) of the new melody tone after variation and the key code (the content of register 80) of the old melody tone before variation, that is the data MI representing the melodic interval of the melody tone is added to the adder 114 for a short time. To the other input of the adder 114 is applied the duet key code DKC being stored in the register 104. When the gate circuit 113 is enabled to apply the data MI to the adder 114, the duet key code DKC stored in the register 104 is a duet tone (corresponding to a melody tone stored in the old key code register 80) produced before the variation of the melody. Consequently, the adder 114 duodecimally adds the duet key code DKC produced previously to the interval data MI same as the motion of the melody, thereby producing the key code DKC3 of a duet tone to be newly produced. In other words, the key code DKC3 is determined such that the melodic interval of the duet would be equal to the melodic interval of the melody. This duet key code DKC3 is applied to the A input of the selector 97.

When the nondiatonic tone signal $\overline{DN}$ outputted from the duet interval data memory device 76 is "1", that is when the accompaniment chord is a diatonic chord but the melody tone is a nondiatonic tone (chromatic scale), the improvement (6) is applied. In this case, when the signal S2 outputted from the subtracter 112 is "0", that is when the interval data MI shows an interval shorter than the major 2 degrees, ① of the improvement (60) is applied. In this case, the AND gate circuit 98 supplied with a signal obtained by inverting signal S2 with inverter 115, and signal $\overline{DN}$ produces an output "1" so that the selector 97 selects and outputs the new duet code DKC3 (obtained by duodecimally) adding the interval data MI) to the previous duet key code). Then the variation detection pulse CHCD is supplied to the register 104 to store therein a new duet key code DKC. In this manner, the duet key code DKC3 formed according to ① of the improvement (6) is stored in the register 104 so that a musical tone signal corresponding to this duet key code is produced by the duet musical tone signal generator 26. Newly formed duet key code DKC (now producing a musical tone) is applied to an adder 114 but at this time, since the gate circuit 113 has already been disabled, the interval data MI would not be applied. Accordingly, the duet key code DKC now producing the musical tone passes to the A input of the selector 97 without being modified by the adder 14.

Where the signal S2 produced by the subtracter 112 is "1", ② of improvement (6) is applied. More particularly, the nondiatonic tone signal $\overline{DN}$ and signal S2 applied to the AND gate circuit 103 are both "1", an enabling signal ENB is applied to the control circuit 108 from the AND gate circuit 103 via OR gate circuit 102 to form a duet key code DKC2 having the same note as one of the chord constituting tones (LKNC) in the same manner as in a case of applying the improvement (1). The output "1" of the AND gate circuit 101 supplied with signal $\overline{DN}$ and S2 is applied to the B selection control input of the selector 97 through the OR gate gate circuit 99 for selecting the duet key code DKC2 applied to the B input. Thus the duet key code DKC2 formed according to ② improvement (6) is selected by the selector 97 and stored in the register 104.

A chord nondetection signal NOCHD is applied to the clear input of the register 104. Accordingly, register 104 is cleared where an accompaniment chord is not detected by the chord detecting circuit 74 to crease the duet key code DKC so that no duet tone is produced.

In the foregoing embodiments it was assumed that a specific tonality designation switch is used not only for the tonality designator 16 shown in FIG. 1 but also for the tonality designators 28 and 45 shown in FIG. 3, and FIGS. 6 and 20. But it will be clear that it is also possible to use a keyboard (for example, the lower keyboard) as shown in FIG. 22 or 23 instead of using a specific switch.

Figure 22:
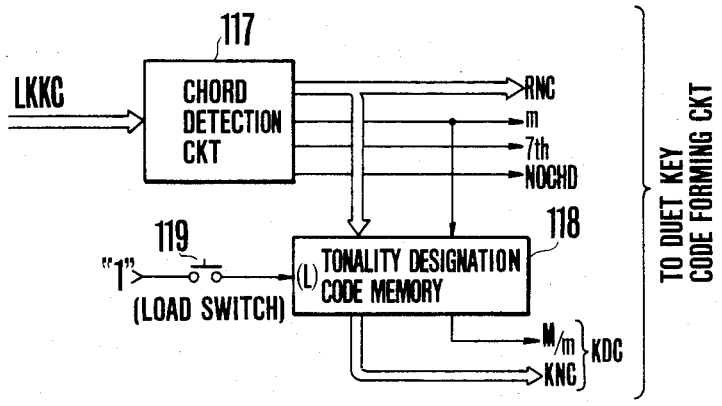
FIG. 22 is a block diagram showing another means for designating the key and FIG. 23 is a block diagram showing still another means for designating the key.

In FIG. 22, an information LKKC of a lower keyboard depressed key is applied to the chord detector 117 so as to detect a chord based on the combination of a plurality of depressed keys on the lower keyboard. Similar to the chord detecting circuit 74 shown in FIG. 20, the chord detecting circuit 117 produces a root note code RNC representing the root note of the detected chord, a minor chord indication code m representing the type of the chord, and the seventh chord indication code 7th, whereas when a chord is not detected the chord detecting circuit 117 produces a chord nondetection signal NOCHD. The root note code RNC and the minor chord indication code m outputted from the chord detecting circuit 117 are stored in a tonality designation code memory device 118, which when a lead switch 119 is closed, stores the root note code RNC produced by the chord detecting circuit 117 and the minor indication code m. The note code RNC and the minor indication code m stored in the memory device 118 are supplied to a duet note key code forming circuit (not shown) as the note code KNC representing the key note of the designated tonality and the signal M/m representing the tonality. More particularly, the note code KNC and the tonality indication signal M/m stored in the memory device 118 constitute the tonality designation code KDC.

To designate a tonality, a chord key (chord I) on the lower keyboard corresponding to the tonality is depressed while at the same time the load switch 119 is closed. For example, to designate a C major tonality, C major chord keys (3 keys of C, E and G) on the lower keyboard are depressed, whereas to designate a A minor tonality A minor chord keys (3 keys of A, C and E) are depressed. In this manner, a desired tonality designation code KDC (KNC and M/m) is stored in the tonality designation code memory device 118. Unless the load switch 119 is closed the contents of the memory device are not rewritten so that the content of the tonality designation code KC does not vary during a normal chord performance. The root-note note code RNC and others m, 7th, NDCHD outputted from the chord detection circuit 117 are suitably utilized in the duet key code forming circuit, not shown.

Figure 23:
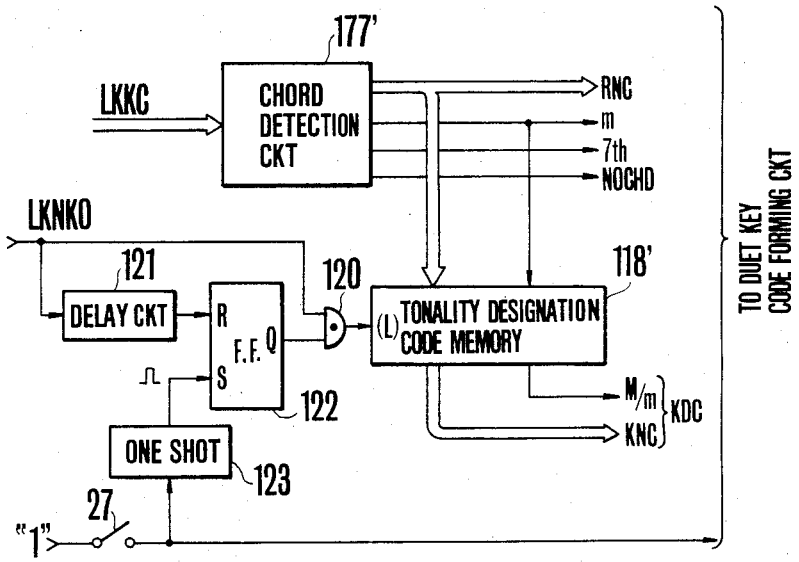

Like the embodiments shown in FIG. 22, is FIG. 23, a chord is detected by a chord detection circuit 117' based on the information LKKC regarding the lower keyboard depressed key and the root-note note code RNC and the minor chord indication code m of the detected chord is applied to a tonality designation code memory device 118'. In this case, however, the tonality designation code is automatically applied to the memory device 118' instead of a manner operation as in the case shown in FIG. 22.

First key depression on the lower keyboard is detected by using a suitable circuit such as the depressed key detection and tone production assignment circuit 11 (FIGS. 1, 3, 6 and 20), and in response to such detection, a lower keyboard new key ON signal LKNKO is generated. This lower keyboard new key ON signal LKNKO is applied to an AND gate circuit 120 shown in FIG. 23, and to the reset input R of a flip-flop circuit 122 after being delayed a definite time with a delay circuit 121. The output of a one shot circuit 123 responsive to the build up of the output of the duet switch 27 is applied to the set input S of the flip-flop circuit 122. The output Q thereof is applied to the AND gate circuit 120, the output thereof forming a load instruction L for the tonality designation code memory device 118'.

To perform the duet automatic performance, the duet switch 27 is firstly closed and the output thereof makes operable a duet key code forming circuit, not shown. As the output of the duet switch 27 builds up to "1", the one short circuit 123 produces a shot pulse, whereby the flip-flop circuit 122 is set. Thereafter, when a key is depressed on the lower keyboard, that is when a chord of the first paragraph of a music is performed, the lower keyboard new key ON signal LKNKO becomes "1" for a definite short time so that the AND gate circuit 120 produces a pulse "1" so that the root-note note code RNC of the accompaniment chord of the first paragraph of the music, and the indication code m are stored in the memory device 118'. After elapse of the delay time (a short time) of the delay circuit 121, a delayed signal of the new key on signal LKNKO is applied to the flip-flop circuit 122 to reset the same. Accordingly, thereafter the AND gate circuit 120 is disabled so as to hold the memories of the root-note note code RNC of the first paragraph and the indication code m which were written into the memory table 118' and these memories are utilized as the tonality designation codes KDC (KDC and M/m).

The reason that the accompaniment chord of the first paragraph is automatically stored in the memory device 118' the tonality designation information lies in that in most music the chord of their first paragraphs is the chord I of the tonality of the music. Accordingly, in the embodiment shown in FIG. 23, the tonality designation code KDC is automatically stored in the memory device 118' by commencing the performance of the music without depressing a chord key for designating a tonality as shown in FIG. 22. As an exceptional case, where the chord of the first paragraph is not a chord I, before commencing the performance, the key of the chord I is depressed as in the embodiment shown in FIG. 22.

Although in the foregoing embodiments, the tone generated as the duet tone is a single tone, provision of a plurality of duet note key code forming circuits 15, 15A, 15B and 15C as well as duet tone generators 26 makes it possible to simultaneously produce a plurality of ensemble tones, resulting in a trio, quartet, etc. Although in the embodiments shown in FIGS. 6, 15 and 20, the interval of the duet formed according to the fundamental rule was made to be 3 degrees lower than the melody tone, it is also possible to select the intervals as in the embodiment shown in FIG. 1.

Furthermore in the foregoing embodiments, a duet interval data ΔKC representing the interval between the melody tone and the duet was stored in the memory devices 21-1 through 7o 21-8, tonality-duet Table III, duet table 524, #1 table 528, and the duet tables 83 and 84, as duet forming data, but data showing the pitch of the duet can also be stored, such data comprising a note code representing the note of a duet, and an information representing the difference (upper or lower octave) between a note code showing the note of a duet, for example, and the octave of the melody tone of the duet.

Thus for example, note data and octave down data (underlined data) as shown n Tables XXVII and XXVIII may be prestored as the duet forming data. In such a case, for the purpose of calculating the duet note key code DKC, the note code read out from the memory devices or memory tables and showing the note of the duet is utilized as the note code of DKC as it is, so as to make the octave code of the melody tone (the upper keyboard depressed key) which is subtracted or added with "1" according to the octave down (or up) data, or a code same as the octave code of a melody tone to be the octave code of DKC.

Although in the foregoing embodiments the addition and subtraction operations regarding the note code NS were performed duodenarily on the assumption that the note codes NC corresponding to 12 notes (C to B) are continuous values, where the note codes NC are discontinuous, a suitable data correction computation is added to the additional subtraction operations. One example of such data correction circuit is disclosed in U.S. Pat. No. 4,184,401.

Although in the foregoing embodiments, the scales were limited to an Ionian mode and a Aeolian mode, it should be understood that the scale can be changed or expanded to another scale. In such a case, the construction of the ROM for storing the duet forming data in the duet key code forming circuit shown in the foregoing embodiments is modified or expanded. If desired, the construction of the switch of the tonality designater may be changed. The other scales include modes of Doria, Phrygia, Lydia, Mixolydia, Locria, etc. For example Doria includes the scales of re, mi, fa, so, la, si, do and re. The scale note where a C Doria is designated as the performance tonality C, D, D♯, F, G, A and Bb and in this case where the melody tone is D, the ROM is constructed to generate Bb three degrees below as the duet.

As above described, the invention has an excellent advantages that the duet performance can be made automatically. Moreover, by applying the improvement (1) through (6) or (7) through (9), high degree and extremely complicated duet automatic performance becomes possible.

What is claimed is:

1. An electronic musical instrument of the type including a keyboard, and musical tone generating means for generating a musical tone corresponding to a depressed key of said keyboard, said depressed key being represented by certain depressed key information, said electronic musical instrument further comprising:

tonality designating means that designate the tonality of a musical piece to be performed independent of said depressed key information;

ensemble interval designating means for providing an ensemble interval designating information which determines an interval between the note of said depressed key and a note to be provided as an ensemble note;

ensemble tone data forming means for forming pitch data of an ensemble note in accordance with the designated tonality, the ensemble interval designating information and said depressed key information, said pitch data representing a scale tone of the designated tonality which is spaced from the depressed key tone by an interval of a degree number as is determined according to said ensemble interval designating information; and ensemble musical tone generating means for generating a musical tone signal in accordance with the ensemble pitch data thus formed.

2. An electronic musical instrument according to claim 1 wherein said ensemble tone data forming means comprises:

memory means which prestores ensemble interval data representing intervals between depressed key tones and said ensemble tones; and a calculating circuit for calculating the ensemble pitch data based on said depressed key information and said ensemble interval data read out from said memory means according to the designation by said ensemble interval designating information.

3. An electronic musical instrument according to claim 1 wherein said ensemble tone data forming means comprises:

memory means which prestores data representing ensemble note pitches, and means for selectively reading out said ensemble note pitch data in accordance with the designated tonality, the ensemble interval designating information and a depressed key information.

4. An electronic musical instrument according to claim 1 wherein said ensemble interval designating means includes:

a degree designator for providing a degree information as said ensemble interval designating information which degree information designates one of a plurality of musical interval degrees, the pitch data of an ensemble not being determined according to said designated degree.

5. A keyboard electronic musical instrument having a melody keyboard portion and an accompaniment keyboard portion, and having musical tone generating means for generating musical tones corresponding to depressed keys on said keyboard portions, said instrument further comprising:

tonality designating means for designating the tonality of a musical piece to be performed, chord determination means, cooperating with said tonality designating means, for detecting wheether a chord of the designated tonality has been played on said accompaniment keyboard portion, and ensemble tone production means, cooperating with said tonality designating means, said chord determination means and said keyboard portions, and operative in response to detection of a chord and to the playing of a note of the designated tonality on said melody keyboard portion, for producing an ensemble tone determined in accordance with the designated tonality, the detected chord and the not played on said melody keyboard portion, musical end detecting means, cooperating with said chord determination means and with said melody keyboard portion, for detecting the change of chords played on said accompaniment keyboard portion from a chord of dominant seventh to a root triad chord, and for detecting a concurrent change of the note played on said melody keyboard portion from a tone of the fourth degree with respect to the designated tonality to a tone of the third degree or from a seventh degree tone to a first degree tone, and for producing a signal indicative of such concurrent change, and wherein said ensemble tone production means cooperates with said musical end detecting means and is responsive to said signal to produce as the ensemble tone, during playing of said root triad chord, and third degree tone if the fourth degree tone was produced as the ensemble tone during the dominant seventh chord production or a first degree tone if a seventh degree tone was produced during the dominant seventh chord production.

6. An electronic musical instrument of the type including a keyboard and musical tone generating means for generating a musical tone corresponding to a depressed key of said keyboard, said depressed key being represented by certain depressed key information, said electronic musical instrument further comprising:

tonality designating means that designates the tonality of a musical piece to be performed, said tonality designator including means for designating a root note of a tonality, and means for designating one out of a major tonality and a minor tonality, ensemble tone data forming means for forming pitch data of an ensemble note in accordance with the designated tonality and said depressed key information, said pitch data representing a scale tone of the designated tonality which is spaced from the depressed key tone by a predetermined degree number; and ensemble musical tone generating means for generating a musical tone signal in accordance with the ensemble pitch data thus formed, including;

memory means which prestroes ensemble interval data representing intervals between depressed key tones and said ensemble tones; and a calculating circuit for calculating the ensemble pitch data based on said ensemble interval data read out from said memory means and said depressed key information, and wherein said memory means comprises:

a fundamental memory device for prestoring pitch data of ensemble notes in the form of data representing pitches of notes in a scale of a predetermined certain tonality which defines a fundamental tonality;

a data modifying device for modifying values of data read out of said fundamental memory device in accordance with an interval between the root note of the designated tonality and the root note of the fundamental tonality;

a data memory device for storing the modified values; and means for reading out the modified value stored in said data memory device in accordance with depressed key information.

7. An electronic music instrument according to claim 6 wherein said fundamental memory device includes:

memory means for storing pitch data of notes in a major scale of a reference tonality; and memory means for storing pitch data of notes in a minor scale of a reference tonality, whereby one of said memory means is utilized according to the designated tonality.

8. A keyboard electronic musical instrument having a melody keyboard portion and an accompaniment keyboard portion, and having musical tone generating means for generating musical tones corresponding to depressed keys on said keyboard portions, said instrument comprising:

tonality designating means for designating the tonality of a musical piece to be performed, chord determination means, cooperating with said tonality designating means, for detecting whether a chord of the designated tonality has been played on said accompaniment keyboard portion, and ensemble tone production means, cooperating with said tonality designating means, said chord determination means and said keyboard portions, and operative in response to detection of a chord and to the playing of a note of the designated tonality on said melody keyboard portion for producing an ensemble tone determined in accordance with the designated tonality, the detected chord and the scale note played on said melody keyboard.

9. An electronic musical instrument of the type including first and second keyboards, and a musical tone generator for producing musical tones corresponding to keys depressed on said first and second keyboards, said electronic musical instrument further comprising:

tonality designating means for designating the tonality of a musical piece to be performed;

ensemble tone data forming means for forming ensemble note pitch data corresponding to a melody tone designated by a depressed key of said first keyboard and to the designated tonality;

ensemble musical tone generating means for generating a musical tone signal in accordance with said formed pitch data, and wherein said ensemble tone data forming means comprises:

chord detecting means for identifying a chord from the depressed key state of said second keyboard; and data forming means for forming an ensemble pitch data in accordance with said designated tonality, the identified chord and said melody tone designated by said depressed key of said first keyboard.

10. An electronic musical instrument according to claim 9 wherein said ensemble tone data forming means comprises:

first means for forming a pitch data representing a tone which is a scale tone of said designated tonality and is spaced a predetermined number of degrees from said depressed key tone of said first keyboard; and second means for forming another pitch data instead of said pitch data formed by said first means when a certain relation among said designated tonality, said identified chord, and said depressed key tone of said first keyboard is established.

11. An electronic musical instrument according to claim 10 wherein said second means comprises:

means which, when said identified chord is constituted by the diatonic scale notes of said designated tonality and when depressed key tone of said first keyboard is the same note as one of the tones constituting said chord, forms pitch data of a tone having the same note name as one of the constituent tones of said chord and being closest to said depressed key tone.

12. An electronic musical instrument according to claim 10 wherein said second means comprises:

means which, when among the tones constituting said identified chord there is a tone which is not a diatonic note of the designated tonality, forms pitch data of a tone having the same note name as one of the constituent tones of said chord and being closest to the depressed key tone of said first keyboard.

13. An electronic musical instrument according to claim 11, wherein said second means comprises:

means which forms a pitch data of a tone having the same note name as one of the constituent tones of said chord, and which is closest to but spaced more than two degrees from the depressed key tone of said first keyboard.

14. An electronic musical instrument according to claim 10 wherein said second means comprises means which detects a chord progression for an end of a musical piece based on a relation between the designated tonality and the identified chords and also detects that an ensemble tone of a scale degree has appeared immediately before said end, which selects for the end a tone of a predetermined scale degree from amongst the scale tones of said designated tonality, and which forms a pitch data of said selected tone.

15. An electronic musical instrument according to claim 10 wherein said second means comprises:

a first circuit for storing, at an instance when a key is presently being depressed, information of a tone of a key of said first keyboard depressed immediately before said presently depressed key;

a second circuit for storing an ensemble note pitch data which is formed corresponding to the tone of the key depressed immediately before said presently depressed key, and a third circuit which, when the now-being-depressed key tone of said first keyboard is not a diatonic scale tone of the designated tonality, shifts the pitch data of the ensemble note stored in said second circuit by a value representing an interval which is the same as a melodic interval between a previously depressed key tone and the presently depressed key tone thereby forming a present ensemble note pitch data.

16. An electronic musical instrument according to claim 15 wherein said third circuit comprises a circuit which, only when the melodic interval between the tone of the key depressed immediately before the presently depressed key and the tone of the presently depressed key is within an interval range of predetermined degrees, shifts the pitch data of the ensemble note stored in said second circuit by a value representing an interval which is the same as said melodic interval for forming a present ensemble note pitch data, whereas, when said melodic interval exceeds the interval range of said predetermined degrees, forms pitch data having the same note as the chord constituting tone and closest to the presently depressed key tone.

17. An electronic musical instrument according to claim 10 wherein said second means comprises:

means which, when said identified chord is constituted by diatonic scale tones of the designated tonality and when the depressed key tone of said first keyboard is a non-diatonic scale tcne and is adjacent to one of said chord constituting tones, forms a pitch data having the same note as said chord constituting tone and closest to said depressed key tone.

18. An electronic musical instrument according to claim 9 wherein said tonality designating means comprises:

memory means for storing tonality designation codes each being made up of a data representing a root note of the tonality and a data representing a major/minor kind of the tonality; and means for storing in said memory means as said tonality designation code a data representing a root note and a major/minor kind of the chord identified by said chord detecting means.

19. A keyboard electronic musical instrument having a melody keyboard portion and an accompaniment keyboard portion, and having musical tone generating means for generating musical tones corresponding to depressed keys on said keyboard portions, said instrument further comprising:

tonality designating means for designating the tonality of a musical piece to be performed, chord determination means, cooperating with said tonality designating means, for detecting whether a diatonic chord of the designated tonality has been played on said accompaniment keyboard portion, and ensemble tone production means, cooperating with said tonality designating means, said chord determination means and said keyboard portions, and operative in response to the detection of a diatonic chord and to the playing of a diatonic scale note of the designated tonality on said melody keyboard portion, for producing as an ensemble tone a tone that is spaced by a predetermined number of degrees from said played diatonic scale note.

20. An electronic musical instrument according to claim 19 wherein:

said chord determination means includes means for detecting that a non-diatonic chord of the designated tonality has been played on said accompaniment keyboard portion, and wherein:

said ensemble tone production means is operative, in response to the detection of a non-diatonic chord and to the playing of any note on said melody keyboard portion, for producing as an ensemble tone a tone which corresponds in note name to one of the constituent tones of said detected non-diatonic chord and which is lower than and closest to the note played on said melody keyboard portion, but which is spaced therefrom by greater than a major second.

21. An electronic musical instrument according to claim 19 wherein:

said ensemble tone production means is operative in response to the detection of a diatonic chord and to the playing on said melody keyboard portion of a note which corresponds to one of the chord constituting tones, for producing instead as said ensemble tone the tone from among the chord constituting tones which is lower than said melody tone and closest thereto.

22. An electronic musical instrument according to claim 20 wherein, if the ensemble tone currently intended to be produced by said production means differs greatly from the immediately preceding ensemble tone, then said ensemble tone production means will produce instead as the current ensemble tone that tone, from among the tones constituting said non-diatonic chord which is closest to said preceding ensemble tone and which lies between said preceding ensemble tone and said ensemble tone currently intended to be produced, or if no such chord constituting tone lies therebetween, will produce as the current ensemble tone that chord constituting tone closest to said preceding ensemble tone.

23. An electronic musical instrument according to claim 21 wherein, if the ensemble tone currently intended to be produced by said production means differs greatly from the immediately preceding ensemble tone, then said ensemble tone production means will produce instead as the current ensemble tone that tone from among the tones constituting said diatonic chord which is closest to said preceding ensemble tone and which lies between said preceding ensemble tone and said ensemble tone currently intended to be produced, or if no such chord constituting tone lies therebetween, will produce as the current ensemble tone that chord constituting tone closest to said preceding ensemble tone.

24. An electronic musical instrument according to claim 22 wherein, if the tone to be produced as said current ensemble tone is a perfect interval with respect to the note played on said melody keyboard portion, so that the frequency ratio therebetween is expressed by a simple integer, said production means will produce instead as the ensemble tone that chord constituting tone which is adjacent to said perfect interval tone.

25. An electronic musical instrument according to claim 23 wherein, if the tone to be produced as said current ensemble tone is a perfect interval with respect to the note played on said melody keyboard portion, so that the frequency ratio therebetween is expressed by a simple integer, said production means will produce instead as the ensemble tone that chord constituting tone which is adjacent to said perfect interval tone.

26. An electronic musical instrument according to claim 19 and operative when said chord determination means detects that a diatonic chord is played on said accompaniment keyboard portion and when a non-diatonic tone of the designated tonality is played on said melody keyboard portion, said instrument further comprising:

melody motion determination means for determining the melodic interval between the tone presently being played on said melody keyboard portion and the immediately preceding tone played on said melody keyboard portion, said ensemble tone production means cooperating with said motion determination means to produce instead as the current ensemble tone a tone which is of an interval with respect to the immediately preceding ensemble tone that is the same as the melodic interval determined by said melody interval determining means, in the event that said melodic interval is equal to or shorter than a major second, and to produce instead, when said determined melodic interval is longer than a major second, as the current ensemble tone a tone which is one of the tones constituting the chord being played on said accompaniment keyboard portion and which is closest to but more than a major second interval apart from and lower than the tone presently being played on said melody keyboard portion.

27. An electronic musical instrument according to claim 9 further comprising:

ensemble interval designating means for providing an ensemble interval designating information which determines an interval between the note of said depressed key on said first keyboard and a note to be provided as an ensemble note; and wherein said ensemble tone data forming means forms said ensemble note pitch data corresponding to said ensemble interval designating information as well as to said designated melody tone and said designated tonality.

* * * * *